US012703958B2

(12) United States Patent
Izumikawa

(10) Patent No.: US 12,703,958 B2
(45) Date of Patent: Aug. 11, 2026

(54) SHOVEL AND CONSTRUCTION SYSTEM

(71) Applicant: SUMITOMO CONSTRUCTION MACHINERY CO., LTD., Tokyo (JP)

(72) Inventor: Takeya Izumikawa, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 883 days.

(21) Appl. No.: 17/448,725

(22) Filed: Sep. 24, 2021

(65) Prior Publication Data

US 2022/0010521 A1 Jan. 13, 2022

Related U.S. Application Data

(63) Continuation of application No. PCT/JP2020/014377, filed on Mar. 27, 2020.

(30) Foreign Application Priority Data

Mar. 28, 2019 (JP) ..... 2019-065020

(51) Int. Cl.
*E02F 9/20* (2006.01)
*E02F 3/43* (2006.01)
(Continued)

(52) U.S. Cl.
CPC ..... *E02F 3/437* (2013.01); *E02F 3/434* (2013.01); *E02F 9/2033* (2013.01);
(Continued)

(58) Field of Classification Search
CPC ..... E02F 3/422; E02F 3/434; E02F 9/2004; E02F 9/2033; E02F 9/2041; E02F 9/2045;
(Continued)

(56) References Cited

U.S. PATENT DOCUMENTS 5,960,378 A * 9/1999 Watanabe ..... E02F 3/32 37/415
6,076,029 A * 6/2000 Watanabe ..... E02F 3/437 37/340
(Continued)

FOREIGN PATENT DOCUMENTS

EP 2757782 7/2014
JP 03295933 A * 12/1991
(Continued)

OTHER PUBLICATIONS

EPO machine translation of JP 03-295934A (original JP document published Dec. 26, 1991) (Year: 1991).*
(Continued)

*Primary Examiner* — David A Testardi
(74) *Attorney, Agent, or Firm* — IPUSA, PLLC

(57) ABSTRACT

A shovel includes a lower traveling body, an upper turning body turnably mounted on the lower traveling body, an attachment attached to the upper turning body, and a controller provided to the upper turning body. The controller is configured to set a predetermined condition on movement of the lower traveling body, and provide information on stopping the movement of the lower traveling body upon determining that the predetermined condition is satisfied.

14 Claims, 24 Drawing Sheets

(51) Int. Cl.
*E02F 9/22* (2006.01)
*E02F 9/26* (2006.01)

(52) U.S. Cl.
CPC ..... *E02F 9/2041* (2013.01); *E02F 9/22* (2013.01); *E02F 9/26* (2013.01)

(58) Field of Classification Search
CPC . E02F 9/205; E02F 3/435; E02F 3/437; E02F 9/24; E02F 9/26; E02F 9/262; E02F 9/265
See application file for complete search history.

(56) References Cited

U.S. PATENT DOCUMENTS 6,167,336 A * 12/2000 Singh ..... E02F 9/2045 701/50
10,527,731 B2 1/2020 Kinoshita et al.
2008/0127529 A1* 6/2008 Stanek ..... E02F 3/435 37/348
2008/0127531 A1* 6/2008 Stanek ..... E02F 9/2004 701/50
2008/0133093 A1* 6/2008 Stanek ..... E02F 9/20 37/468
2008/0133094 A1* 6/2008 Stanek ..... E02F 9/2041 37/468
2012/0136508 A1* 5/2012 Taylor ..... E02F 9/262 701/25
2012/0327261 A1* 12/2012 Tafazoli Bilandi ..... E02F 9/24 348/E5.022
2013/0222573 A1* 8/2013 Onuma ..... E02F 9/24 348/82
2013/0271274 A1* 10/2013 Ebert ..... E02F 9/2054 340/435
2014/0354813 A1* 12/2014 Ishimoto ..... G06T 11/60 348/148
2016/0145827 A1* 5/2016 Kami ..... E02F 3/30 701/50
2017/0089033 A1* 3/2017 Matsuyama ..... E02F 9/2285
2018/0038067 A1* 2/2018 Hashimoto ..... E02F 9/262
2018/0258616 A1* 9/2018 Kiyota ..... G06T 1/00
2019/0003152 A1* 1/2019 Nakamura ..... E02F 9/264
2019/0360177 A1* 11/2019 Kiyota ..... B60R 1/23
2020/0048871 A1* 2/2020 Nishizawa ..... E02F 9/265
2020/0165799 A1* 5/2020 Wu ..... E02F 9/2033
2020/0340205 A1* 10/2020 Naito ..... E02F 9/262
2020/0407948 A1* 12/2020 Seki ..... G06V 20/58
2021/0010243 A1* 1/2021 Fukuoka ..... E02F 9/261
2021/0047798 A1* 2/2021 Kamimura ..... E02F 9/24
2021/0332566 A1* 10/2021 Shintani ..... E02F 3/435
2021/0381195 A1* 12/2021 Mura ..... E02F 9/2228
2022/0195703 A1* 6/2022 Takaoka ..... E02F 3/841

FOREIGN PATENT DOCUMENTS

JP 03295934 A * 12/1991
JP 04161525 A * 6/1992
JP 05033363 A * 2/1993
JP 08253950 A * 10/1996 ..... E02F 9/2207
JP 2000-291076 10/2000
JP 2000291076 A * 10/2000
JP 2000352076 A * 12/2000
JP 2003-105807 4/2003
JP 2004251024 A * 9/2004
JP 2006333834 A * 12/2006
JP 2013-151830 8/2013
JP 2013151830 A * 8/2013
JP 2013-217137 10/2013
JP 2013217137 A * 10/2013
JP 2019-039206 3/2019
JP 2019-173467 10/2019
KR 20170086968 A * 7/2017
WO 1998/036131 8/1998
WO WO-2017002749 A1 * 1/2017 ..... E02F 9/20
WO WO-2017061518 A1 * 4/2017 ..... G01B 11/245
WO WO-2017094626 A1 * 6/2017 ..... E02F 9/26
WO 2018/025512 2/2018
WO WO-2018151280 A1 * 8/2018 ..... B60R 1/00
WO WO-2019026802 A1 * 2/2019 ..... E02F 3/651
WO WO-2019049309 A1 * 3/2019 ..... B60K 35/00

OTHER PUBLICATIONS

EPO machine translation of JP 03-295933A (original JP document published Dec. 26, 1991) (Year: 1991).*
EPO machine translation of JP 05-33363A (original JP document published Feb. 9, 1993) (Year: 1993).*
EPO machine translation of Jp 2004-251024A (original JP document published Sep. 9, 2004 (Year: 2004).*
Jo, Byung-Wan et al., "Proximity Warning and Excavator Control System for Prevention of Collision Accidents", Sustainability 2017, 9, 1488; doi:10.3390/su9081488, MDPI, 20 pages (Year: 2017).*
International Search Report for PCT/JP2020/014377 mailed on Jun. 16, 2020.

* cited by examiner

SHOVEL AND CONSTRUCTION SYSTEM

CROSS-REFERENCE TO RELATED APPLICATION

The present application is a continuation of International Application No. PCT/JP2020/014377, filed on Mar. 27, 2020, which claims priority to Japanese Application No. JP2019-065020, filed on Mar. 28, 2019, the entire content of each of which is incorporated herein by reference.

BACKGROUND

Technical Field

The disclosures herein relate to a shovel and a construction system.

Description of Related Art

In related art, a shovel having a function to automatically adjust the bucket tip position during work for forming a slope is known.

SUMMARY

According to an embodiment of the present invention, a shovel includes a lower traveling body, an upper turning body turnably mounted on the lower traveling body, an attachment attached to the upper turning body, and a controller provided to the upper turning body. The controller is configured to set a predetermined condition on movement of the lower traveling body, and provide information on stopping the movement of the lower traveling body upon determining that the predetermined condition is satisfied.

According to another embodiment of the present invention, a shovel includes a lower traveling body, a traveling hydraulic motor configured to move the lower traveling body, an upper turning body turnably mounted on the lower traveling body, an attachment attached to the upper turning body, and a controller provided to the upper turning body. The controller is configured to set a predetermined condition on movement of the lower traveling body, and control the traveling hydraulic motor to stop the movement of the lower traveling body upon determining that the predetermined condition is satisfied.

According to a further embodiment of the present invention, a construction system for assisting construction work to be performed using a shovel is provided. The shovel includes a lower traveling body, an upper turning body turnably mounted on the lower traveling body, an attachment attached to the upper turning body, and a controller provided to the upper turning body. The construction system includes a communication device configured to communicate with the shovel, and a control device. The control device is configured to set a predetermined condition on movement of the lower traveling body, and upon determining that the predetermined condition is satisfied, output information on stopping the movement of the lower traveling body to the shovel via the communication device.

According to a further embodiment of the present invention, a construction system for assisting construction work to be performed using a shovel is provided. The shovel includes a lower traveling body, a traveling hydraulic motor configured to move the lower traveling body, an upper turning body turnably mounted on the lower traveling body, and an attachment attached to the upper turning body. The construction system includes a communication device configured to communicate with the shovel, and a control device. The control device is configured to set a predetermined condition on movement of the lower traveling body, and upon determining that the predetermined condition is satisfied, output information on stopping the movement of the lower traveling body to the shovel via the communication device such that the traveling hydraulic motor is controlled to stop the movement of the lower traveling body.

BRIEF DESCRIPTION OF THE DRAWINGS

Other objects and further features of the present invention will be apparent from the following detailed description when read in conjunction with the accompanying drawings, in which.

DETAILED DESCRIPTION

The shovel according to the related art only has a function to automatically adjust the bucket tip position along the slope during the operation of the excavation attachment when the travel operation of the shovel is not performed. Therefore, during slope finishing work, each time a slope area having a width corresponding to the width of the bucket is finished, the operator needs to move the shovel in the extending direction of the slope in order to finish an adjacent slope area. In this case, there is a possibility that the operator may excessively move the shovel.

In view of the above, it is desirable to provide a shovel whose movement during slope forming work or leveling work can be assisted.

Figure 1:
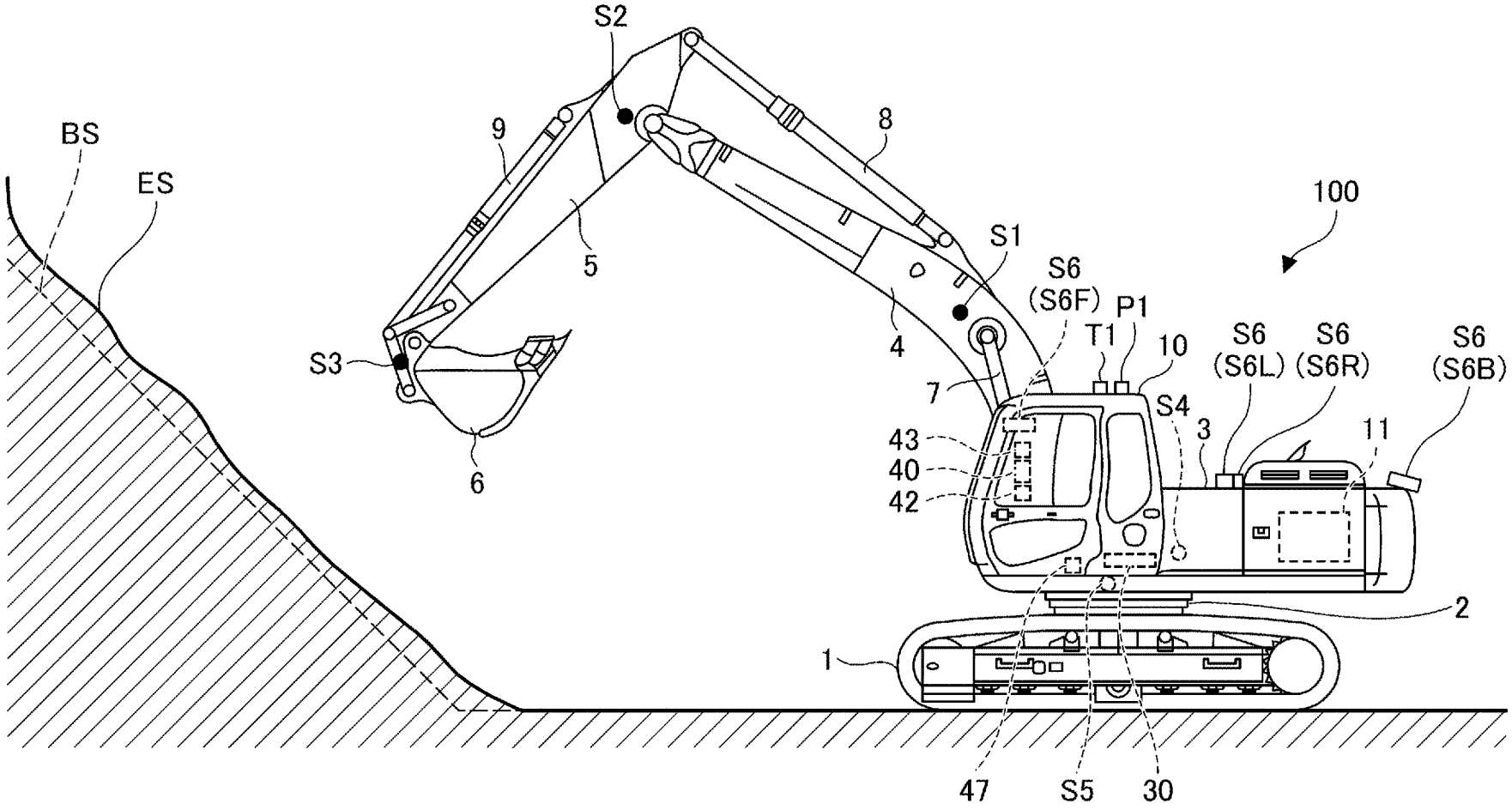
FIG. 1 is a side view of a shovel according to an embodiment of the present invention.

FIG. 1 is a side view of a shovel 100 serving as an excavator according to an embodiment of the present invention. An upper turning body 3 is turnably mounted on a lower traveling body 1 of the shovel 100 via a turning mechanism 2. A boom 4 is attached to the upper turning body 3. An arm 5 is attached to the tip of the boom 4, and a bucket 6 serving as an end attachment is attached to the tip of the arm 5.

The boom 4, the arm 5, and the bucket 6 form an excavation attachment that is an example of an attachment. The boom 4 is driven by a boom cylinder 7, the arm 5 is driven by an arm cylinder 8, and the bucket 6 is driven by a bucket cylinder 9. A boom angle sensor S1 is attached to the boom 4, an arm angle sensor S2 is attached to the arm 5, and a bucket angle sensor S3 is attached to the bucket 6.

The boom angle sensor S1 is configured to detect the rotation angle of the boom 4. According to the present embodiment, the boom angle sensor S1 is an acceleration sensor, and can detect the rotation angle of the boom 4 relative to the upper turning body 3 (hereinafter referred to as a "boom angle"). For example, the boom angle is smallest when the boom 4 is lowest and increases as the boom 4 is raised.

The arm angle sensor S2 is configured to detect the rotation angle of the arm 5. According to the present embodiment, the arm angle sensor S2 is an acceleration sensor, and can detect the rotation angle of the arm 5 relative to the boom 4 (hereinafter referred to as a "arm angle"). For example, the arm angle is smallest when the arm 5 is most closed and increases as the arm 5 is opened.

The bucket angle sensor S3 is configured to detect the rotation angle of the bucket 6. According to the present embodiment, the bucket angle sensor S3 is an acceleration sensor and can detect the rotation angle of the bucket 6 relative to the arm 5 (hereinafter referred to as a "bucket angle"). For example, the bucket angle is smallest when the bucket 6 is most closed and increases as the bucket 6 is opened.

Each of the boom angle sensor S1, the arm angle sensor S2, and the bucket angle sensor S3 may alternatively be a potentiometer using a variable resistor, a stroke sensor that detects the stroke amount of a corresponding hydraulic cylinder, a rotary encoder that detects a rotation angle about a link pin, an inertial measurement unit, a gyroscope, a combination of an acceleration sensor and a gyroscope, or the like.

A cabin 10 that is a cab is provided on the upper turning body 3 and a power source such as an engine 11 is mounted on the upper turning body 3. A controller 30, a display device 40, an input device 42, an audio output device 43, a storage device 47, a body tilt sensor S4, a turning angular velocity sensor S5, a camera S6, a communication device T1, and a positioning device P1 are provided to the upper turning body 3.

The controller 30 is configured to operate as a control device to control the driving of the shovel 100. According to the present embodiment, the controller 30 is constituted of a computer including a CPU, a RAM, a ROM, and the like. Various functions provided by the controller 30 are implemented by the CPU executing programs stored in the ROM, for example. The various functions include, for example, a machine guidance function to guide (give directions to) an operator in manually operating the shovel 100 and a machine control function to automatically assist the operator in manually operating the shovel 100. A machine guidance device 50 (see FIG. 2) included in the controller 30 is configured to execute the machine guidance function and the machine control function.

The display device 40 is configured to display various kinds of information. The display device 40 may be connected to the controller 30 via a communications network such as a CAN or may be connected to the controller 30 via a dedicated line.

The input device 42 is configured so as to enable the operator to input various kinds of information into the controller 30. The input device 42 includes, for example, at least one of a touchpanel, a knob switch, a membrane switch, etc., provided in the cabin 10.

The audio output device 43 is configured to output audio information. The audio output device 43 may be, for example, an in-vehicle loudspeaker connected to the controller 30 or an alarm such as a buzzer. According to the present embodiment, the audio output device 43 is configured to output a variety of pieces of information in response to a sound output command from the controller 30.

The storage device 47 is configured to store various kinds of information. Examples of the storage device 47 include a nonvolatile storage medium such as a semiconductor memory. The storage device 47 may store information output from various devices while the shovel 100 is in operation, and may store information obtained through various devices before the shovel 100 starts to operate. The storage device 47 may store, for example, data on an intended work surface obtained through the communication device T1 or the like. The intended work surface may be set by the operator of the shovel 100 or may be set by a work manager or the like.

The body tilt sensor S4 is configured to detect the inclination of the upper turning body 3. According to the present embodiment, the body tilt sensor S4 is an acceleration sensor that detects the inclination of the upper turning body 3 relative to a horizontal plane. The body tilt sensor S4 may be a combination of an acceleration sensor and a gyroscope or may be an inertial measurement unit or the like. The body tilt sensor S4 detects, for example, the tilt angle of the upper turning body 3 about its longitudinal axis and the tilt angle of the upper turning body 3 about its lateral axis. For example, the longitudinal axis and the lateral axis of the upper turning body 3 cross each other at right angles at the shovel center point that is a point on the turning axis of the shovel 100.

The turning angular velocity sensor S5 is configured to detect the turning angular velocity and the turning angle of the upper turning body 3. According to the present embodiment, the turning angular velocity sensor S5 is a gyroscope. The turning angular velocity sensor S5 may also be a resolver, a rotary encoder, or the like.

The camera S6 is configured to capture an image of an area surrounding the shovel 100. According to the present embodiment, the camera S6 includes a front camera S6F that captures an image of a space in front of the shovel 100, a left camera S6L that captures an image of a space to the left of the shovel 100, a right camera S6R that captures an image of a space to the right of the shovel 100, and a back camera S6B that captures an image of a space behind the shovel 100.

The camera S6 is, for example, a monocular camera including an imaging device such as a CCD or a CMOS, and outputs captured images to the display device 40. The camera S6 may be a stereo camera, a range imaging camera, or the like.

The front camera S6F is attached to, for example, the ceiling of the cabin 10, namely, the inside of the cabin 10. The front camera S6F may alternatively be attached to the roof of the cabin 10, namely, the outside of the cabin 10. The left camera S6L is attached to the left end of the upper surface of the upper turning body 3. The right camera S6R is attached to the right end of the upper surface of the upper turning body 3. The back camera S6B is attached to the back end of the upper surface of the upper turning body 3.

The communication device T1 is configured to control communications with external devices outside the shovel 100. According to the present embodiment, the communication device T1 controls communications with external devices via a satellite communications network, a cellular phone network, the Internet, or the like.

The positioning device P1 is configured to measure the position of the upper turning body 3. The positioning device P1 may also be configured to measure the position and the orientation of the upper turning body 3. The positioning device P1 is, for example, a GNSS compass. The positioning device P1 detects the position and the orientation of the upper turning body 3, and outputs detection values to the controller 30. Therefore, the positioning device P1 can also operate as an orientation detector to detect the orientation of the upper turning body 3. The orientation detector may be an azimuth sensor attached to the upper turning body 3.

Figure 2:
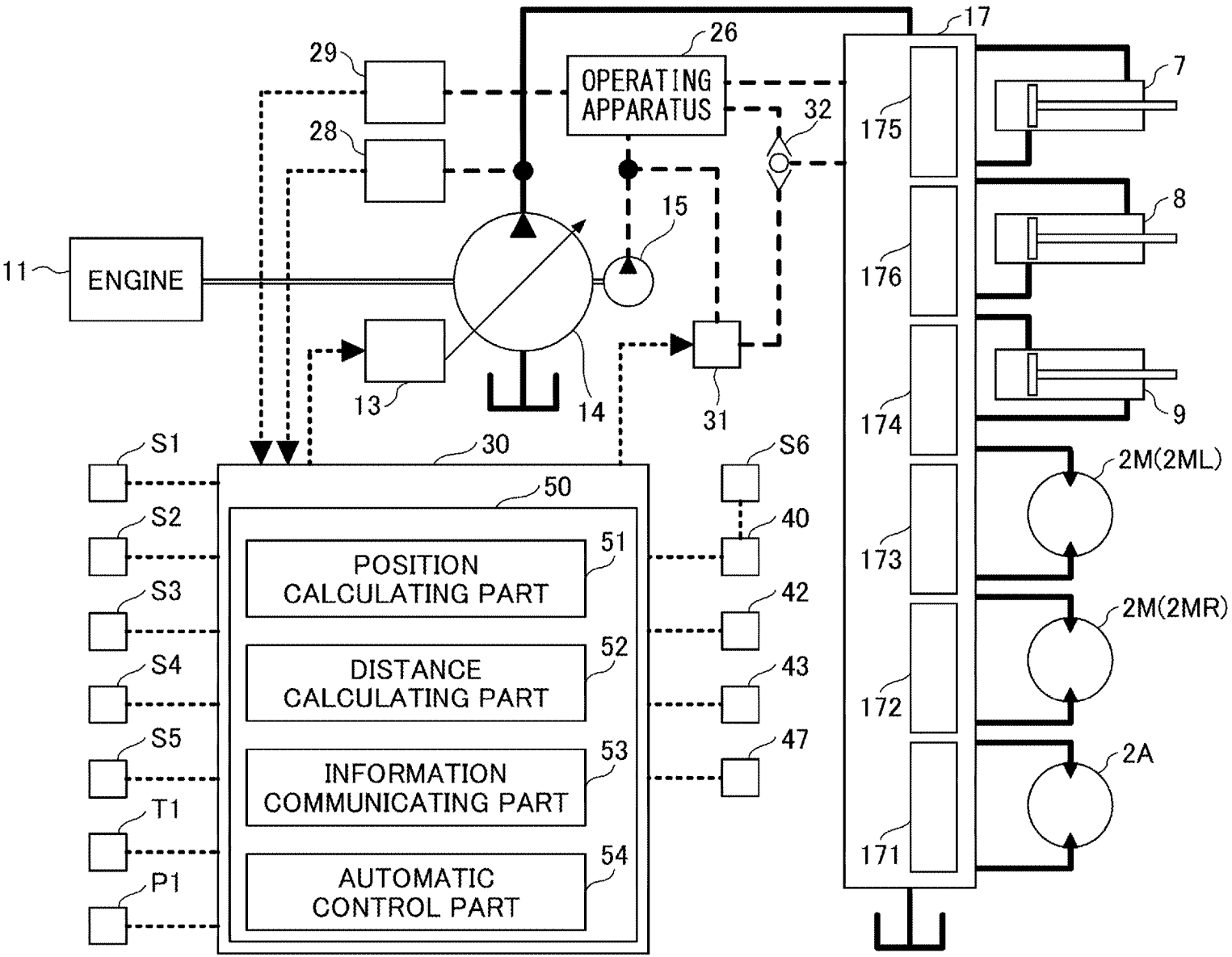
FIG. 2 is a block diagram illustrating an example configuration of a basic system of the shovel of FIG. 1.

FIG. 2 is a block diagram illustrating an example configuration of a basic system of the shovel 100, in which a mechanical power transmission line, a hydraulic oil line, a pilot line, and an electric control line are indicated by a double line, a continuous line, a dashed line, and a dotted line, respectively.

The basic system of the shovel 100 mainly includes the engine 11, a regulator 13, a main pump 14, a pilot pump 15, a control valve 17, an operating apparatus 26, a discharge pressure sensor 28, an operating pressure sensor 29, the controller 30, and a proportional valve 31.

The engine 11 is a drive source of the shovel 100. According to the present embodiment, the engine 11 is a diesel engine that operates so as to maintain a predetermined rotational speed. The output shaft of the engine 11 is coupled to the respective input shafts of the main pump 14 and the pilot pump 15.

The main pump 14 is configured to supply hydraulic oil to the control valve 17 via a hydraulic oil line. According to the present embodiment, the main pump 14 is a swash plate variable displacement hydraulic pump.

The regulator 13 is configured to control the discharge quantity of the main pump 14. According to the present embodiment, the regulator 13 controls the discharge quantity of the main pump 14 by adjusting the swash plate tilt angle of the main pump 14 in response to a control command from the controller 30. For example, the controller 30 receives the output of the operating pressure sensor 29 or the like, and outputs a control command to the regulator 13 to vary the discharge quantity of the main pump 14 on an as-needed basis.

The pilot pump 15 is configured to supply hydraulic oil to various hydraulic control apparatuses including the operating apparatus 26 and the proportional valve 31 via a pilot line. According to the present embodiment, the pilot pump 15 is a fixed displacement hydraulic pump. However, the pilot pump 15 may be omitted. In this case, in place of the pilot pump 15, the main pump 14 may be configured to supply hydraulic oil to various hydraulic control apparatuses.

The control valve 17 is a hydraulic control device that controls a hydraulic system in the shovel 100. The control valve 17 includes control valves 171 through 176. The control valve 17 can selectively supply hydraulic oil discharged by the main pump 14 to one or more hydraulic actuators through the control valves 171 through 176. The control valves 171 through 176 control the flow rate of hydraulic oil flowing from the main pump 14 to hydraulic actuators and the flow rate of hydraulic oil flowing from hydraulic actuators to a hydraulic oil tank. The hydraulic actuators include the boom cylinder 7, the arm cylinder 8, the bucket cylinder 9, a traveling hydraulic motor 2M, and a turning hydraulic motor 2A. The traveling hydraulic motor 2M includes a left traveling hydraulic motor 2ML and a right traveling hydraulic motor 2MR. The turning hydraulic motor 2A may alternatively be a turning electric motor serving as an electric actuator.

The operating apparatus 26 is an apparatus that the operator uses to operate actuators. The actuators include at least one of a hydraulic actuator and an electric actuator. According to the present embodiment, the operating apparatus 26 supplies hydraulic oil discharged by the pilot pump 15 to a pilot port of a corresponding control valve in the control valve 17 via a pilot line. The operating apparatus 26 generates and adjusts a pressure (pilot pressure) of hydraulic oil supplied to a pilot port of a corresponding control valve. The pilot pressure is, in principle, a pressure commensurate with the amount of operation of the operating apparatus 26 for a corresponding hydraulic actuator. At least one of operating apparatuses 26 is configured to be able to supply hydraulic oil discharged by the pilot pump 15 to a pilot port of a corresponding control valve in the control valve 17 via a pilot line and a shuttle valve 32.

The discharge pressure sensor 28 is configured to detect the discharge pressure of the main pump 14. According to the present embodiment, the discharge pressure sensor 28 outputs the detected value to the controller 30.

The operating pressure sensor 29 is configured to detect a pilot pressure generated by the operating apparatus 26. According to the present embodiment, the operating pressure sensor 29 detects the amount of operation of the operating apparatus 26 corresponding to each actuator in the form of pressure, and outputs the detected value to the controller 30. The amount of operation of the operating apparatus 26 may be detected by a sensor other than the operating pressure sensor.

The proportional valve 31, functioning as a control valve for machine control, is placed in a conduit connecting the pilot pump 15 and the shuttle valve 32, and is configured to be able to change the flow area of the conduit. According to the present embodiment, the proportional valve 31 operates in response to a control command output from the controller 30. Therefore, the controller 30 can supply hydraulic oil discharged by the pilot pump 15 to a pilot port of a corresponding control valve in the control valve 17 via the proportional valve 31 and the shuttle valve 32, independent of the operator's operation of the operating apparatus 26.

The shuttle valve 32 includes two inlet ports and one outlet port. Of the two inlet ports, one is connected to the operating apparatus 26 and the other is connected to the proportional valve 31. The outlet port is connected to a pilot port of a corresponding control valve in the control valve 17. Therefore, the shuttle valve 32 can cause the higher one of a pilot pressure generated by the operating apparatus 26 and a pilot pressure generated by the proportional valve 31 to act on a pilot port of a corresponding control valve.

According to this configuration, the controller 30 can operate a hydraulic actuator corresponding to a specific operating apparatus 26 independent of the operator's operation with respect to the specific operating apparatus 26.

Next, the machine guidance device 50 included in the controller 30 will be described. The machine guidance device 50 is configured to execute the machine guidance function, for example. According to the present embodiment, the machine guidance device 50, for example, notifies the operator of work information such as the distance between the intended work surface and the working part of the attachment. Data on the intended work surface are stored in, for example, the storage device 47 in advance. The data on the intended work surface is expressed in, for example, a reference coordinate system. The reference coordinate system is, for example, the world geodetic system. The world geodetic system is a three-dimensional orthogonal XYZ coordinate system with its origin at the center of earth's gravity, its X-axis in the direction of the intersection of the Greenwich meridian and equator, its Y-axis in the direction of 90 degrees east longitude, and its Z-axis in the direction of the Arctic. However, the operator may set any point at a construction site as a reference point and set the intended work surface based on the relative positional relationship between each point of the intended work surface and the reference point. The working part of the attachment is, for example, the tip of the bucket 6, the back surface of the bucket 6, or the like. The machine guidance device 50 provides guidance on operating the shovel 100 by notifying the operator of the work information via at least one of the display device 40, the audio output device 43, and the like.

The machine guidance device 50 may execute the machine control function to automatically assist the operator in manually operating the shovel 100. For example, when the operator is manually performing an excavation operation, the machine guidance device 50 may automatically operate at least one of the boom 4, the arm 5, and the bucket 6 such that the position of the tip of the bucket 6 coincides with the intended work surface.

The machine guidance device 50, which is incorporated into the controller 30 according to the present embodiment, may be a control device provided separately from the controller 30. In this case, for example, similar to the controller 30, the machine guidance device 50 is constituted of a computer including a CPU, a RAM, a ROM, and the like. The CPU executes programs stored in the ROM or the like to implement various functions provided by the machine guidance device 50. The machine guidance device 50 and the controller 30 are communicably connected to each other through a communications network such as a CAN.

Specifically, the machine guidance device 50 obtains information from at least one of the boom angle sensor S1, the arm angle sensor S2, the bucket angle sensor S3, the body tilt sensor S4, the turning angular velocity sensor S5, the camera S6, the positioning device P1, the communication device T1, the input device 42, etc. Then, the machine guidance device 50, for example, calculates the distance between the bucket 6 and the intended work surface based on the obtained information, and notifies the operator of the shovel 100 of the distance between the bucket 6 and the intended work surface through at least one of audio and image display.

The machine guidance device 50 includes a position calculating part 51, a distance calculating part 52, an information communicating part 53, and an automatic control part 54 as functional elements. Although the position calculating part 51, the distance calculating part 52, the information communicating part 53, and the automatic control part 54 are illustrated as separate components for explanation purposes, the position calculating part 51, the distance calculating part 52, the information communicating part 53, and the automatic control part 54 are not necessarily physically separated, and may be entirely or partially implemented by a common software component or hardware component.

The position calculating part 51 is configured to calculate the position of a measurement target. According to this embodiment, the position calculating part 51 calculates the coordinate point of the working part of the attachment in the reference coordinate system. Specifically, the position calculating part 51 calculates the coordinate point of the tip of the bucket 6 from the respective rotation angles of the boom 4, the arm 5, and the bucket 6. The position calculating part 51 may calculate not only the coordinate point of the center of the tip of the bucket 6, but also the coordinate point of the left end of the tip of the bucket 6 and the coordinate point of the right end of the tip of the bucket 6.

The distance calculating part 52 is configured to calculate the distance between two positioning targets. According to the present embodiment, the distance calculating part 52 calculates the vertical distance between the tip of the bucket 6 and the intended work surface. The distance calculating part 52 may calculate the distance (for example, the vertical distance) between the intended work surface and the coordinate point of each of the left end and the right end of the tip of the bucket 6 such that the machine guidance device 50 can determine whether the shovel 100 front-faces the intended work surface.

Further, the distance calculating part 52 is configured to calculate the distance between a specific virtual plane and a specific positioning target. The specific virtual plane is, for example, a virtual plane including the normal to the intended work surface such as a slope. The specific positioning target is, for example, a shovel center point, which is an example of a predetermined part of the shovel 100. The specific virtual plane and the specific positioning target are utilized to assist the movement of the shovel during finishing work. The arrangement of such specific virtual planes may be preset or may be dynamically set. According to the present embodiment, the distance calculating part 52 is configured to calculate the linear distance between a virtual plane including the normal to an upward slope BS (see FIG. 1) and the shovel center point (hereinafter referred to as a "remaining distance"). That is, the remaining distance refers to the linear distance between the shovel center point and an adjacent virtual plane including the normal to the upward slope BS at the next predetermined position to which the shovel 100 moves after finishing a slope area of the upward slope BS at the current predetermined position during slope finishing work.

The information communicating part 53 is configured to communicate various kinds of information to the operator of the shovel 100. According to the present embodiment, the information communicating part 53 notifies the operator of the shovel 100 of each of the various distances calculated by the distance calculating part 52. Specifically, the information communicating part 53 uses visual information and auditory information to notify the operator of the shovel 100 of the vertical distance between the tip of the bucket 6 and the intended work surface.

For example, the information communicating part 53 may use intermittent sounds through the audio output device 43 to notify the operator of the vertical distance between the tip of the bucket 6 and the intended work surface. In this case, the information communicating part 53 may reduce the interval between intermittent sounds as the vertical distance decreases. The information communicating part 53 may use a continuous sound, and may represent variations in the vertical distance by changing the pitch, loudness, or the like of the sound. Further, when the tip of the bucket 6 is positioned lower than the intended work surface, the information communicating part 53 may issue an alarm. The alarm is, for example, a continuous sound significantly louder than the intermittent sounds.

Further, in order to assist the movement of the shovel during finishing work, the information communicating part 53 may be configured to set a predetermined condition on the movement of the lower traveling body 1, and provide information on stopping the movement of the lower traveling body 1 when the predetermined condition is satisfied. In this case, the predetermined condition includes the remaining distance between a virtual plane and the shovel center point being less than or equal to a threshold. The threshold may be a preset value or may be a dynamically calculated value.

For example, the information communicating part 53 may be configured to use visual information and auditory information to continuously notify the operator of the shovel 100 of the remaining distance while the shovel 100 is traveling. For example, when the predetermined condition is satisfied, the information communicating part 53 may start a function for notifying the operator of the remaining distance by using intermittent sounds through the audio output device 43. In this case, the information communicating part 53 may reduce the interval between intermittent sounds as the remaining distance decreases. The information communicating part 53 may use a continuous sound, and may represent variations in the remaining distance by changing the pitch, loudness, or the like of the sound. Further, the information communicating part 53 may issue an alarm when the remaining distance becomes a negative value, that is, when the shovel center point goes beyond a virtual plane. The alarm is, for example, a continuous sound significantly louder than the intermittent sounds. Further, the information communicating part 53 may be configured to issue an alarm when it is determined that the shovel center point reaches a virtual plane, that is, the remaining distance is less than or equal to a predetermined value (such as zero).

The information communicating part 53 may display the vertical distance between the tip of the bucket 6 and the intended work surface on the display device 40 as work information. For example, the display device 40 displays the work information received from the information communicating part 53 on a screen, together with image data received from the camera S6. The information communicating part 53 may use an image of an analog meter, an image of a bar graph indicator, or the like to notify the operator of the vertical distance or the remaining distance.

The automatic control part 54 is configured to automatically assist the operator in manually operating the shovel 100 by automatically moving actuators. For example, the automatic control part 54 may automatically extend or retract at least one of the boom cylinder 7, the arm cylinder 8, and the bucket cylinder 9 such that the position of the tip of the bucket 6 coincides with the intended work surface, while the operator is manually performing an arm closing operation. In this case, for example, by simply operating an arm operating lever in a closing direction, the operator can close the arm 5 while causing the position of the tip of the bucket 6 to coincide with the intended work surface. This automatic control may be executed upon a predetermined switch, included in the input device 42, being pressed. The predetermined switch is, for example, a machine control switch (hereinafter referred to as a "MC switch"), and may be positioned, as a knob switch, at the tip of the operating apparatus 26.

The automatic control part 54 may cause the turning hydraulic motor 2A to automatically rotate such that the upper turning body 3 front-faces the intended work surface when the predetermined switch such as the MC switch is pressed. In this case, the operator can cause the upper turning body 3 to front-face the intended work surface by simply pressing the predetermined switch, or by simply operating a turning operating lever while the predetermined switch is pressed. Alternatively, the operator can cause the upper turning body 3 to front-face the intended work surface and start the machine control function related to excavation by simply pressing the predetermined switch.

In the following, the control that causes the upper turning body 3 to front-face the intended work surface is referred to as "front-facing control". In the front-facing control, the machine guidance device 50 determines that the shovel 100 front-faces the intended work surface, for example, when the left end vertical distance between the coordinate point of the left end of the tip of the bucket 6 and the intended work surface is equal to the right end vertical distance between the coordinate point of the right end of the tip of the bucket 6 and the intended work surface. However, the machine guidance device 50 may also determine that the shovel 100 front-faces the intended work surface when the difference between the left end vertical distance and the right end vertical distance is less than or equal to a predetermined value, instead of when the left end vertical distance is equal to the right end vertical distance, namely, instead of when the difference is zero.

In order to assist the movement of the shovel during finishing work, the automatic control part 54 may be configured to set a predetermined condition on the movement of the lower traveling body 1, and control the traveling hydraulic motor 2M to stop the movement of the lower traveling body 1 when the predetermined condition is satisfied. In this case, the predetermined condition includes the remaining distance being less than or equal to a predetermined value when the travel lever is operated while the predetermined switch such as the MC switch is pressed.

For example, in response to the remaining distance being zero when the travel lever is operated while the predetermined switch such as the MC switch is pressed, the automatic control part 54 may forcibly stop the rotation of the traveling hydraulic motor 2M, irrespective of whether the travel lever is operated. In this case, the operator can cause the lower traveling body 1 to travel until the shovel center point reaches a virtual plane, by simply operating the travel lever while the predetermined switch is pressed. That is, the operator can stop the shovel 100 at a position appropriate for continuing the finishing work.

Alternatively, the automatic control part 54 may automatically cause the traveling hydraulic motor 2M to rotate when the predetermined switch such as the MC switch is pressed, irrespective of whether the travel lever is operated. In response to the remaining distance being zero, the automatic control part 54 forcibly stops the rotation of the traveling hydraulic motor 2M. In this case, the operator can cause the lower traveling body 1 to travel until the shovel center point reaches a virtual plane by simply pressing the predetermined switch. That is, the operator can move the shovel 100 to a position appropriate for continuing the finishing work.

The predetermined condition may be a condition that the travel distance of the shovel 100 has reached the target travel distance when the travel lever is operated while the predetermined switch such as the MC switch is pressed. In this case, the travel distance of the shovel 100 is calculated based on the output of the positioning device P1. The target travel distance is set based on at least one of information on the size of the end attachment, information on the positional relationship between the intended work surface and the shovel 100, and information on the current ground surface. The target travel distance may be a preset value or may be a dynamically set value.

According to the present embodiment, the automatic control part 54 can individually and automatically operate actuators by individually and automatically controlling pilot pressures acting on control valves corresponding to the actuators.

For example, in the front-facing control, the automatic control part 54 may operate the turning hydraulic motor 2A based on the difference between the left end vertical distance and the right end vertical distance. Specifically, when the turning operating lever is operated while the predetermined switch is pressed, the automatic control part 54 determines whether the turning operating lever is operated in a direction that causes the upper turning body 3 to front-face the intended work surface. For example, when the turning operating lever is operated in a direction that increases the vertical distance between the tip of the bucket 6 and the intended work surface (upward slope), the automatic control part 54 does not perform the front-facing control. Conversely, when the turning operating lever is operated in a direction that decreases the vertical distance between the tip of the bucket 6 and the intended work surface (upward slope), the automatic control part 54 performs the front-facing control. In this manner, the turning hydraulic motor 2A can be operated such that the difference between the left end vertical distance and the right end vertical distance is reduced. Then, the automatic control part 54 stops the turning hydraulic motor 2A when the difference is less than or equal to a predetermined value or is zero. Alternatively, the automatic control part 54 may set a turning angle that causes the difference to be less than or equal to a predetermined value or zero as a target angle, and perform turning angle control such that the angular difference between the target angle and a current turning angle (detected value) is zero. In this case, the turning angle is, for example, the angle of the longitudinal axis of the upper turning body 3 with respect to a reference direction.

Figure 3:
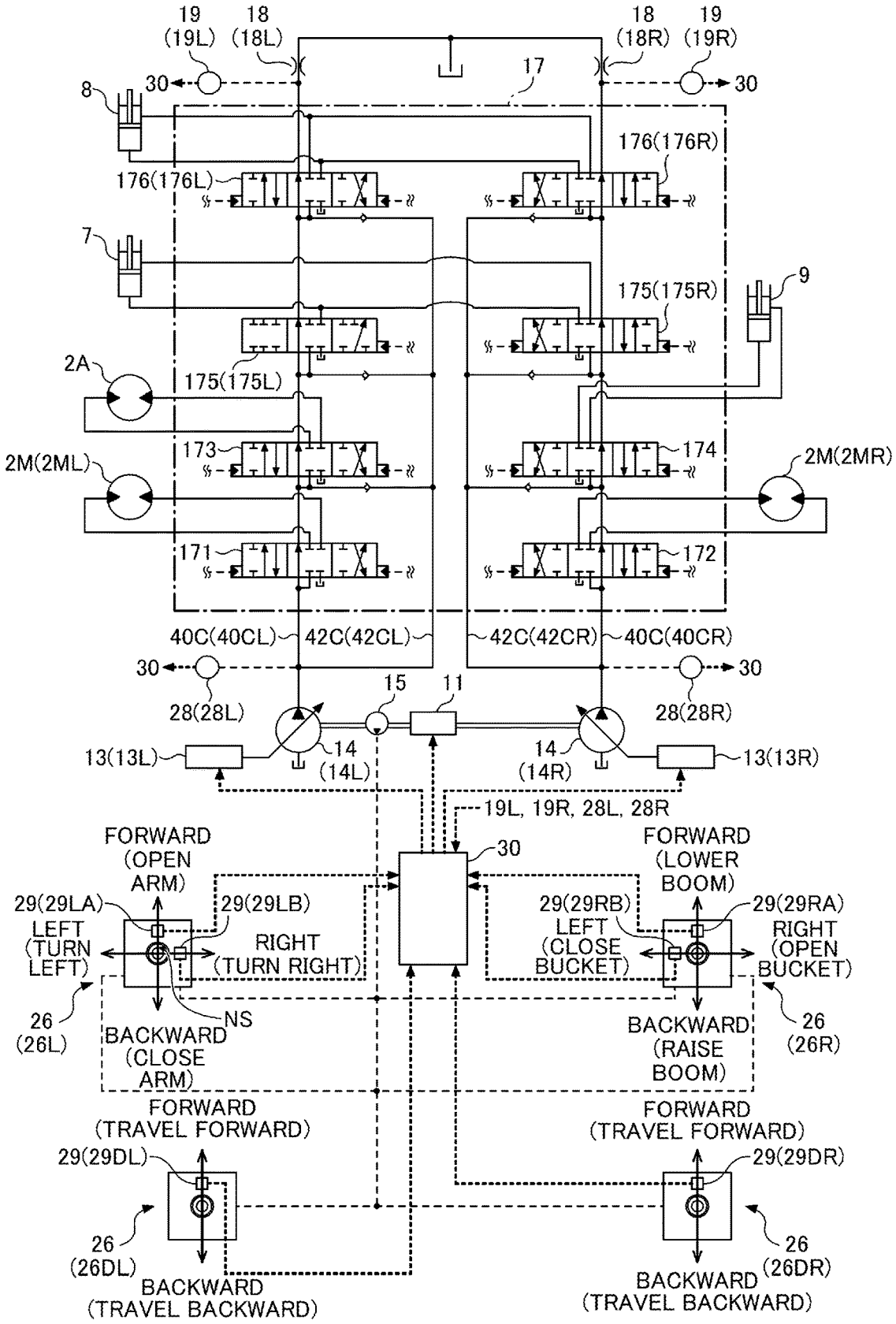
FIG. 3 is a diagram illustrating an example configuration of a hydraulic system installed in the shovel of FIG. 1.

Next, an example configuration of a hydraulic system installed in the shovel 100 will be described with reference to FIG. 3. FIG. 3 is a diagram illustrating an example configuration of the hydraulic system installed in the shovel 100. In FIG. 3, a mechanical power transmission line, a hydraulic oil line, a pilot line, and an electric control line are indicated by a double line, a continuous line, a dashed line, and a dotted line, respectively.

The hydraulic system of the shovel 100 mainly includes the engine 11, the regulator 13, a main pump 14, the pilot pump 15, the control valve 17, the operating apparatus 26, the discharge pressure sensor 28, the operating pressure sensor 29, and the controller 30.

In FIG. 3, the hydraulic system is configured to circulate hydraulic oil from the main pump 14 driven by the engine 11 to the hydraulic oil tank via a center bypass conduit 40C or a parallel conduit 42C.

The engine 11 is a drive source of the shovel 100. According to the present embodiment, the engine 11 is a diesel engine that operates so as to maintain a predetermined rotational speed. The output shaft of the engine 11 is coupled to the respective input shafts of the main pump 14 and the pilot pump 15.

The main pump 14 is configured to supply hydraulic oil to the control valve 17 via a hydraulic oil line. According to the present embodiment, the main pump 14 is a swash plate variable displacement hydraulic pump.

The regulator 13 is configured to control the discharge quantity of the main pump 14. According to the present embodiment, the regulator 13 controls the discharge quantity of the main pump 14 by adjusting the swash plate tilt angle of the main pump 14 in response to a control command from the controller 30.

The pilot pump 15 is configured to supply hydraulic oil to hydraulic control apparatuses including the operating apparatus 26 via a pilot line. According to the present embodiment, the pilot pump 15 is a fixed displacement hydraulic pump.

The control valve 17 is a hydraulic control device that controls the hydraulic system in the shovel 100. In the present embodiment, the control valve 17 includes control valves 171 through 176. The control valve 175 includes a control valve 175L and a control valve 175R, and the control valve 176 includes a control valve 176L and a control valve 176R. The control valve 17 is configured to be able to selectively supply hydraulic oil discharged by the main pump 14 to one or more hydraulic actuators through the control valves 171 through 176. The control valves 171 through 176 control the flow rate of hydraulic oil flowing from the main pump 14 to hydraulic actuators and the flow rate of hydraulic oil flowing from hydraulic actuators to a hydraulic oil tank. The hydraulic actuators include the boom cylinder 7, the arm cylinder 8, the bucket cylinder 9, the left traveling hydraulic motor 2ML, the right traveling hydraulic motor 2MR, and the turning hydraulic motor 2A.

The operating apparatus 26 is an apparatus that the operator uses to operate actuators. The operating apparatus 26 includes, for example, an operating lever and an operating pedal. The actuators include at least one of a hydraulic actuator and an electric actuator. According to the present embodiment, the operating apparatus 26 is configured to supply hydraulic oil discharged by the pilot pump 15 to a pilot port of a corresponding control valve in the control valve 17 via a pilot line. The pressure of hydraulic oil supplied to each pilot port (pilot pressure) is a pressure commensurate with the direction of operation and the amount of operation of the operating apparatus 26 for a corresponding hydraulic actuator. However, the operating apparatus 26 may alternatively be an electrical control type instead of the above-described pilot pressure type. In this case, the control valves in the control valve 17 may be electromagnetic solenoid spool valves.

The discharge pressure sensor 28 is configured to detect the discharge pressure of the main pump 14. According to the present embodiment, the discharge pressure sensor 28 outputs the detected value to the controller 30.

The operating pressure sensor 29 is configured to detect the details of the operator's operation using the operating apparatus 26. According to the present embodiment, the operating pressure sensor 29 detects the direction of operation and the amount of operation of the operating apparatus 26 corresponding to each actuator in the form of pressure (operating pressure), and outputs the detected value to the controller 30. The details of the operation of the operating apparatus 26 may be detected using a sensor other than an operating pressure sensor.

The main pump 14 includes a left main pump 14L and a right main pump 14R. The left main pump 14L circulates hydraulic oil to the hydraulic oil tank via a left center bypass conduit 40CL or a left parallel conduit 42CL. The right main pump 14R circulates hydraulic oil to the hydraulic oil tank via a right center bypass conduit 40CR or a right parallel conduit 42CR.

The left center bypass conduit 40CL is a hydraulic oil line that passes through the control valves 171, 173, 175L and 176L placed in the control valve 17. The right center bypass conduit 40CR is a hydraulic oil line that passes through the control valves 172, 174, 175R and 176R placed in the control valve 17.

The control valve 171 is a spool valve that switches the flow of hydraulic oil in order to supply hydraulic oil discharged by the left main pump 14L to the left traveling hydraulic motor 2ML and to discharge hydraulic oil discharged by the left traveling hydraulic motor 2ML to the hydraulic oil tank.

The control valve 172 is a spool valve that switches the flow of hydraulic oil in order to supply hydraulic oil discharged by the right main pump 14R to the right traveling hydraulic motor 2MR and to discharge hydraulic oil discharged by the right traveling hydraulic motor 2MR to the hydraulic oil tank.

The control valve 173 is a spool valve that switches the flow of hydraulic oil in order to supply hydraulic oil discharged by the left main pump 14L to the turning hydraulic motor 2A and to discharge hydraulic oil discharged by the turning hydraulic motor 2A to the hydraulic oil tank.

The control valve 174 is a spool valve that switches the flow of hydraulic oil in order to supply hydraulic oil discharged by the right main pump 14R to the bucket cylinder 9 and to discharge hydraulic oil in the bucket cylinder 9 to the hydraulic oil tank.

The control valve 175L is a spool valve that switches the flow of hydraulic oil in order to supply hydraulic oil discharged by the left main pump 14L to the boom cylinder 7. The control valve 175R is a spool valve that switches the flow of hydraulic oil in order to supply hydraulic oil discharged by the right main pump 14R to the boom cylinder 7 and to discharge hydraulic oil in the boom cylinder 7 to the hydraulic oil tank.

The control valve 176L is a spool valve that switches the flow of hydraulic oil in order to supply hydraulic oil discharged by the left main pump 14L to the arm cylinder 8 and to discharge hydraulic oil in the arm cylinder 8 to the hydraulic oil tank.

The control valve 176R is a spool valve that switches the flow of hydraulic oil in order to supply hydraulic oil discharged by the right main pump 14R to the arm cylinder 8 and to discharge hydraulic oil in the arm cylinder 8 to the hydraulic oil tank.

The left parallel conduit 42CL is a hydraulic oil line parallel to the left center bypass conduit 40CL. When the flow of hydraulic oil through the left center bypass conduit 40CL is restricted or blocked by any of the control valves 171, 173 and 175L, the left parallel conduit 42CL can supply hydraulic oil to a control valve further downstream. The right parallel conduit 42CR is a hydraulic oil line parallel to the right center bypass conduit 40CR. When the flow of hydraulic oil through the right center bypass conduit 40CR is restricted or blocked by any of the control valves 172, 174 and 175R, the right parallel conduit 42CR can supply hydraulic oil to a control valve further downstream.

The regulator 13 includes a left regulator 13L and a right regulator 13R. The left regulator 13L controls the discharge quantity of the left main pump 14L, for example, by adjusting the swash plate tilt angle of the left main pump 14L in accordance with the discharge pressure of the left main pump 14L. Specifically, the left regulator 13L, for example, reduces the discharge quantity of the left main pump 14L by adjusting the swash plate tilt angle of the left main pump 14L as the discharge pressure of the left main pump 14L increases. The same applies to the right regulator 13R. Accordingly, the absorbed power of the main pump 14 expressed by the product of the discharge pressure and the discharge quantity can be prevented from exceeding the output power of the engine 11.

The operating apparatus 26 includes a left operating lever 26L, a right operating lever 26R, and a travel lever 26D. The travel lever 26D includes a left travel lever 26DL and a right travel lever 26DR.

The left operating lever 26L is used for a turning operation and is used to operate the arm 5. When the left operating lever 26L is operated forward or backward, the left operating lever 26L introduces a control pressure commensurate with the amount of lever operation to a pilot port of the control valve 176, using hydraulic oil discharged by the pilot pump 15. Further, when the left operating lever 26L is operated rightward or leftward, the left operating lever 26L introduces a control pressure commensurate with the amount of lever operation to a pilot port of the control valve 173, using hydraulic oil discharged by the pilot pump 15.

Specifically, when operated in an arm closing direction, the left operating lever 26L introduces hydraulic oil to the right side pilot port of the control valve 176L and introduces hydraulic oil to the left side pilot port of the control valve 176R. Further, when operated in an arm opening direction, the left operating lever 26L introduces hydraulic oil to the left side pilot port of the control valve 176L and introduces hydraulic oil to the right side pilot port of the control valve 176R. Further, when operated in a left turning direction, the left operating lever 26L introduces hydraulic oil to the left side pilot port of the control valve 173. When operated in a right turning direction, the left operating lever 26L introduces hydraulic oil to the right side pilot port of the control valve 173.

The right operating lever 26R is used to operate the boom 4 and operate the bucket 6. When operated forward or backward, the right operating lever 26R introduces a control pressure commensurate with the amount of lever operation to a pilot port of the control valve 175, using hydraulic oil discharged by the pilot pump 15. Further, when operated rightward or leftward, the right operating lever 26R introduces a control pressure commensurate with the amount of lever operation to a pilot port of the control valve 174, using hydraulic oil discharged by the pilot pump 15.

Specifically, when operated in a boom lowering direction, the right operating lever 26R introduces hydraulic oil to the left side pilot port of the control valve 175R. Further, when operated in a boom raising direction, the right operating lever 26R introduces hydraulic oil to the right side pilot port of the control valve 175L and introduces hydraulic oil to the left side pilot port of the control valve 175R. When operated in a bucket closing direction, the right operating lever 26R introduces hydraulic oil to the right side pilot port of the control valve 174. When operated in a bucket opening direction, the right operating lever 26R introduces hydraulic oil to the left side pilot port of the control valve 174.

The travel lever 26D is used to operate the crawlers. Specifically, the left travel lever 26DL is used to operate a left crawler. The left travel lever 26DL may be configured to operate together with a left travel pedal. When operated forward or backward, the left travel lever 26DL introduces a control pressure commensurate with the amount of lever operation to a pilot port of the control valve 171, using hydraulic oil discharged by the pilot pump 15. The right travel lever 26DR is used to operate a right crawler. The right travel lever 26DR may be configured to operate together with a right travel pedal. When operated forward or backward, the right travel lever 26DR introduces a control pressure commensurate with the amount of lever operation to a pilot port of the control valve 172, using hydraulic oil discharged by the pilot pump 15.

The discharge pressure sensor 28 includes a discharge pressure sensor 28L and a discharge pressure sensor 28R. The discharge pressure sensor 28L detects the discharge pressure of the left main pump 14L, and outputs the detected value to the controller 30. The same applies to the discharge pressure sensor 28R.

The operating pressure sensor 29 includes operating pressure sensors 29LA, 29LB, 29RA, 29RB, 29DL and 29DR. The operating pressure sensor 29LA detects the details of the operator's forward or backward operation of the left operating lever 26L in the form of pressure, and outputs the detected value to the controller 30. Examples of the details of the operation include the direction of lever operation and the amount of lever operation (the angle of lever operation).

Likewise, the operating pressure sensor 29LB detects the details of the operator's rightward or leftward operation of the left operating lever 26L in the form of pressure, and outputs the detected value to the controller 30. The operating pressure sensor 29RA detects the details of the operator's forward or backward operation of the right operating lever 26R in the form of pressure, and outputs the detected value to the controller 30. The operating pressure sensor 29RB detects the details of the operator's rightward or leftward operation of the right operating lever 26R in the form of pressure, and outputs the detected value to the controller 30. The operating pressure sensor 29DL detects the details of the operator's forward or backward operation of the left travel lever 26DL in the form of pressure, and outputs the detected value to the controller 30. The operating pressure sensor 29DR detects the details of the operator's forward or backward operation of the right travel lever 26DR in the form of pressure, and outputs the detected value to the controller 30.

The controller 30 receives the output of the operating pressure sensor 29, and outputs a control command to the regulator 13 to change the discharge quantity of the main pump 14 on an as-needed basis. Furthermore, the controller 30 receives the output of a control pressure sensor 19 provided upstream of a throttle 18, and outputs a control command to the regulator 13 to change the discharge quantity of the main pump 14 on an as-needed basis. The throttle 18 includes a left throttle 18L and a right throttle 18R, and the control pressure sensor 19 includes a left control pressure sensor 19L and a right control pressure sensor 19R.

In the left center bypass conduit 40CL, the left throttle 18L is placed between the most downstream control valve 176L and the hydraulic oil tank. Therefore, the flow of hydraulic oil discharged by the left main pump 14L is restricted by the left throttle 18L. The left throttle 18L generates a control pressure for controlling the left regulator 13L. The left control pressure sensor 19L is a sensor for detecting this control pressure, and output a detected value to the controller 30. The controller 30 controls the discharge quantity of the left main pump 14L by adjusting the swash plate tilt angle of the left main pump 14L in accordance with this control pressure. The controller 30 decreases the discharge quantity of the left main pump 14L as the control pressure increases, and increases the discharge quantity of the left main pump 14L as the control pressure decreases. The discharge quantity of the right main pump 14R is controlled in the same manner.

Specifically, as illustrated in FIG. 3, in the standby state where none of the hydraulic actuators in the shovel 100 is in operation, hydraulic oil discharged by the left main pump 14L passes through the left center bypass conduit 40CL to reach the left throttle 18L. The flow of hydraulic oil discharged by the left main pump 14L increases the control pressure generated upstream of the left throttle 18L. As a result, the controller 30 decreases the discharge quantity of the left main pump 14L to a minimum allowable discharge quantity to control pressure loss (pumping loss) during passage of the discharged hydraulic oil through the left center bypass conduit 40CL. When a hydraulic actuator is operated, hydraulic oil discharged by the left main pump 14L flows into the operated hydraulic actuator through a control valve corresponding to the operated hydraulic actuator. The flow of hydraulic oil discharged by the left main pump 14L that reaches the left throttle 18L is reduced in amount or lost, so that the control pressure generated upstream of the left throttle 18L is reduced. As a result, the controller 30 increases the discharge quantity of the left main pump 14L to circulate sufficient hydraulic oil to the operated hydraulic actuator to ensure driving of the operated hydraulic actuator. The controller 30 controls the discharge quantity of the right main pump 14R in the same manner.

With to the configuration as described above, the hydraulic system of FIG. 3 can reduce unnecessary energy consumption in the main pump 14 in the standby state. The unnecessary energy consumption includes pumping loss that hydraulic oil discharged by the main pump 14 causes in the center bypass conduit 40C. Furthermore, in the case of actuating a hydraulic actuator, the hydraulic system of FIG. 3 can ensure that necessary and sufficient hydraulic oil is supplied from the main pump 14 to the hydraulic actuator to be actuated.

Figure 4A:
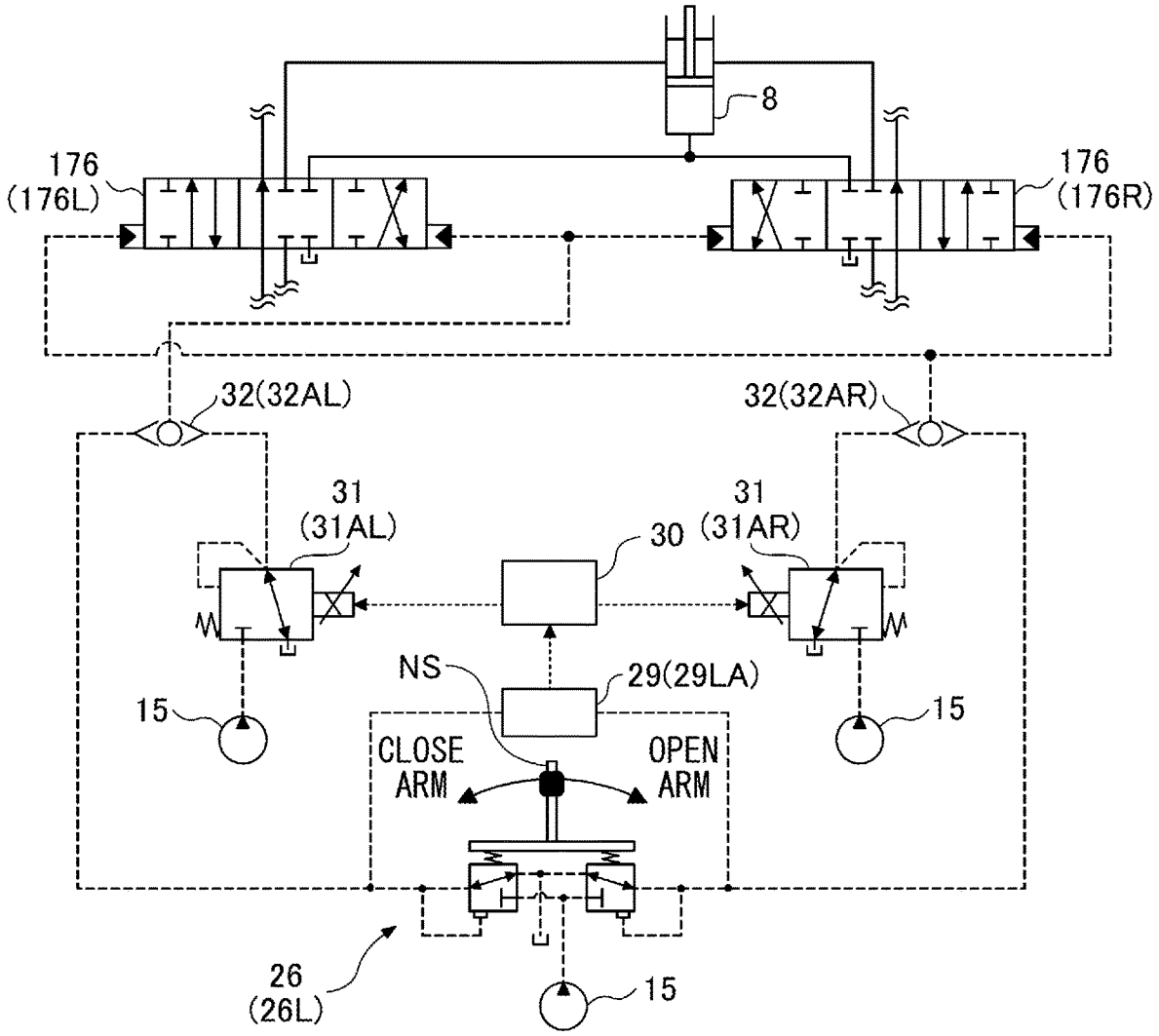
FIG. 4A is a diagram illustrating a part of the hydraulic system related to the operation of an arm cylinder.
Figure 4B:
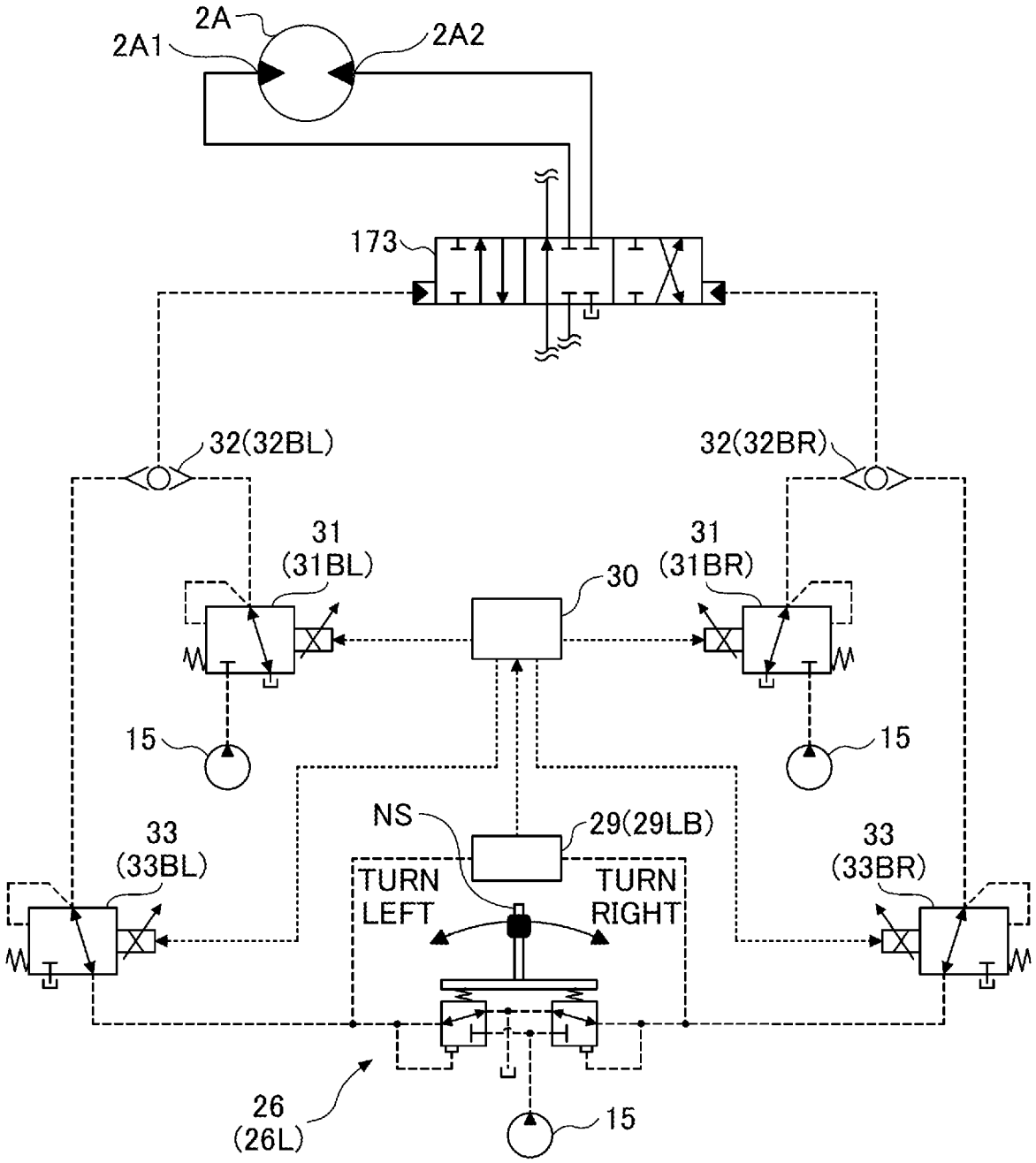
FIG. 4B is a diagram illustrating a part of the hydraulic system related to the operation of a turning hydraulic motor.
Figure 4C:
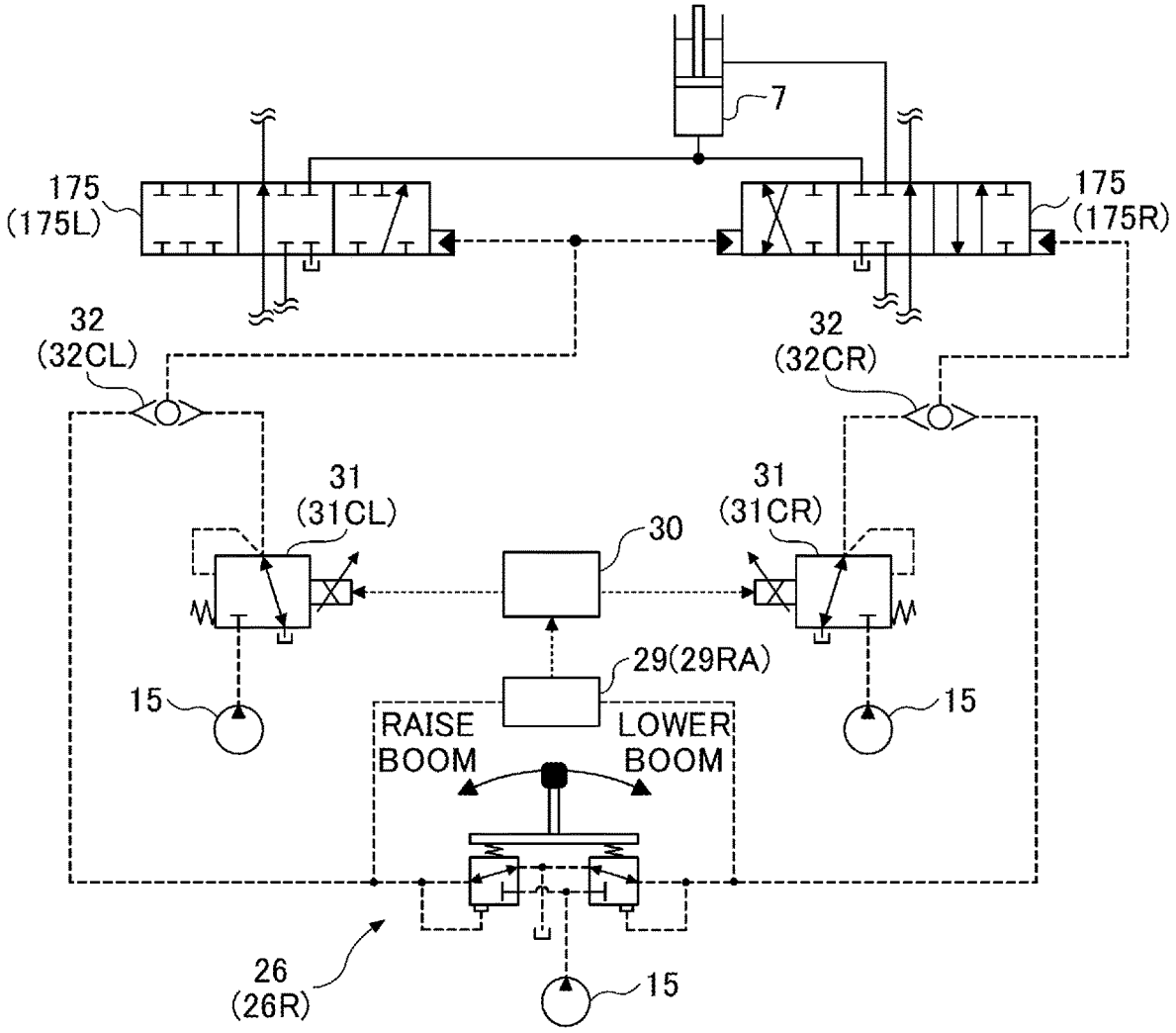
FIG. 4C is a diagram illustrating a part of the hydraulic system related to the operation of a boom cylinder.
Figure 4D:
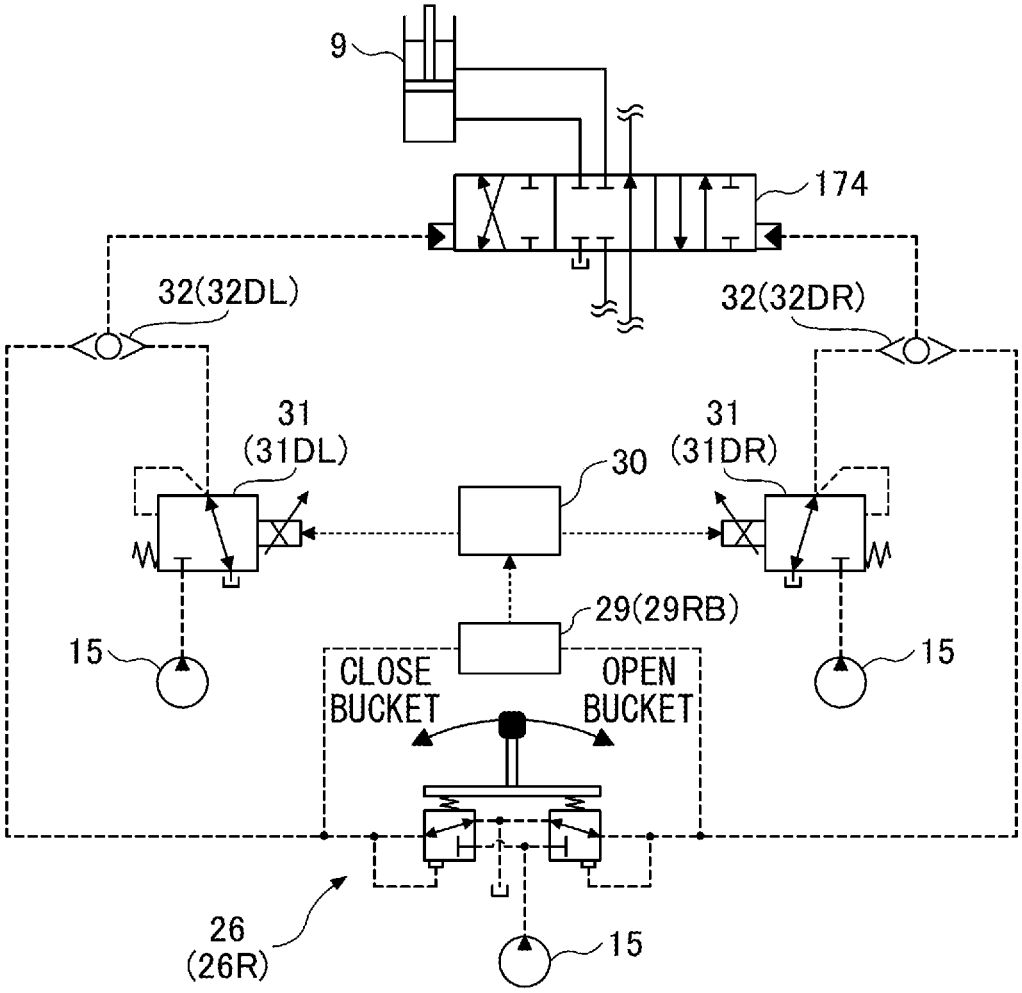
FIG. 4D is a diagram illustrating a part of the hydraulic system related to the operation of a bucket cylinder.
Figure 4E:
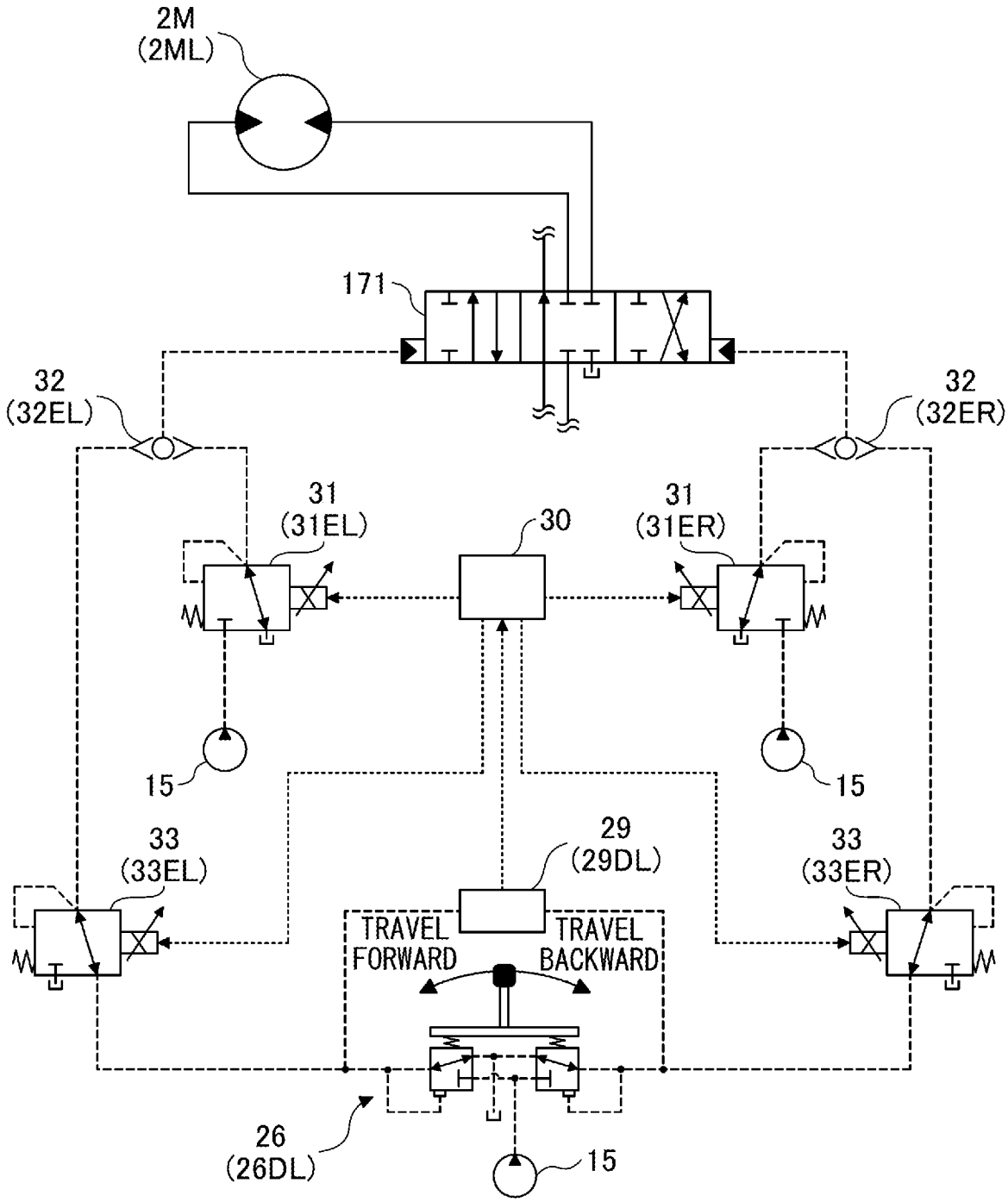
FIG. 4E is a diagram illustrating a part of the hydraulic system related to the operation of a left traveling hydraulic motor.
Figure 4F:
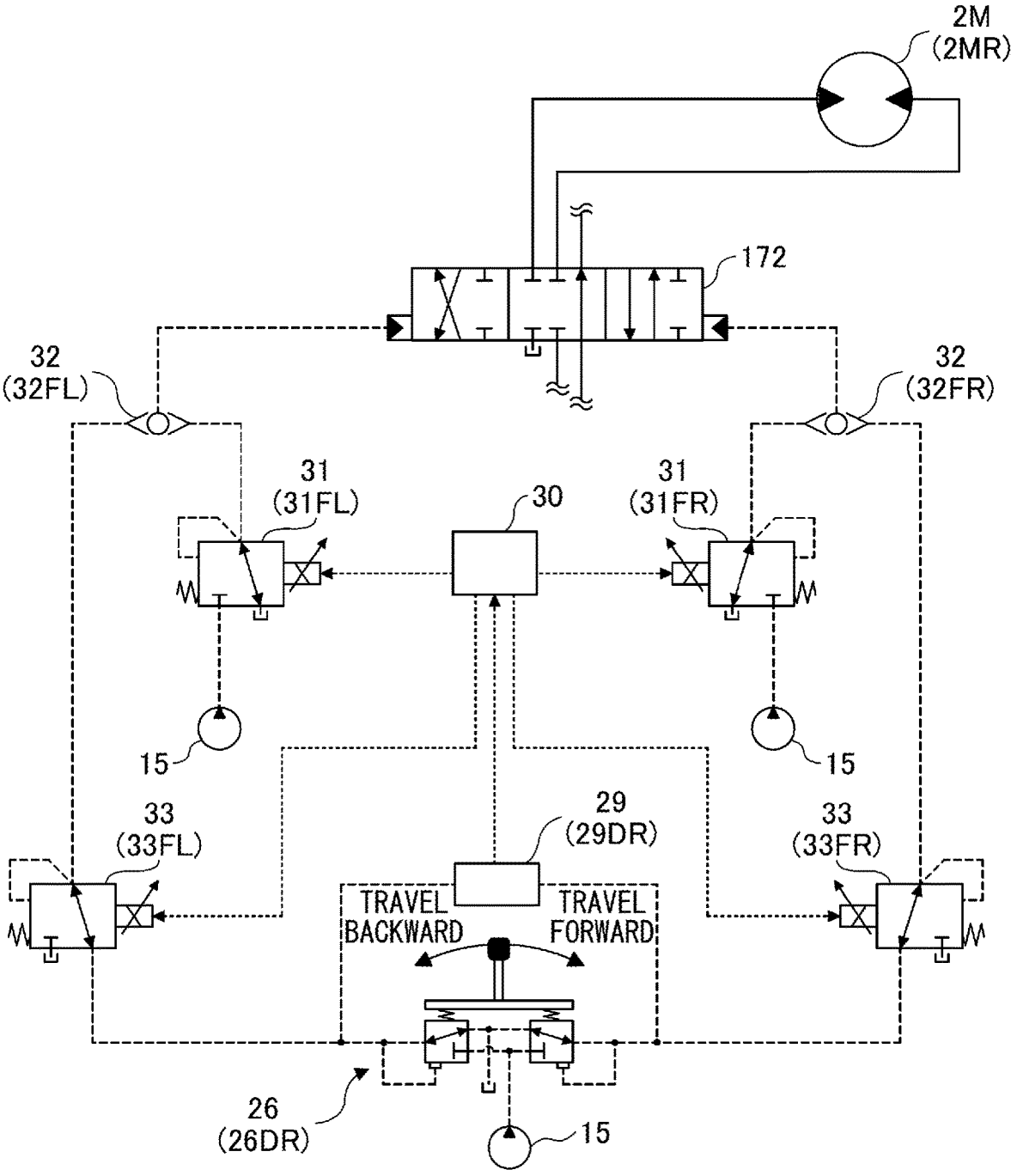
FIG. 4F is a diagram illustrating a part of the hydraulic system related to the operation of a right traveling hydraulic motor.

Next, a configuration in which the controller 30 uses the machine control function to operate an actuator will be described with reference to FIG. 4A through FIG. 4F. FIG. 4A through FIG. 4F are diagrams illustrating parts of the hydraulic system. Specifically, FIG. 4A is a diagram illustrating a part of the hydraulic system related to the operation of the arm cylinder 8. FIG. 4B is a diagram illustrating a part of the hydraulic system related to the operation of the turning hydraulic motor 2A. FIG. 4C is a diagram illustrating a part of the hydraulic system related to the operation of the boom cylinder 7. FIG. 4D is a diagram illustrating a part of the hydraulic system related to the operation of the bucket cylinder 9. FIG. 4E is a diagram illustrating a part of the hydraulic system related to the operation of the left traveling hydraulic motor 2ML. FIG. 4F is a diagram illustrating a part of the hydraulic system related to the operation of the right traveling hydraulic motor 2MR.

As illustrated in FIG. 4A through FIG. 4F, the hydraulic system includes the proportional valve 31 and the shuttle valve 32. The proportional valve 31 includes proportional valves 31AL through 31FL and 31AR through 31FR. The shuttle valve 32 includes shuttle valves 32AL through 32FL and 32AR through 32FR. Further, according to the present embodiment, the hydraulic system includes a proportional valve 33 in the parts illustrated in FIG. 4B, FIG. 4E, and FIG. 4F. The proportional valve 33 includes proportional valves 33BL, 33BR, 33EL, 33ER, 33FL, and 33FR.

The proportional valve 31 operates as a control valve for machine control. The proportional valve 31 is placed in a conduit connecting the pilot pump 15 and the shuttle valve 32, and is configured to be able to change the flow area of the conduit. According to the present embodiment, the proportional valve 31 operates in response to a control command output from the controller 30. Therefore, the controller 30 can supply hydraulic oil discharged by the pilot pump 15 to a pilot port of a corresponding control valve in the control valve 17 through the proportional valve 31 and the shuttle valve 32, independent of the operator's operation of the operating apparatus 26.

The shuttle valve 32 includes two inlet ports and one outlet port. Of the two inlet ports, one is connected to the operating apparatus 26 and the other is connected to the proportional valve 31. The outlet port is connected to a pilot port of a corresponding control valve in the control valve 17. Therefore, the shuttle valve 32 can cause the higher one of a pilot pressure generated by the operating apparatus 26 and a pilot pressure generated by the proportional valve 31 to act on a pilot port of a corresponding control valve.

Similar to the proportional valve 31, the proportional valve 33 operates as a control valve for machine control. The proportional valve 33 is placed in a conduit connecting the operating apparatus 26 and the shuttle valve 32, and is configured to be able to change the flow area of the conduit. According to the present embodiment, the proportional valve 33 operates in response to a control command output from the controller 30. Therefore, the controller 30 can reduce the pressure of hydraulic oil discharged by the operating apparatus 26, and supply the hydraulic oil to a pilot port of a corresponding control valve in the control valve 17 through the shuttle valve 32, independent of the operator's operation of the operating apparatus 26.

With the above configuration, the controller 30 can operate a hydraulic actuator corresponding to a specific operating apparatus 26 independent of the operator's operation with respect to the specific operating apparatus 26. Further, the controller 30 can forcibly stop the operation of a hydraulic actuator corresponding to a specific operating apparatus 26 irrespective of the operator's operation with respect to the specific operating apparatus 26.

For example, as illustrated in FIG. 4A, the left operating lever 26L is used to operate the arm 5. Specifically, the left operating lever 26L causes a pilot pressure commensurate with a forward or backward operation to act on a pilot port of the control valve 176, using hydraulic oil discharged by the pilot pump 15. More specifically, when operated in the arm closing direction (backward direction), the left operating lever 26L causes a pilot pressure commensurate with the amount of operation to act on the right side pilot port of the control valve 176L and the left side pilot port of the control valve 176R. Furthermore, when operated in the arm opening direction (forward direction), the left operating lever 26L causes a pilot pressure commensurate with the amount of operation to act on the left side pilot port of the control valve 176L and the right side pilot port of the control valve 176R.

The left operating lever 26L is provided with a switch NS. According to the present embodiment, the switch NS is a push button switch. The operator can operate the left operating lever 26L while pressing the switch NS. The switch NS may be provided on the right operating lever 26R or at a different position in the cabin 10.

The operating pressure sensor 29LA detects the details of the operator's forward or backward operation of the left operating lever 26L in the form of pressure, and outputs the detected value to the controller 30.

The proportional valve 31AL operates in response to a current command output from the controller 30. The proportional valve 31AL controls a pilot pressure generated by hydraulic oil introduced to the right side pilot port of the control valve 176L and the left side pilot port of the control valve 176R from the pilot pump 15 through the proportional valve 31AL and the shuttle valve 32AL. The proportional valve 31AR operates in response to a current command output from the controller 30. The proportional valve 31AR controls a pilot pressure generated by hydraulic oil introduced to the left side pilot port of the control valve 176L and the right side pilot port of the control valve 176R from the pilot pump 15 through the proportional valve 31AR and the shuttle valve 32AR. The proportional valves 31AL and 31AR can control the pilot pressure such that the control valves 176L and 176R can stop at a desired valve position.

With the above-described configuration, the controller 30 can supply hydraulic oil, discharged by the pilot pump 15, to the right side pilot port of the control valve 176L and the left side pilot port of the control valve 176R through the proportional valve 31AL and the shuttle valve 32AL, independent of the operator's arm closing operation. That is, the arm 5 can be automatically closed. Further, the controller 30 can supply hydraulic oil, discharged by the pilot pump 15, to the left side pilot port of the control valve 176L and the right side pilot port of the control valve 176R through the proportional valve 31AR and the shuttle valve 32AR, independent of the operator's arm opening operation. That is, the arm 5 can be automatically opened.

Further, as illustrated in FIG. 4B, the left operating lever 26L is also used to operate the turning mechanism 2. Specifically, the left operating lever 26L causes a pilot pressure corresponding to a rightward or leftward operation to act on a pilot port of the control valve 173, using hydraulic oil discharged by the pilot pump 15. More specifically, when operated in the left turning direction (leftward direction), the left operating lever 26L causes a pilot pressure corresponding to the amount of operation to act on the left side pilot port of the control valve 173. Furthermore, when operated in the right turning direction (rightward direction), the left operating lever 26L causes a pilot pressure corresponding to the amount of operation to act on the right side pilot port of the control valve 173.

The operating pressure sensor 29LB detects the details of the operator's rightward or leftward operation of the left operating lever 26L in the form of pressure, and outputs the detected value to the controller 30.

The proportional valve 31BL operates in response to a current command output from the controller 30. The proportional valve 31BL controls a pilot pressure generated by hydraulic oil introduced to the left side pilot port of the control valve 173 from the pilot pump 15 through the proportional valve 31BL and the shuttle valve 32BL. The proportional valve 31BR operates in response to a current command output from the controller 30. The proportional valve 31BR controls a pilot pressure generated by hydraulic oil introduced to the right side pilot port of the control valve 173 from the pilot pump 15 through the proportional valve 31BR and the shuttle valve 32BR. The proportional valves 31BL and 31BR can control the pilot pressure such that the control valve 173 can stop at a desired valve position.

With the above-described configuration, the controller 30 can supply hydraulic oil, discharged by the pilot pump 15, to the left side pilot port of the control valve 173 through the proportional valve 31BL and the shuttle valve 32BL, independent of the operator's left turning operation. That is, the turning mechanism 2 can be automatically turned counterclockwise. Furthermore, the controller 30 can supply hydraulic oil, discharged by the pilot pump 15, to the right side pilot port of the control valve 173 through the proportional valve 31BR and the shuttle valve 32BR, independent of the operator's right turning operation. That is, the turning mechanism 2 can be automatically turned clockwise.

The proportional valve 33BL operates in response to a (control command) current command output from the controller 30. The proportional valve 33BL reduces a pilot pressure generated by hydraulic oil introduced to the left side pilot port of the control valve 173 from the pilot pump 15 through the left operating lever 26L, the proportional valve 33BL, and the shuttle valve 32BL. The proportional valve 33BR operates in response to a current command output from the controller 30. The proportional valve 33BR reduces a pilot pressure generated by hydraulic oil introduced to the right side pilot port of the control valve 173 from the pilot pump 15 through the left operating lever 26L, the proportional valve 33BR, and the shuttle valve 32BR. The proportional valves 33BL and 33BR can control the pilot pressure such that the control valve 173 can stop at a desired valve position.

With the above-described configuration, the controller 30 can forcibly stop the left turning movement of the upper turning body 3 by reducing a pilot pressure acting on the left side pilot port of the control valve 173 on an as-needed basis, even when the left turning operation is performed by the operator. The same applies to a case where the controller 30 forcibly stops the right turning movement of the upper turning body 3 when the right turning operation is performed by the operator.

Alternatively, the controller 30 may forcibly stop the left turning movement of the upper turning body 3 by controlling the proportional valve 31BR, increasing a pilot pressure acting on the right side pilot port of the control valve 173, located on the opposite side from the left side pilot port of the control valve 173, and forcibly returning the control valve 173 to a neutral position on an as-needed basis, even when the right turning operation is performed by the operator. In this case, the proportional valve 33BL may be omitted. The same applies to a case where the controller 30 forcibly stops the right turning movement of the upper turning body 3 when the right turning operation is performed by the operator.

Further, as illustrated in FIG. 4C, the right operating lever 26R is used to operate the operate the boom 4. Specifically, the right operating lever 26R causes a pilot pressure corresponding to the forward or backward operation to act on a pilot port of the control valve 175, using hydraulic oil discharged by the pilot pump 15. More specifically, when operated in the boom raising direction (backward direction), the right operating lever 26R causes a pilot pressure corresponding to the amount of operation to act on the right side pilot port of the control valve 175L and the left side pilot port of the control valve 175R. Furthermore, when operated in the boom lowering direction (forward direction), the right operating lever 26R causes a pilot pressure corresponding to the amount of operation to act on the right side pilot port of the control valve 175R.

The operating pressure sensor 29RA detects the details of the operator's forward or backward operation of the right operating lever 26R in the form of pressure, and outputs the detected value to the controller 30.

The proportional valve 31CL operates in response to a current command output from the controller 30. The proportional valve 31CL controls a pilot pressure generated by hydraulic oil introduced to the right side pilot port of the control valve 175L and the left side pilot port of the control valve 175R from the pilot pump 15 through the proportional valve 31CL and the shuttle valve 32CL. The proportional valve 31CR operates in response to a current command output from the controller 30. The proportional valve 31CR controls a pilot pressure generated by hydraulic oil introduced to the left side pilot port of the control valve 175L and the right side pilot port of the control valve 175R from the pilot pump 15 through the proportional valve 31CR and the shuttle valve 32CR. The proportional valves 31CL and 31CR can control the pilot pressure such that the control valves 175L and 175R can stop at a desired valve position.

With the above-described configuration, the controller 30 can supply hydraulic oil, discharged by the pilot pump 15, to the right side pilot port of the control valve 175L and the left side pilot port of the control valve 175R through the proportional valve 31CL and the shuttle valve 32CL, independent of the operator's boom raising operation. That is, the boom 4 can be automatically raised. Furthermore, the controller 30 can supply hydraulic oil, discharged by the pilot pump 15, to the right side pilot port of the control valve 175R through the proportional valve 31CR and the shuttle valve 32CR, independent of the operator's boom lowering operation. That is, the boom 4 can be automatically lowered.

As illustrated in FIG. 4D, the right operating lever 26R is also used to operate the bucket 6. Specifically, the right operating lever 26R causes a pilot pressure corresponding to a rightward or leftward operation to act on a pilot port of the control valve 174, using hydraulic oil discharged by the pilot pump 15. More specifically, when operated in the bucket closing direction (leftward direction), the right operating lever 26R causes a pilot pressure corresponding to the amount of operation to act on the left port of the control valve 174. Furthermore, when operated in the bucket opening direction (rightward direction), the right operating lever 26R causes a pilot pressure corresponding to the amount of operation to act on the right side pilot port of the control valve 174.

The operating pressure sensor 29RB detects the details of the operator's rightward or leftward operation of the right operating lever 26R in the form of pressure, and outputs the detected value to the controller 30.

The proportional valve 31DL operates in response to a current command output from the controller 30. The proportional valve 31DL controls a pilot pressure generated by hydraulic oil introduced to the left side pilot port of the control valve 174 from the pilot pump 15 through the proportional valve 31DL and the shuttle valve 32DL. The proportional valve 31DR operates in response to a current command output from the controller 30. The proportional valve 31DR controls a pilot pressure generated by hydraulic oil introduced to the right side pilot port of the control valve 174 from the pilot pump 15 through the proportional valve 31DR and the shuttle valve 32DR. The proportional valves 31DL and 31DR can control the pilot pressure such that the control valve 174 can stop at a desired valve position.

With the above-described configuration, the controller 30 can supply hydraulic oil, discharged by the pilot pump 15, to the left side pilot port of the control valve 174 through the proportional valve 31DL and the shuttle valve 32DL, independent of the operator's bucket closing operation. That is, the bucket 6 can be automatically closed. Furthermore, the controller 30 can supply hydraulic oil, discharged by the pilot pump 15, to the right side pilot port of the control valve 174 through the proportional valve 31DR and the shuttle valve 32DR, independent of the operator's bucket opening operation. That is, the bucket 6 can be automatically opened.

As illustrated in FIG. 4E, the left travel lever 26DL is used to operate the left crawler. Specifically, the left travel lever 26DL causes a pilot pressure corresponding to the forward or backward operation to act on a pilot port of the control valve 171, using hydraulic oil discharged by the pilot pump 15. More specifically, when operated in the forward direction, the left travel lever 26DL causes a pilot pressure corresponding to the amount of operation to act on the left side pilot port of the control valve 171. When operated in the backward direction, the left travel lever 26DL causes a pilot pressure corresponding to the amount of operation to act on the right side pilot port of the control valve 171.

The operating pressure sensor 29DL detects the details of the operator's forward or backward operation of the left travel lever 26DL in the form of pressure, and outputs the detected value to the controller 30.

The proportional valve 31EL operates in response to a current command output from the controller 30. The proportional valve 31EL controls a pilot pressure generated by hydraulic oil introduced to the left side pilot port of the control valve 171 from the pilot pump 15 through the proportional valve 31EL and the shuttle valve 32EL. The proportional valve 31ER operates in response to a current command output from the controller 30. The proportional valve 31ER controls a pilot pressure generated by hydraulic oil introduced to the right side pilot port of the control valve 171 from the pilot pump 15 through the proportional valve 31ER and the shuttle valve 32ER. The proportional valves 31EL and 31ER can control the pilot pressure such that the control valve 171 can stop at a desired valve position.

With the above-described configuration, the controller 30 can supply hydraulic oil, discharged by the pilot pump 15, to the left side pilot port of the control valve 171 through the proportional valve 31EL and the shuttle valve 32EL, independent of the operator's leftward/forward operation. That is, the left crawler can automatically move forward. Furthermore, the controller 30 can supply hydraulic oil, discharged by the pilot pump 15, to the right side pilot port of the control valve 171 through the proportional valve 31ER and the shuttle valve 32ER, independent of the operator's leftward/backward operation. That is, the left crawler can automatically move backward.

The proportional valve 33EL operates in response to a control command (current command) output from the controller 30. The proportional valve 33EL reduces a pilot pressure generated by hydraulic oil introduced to the left side pilot port of the control valve 171 from the pilot pump 15 through the left travel lever 26DL, the proportional valve 33EL, and the shuttle valve 32EL. The proportional valve 33ER operates in response to a control command (current command) output from the controller 30. The proportional valve 33ER reduces a pilot pressure generated by hydraulic oil introduced to the right side pilot port of the control valve 171 from the pilot pump 15 through the left travel lever 26DL, the proportional valve 33ER, and the shuttle valve 32ER. The proportional valves 33EL and 33ER can control the pilot pressure such that the control valve 171 can stop at a desired valve position.

With the above-described configuration, the controller 30 can reduce a pilot pressure acting on the left side pilot port of the control valve 171 so as to forcibly stop the leftward/forward movement of the lower traveling body 1 on an as-needed basis, even when the leftward/forward operation is performed by the operator. The same applies to a case where the controller 30 forcibly stops the leftward/backward movement of the lower traveling body 1 when the leftward/backward operation is performed by the operator.

Alternatively, the controller 30 may forcibly stop the leftward/forward movement of the lower traveling body 1 by controlling the proportional valve 31ER, increasing a pilot pressure acting on the right side pilot port of the control valve 171, located on the opposite side from the left side pilot port of the control valve 171, and forcibly returning the control valve 171 to a neutral position on an as needed basis, even when the leftward/forward operation is performed by the operator. In this case, the proportional valve 33EL may be omitted. The same applies to a case where the controller 30 forcibly stops the leftward/backward movement of the lower traveling body 1 when the leftward/backward operation is performed by the operator.

As illustrated in FIG. 4F, the right travel lever 26DR is used to operate the right crawler. Specifically, the right travel lever 26DR causes a pilot pressure corresponding to the forward or backward operation to act on a pilot port of the control valve 172, using hydraulic oil discharged by the pilot pump 15. More specifically, when operated in the forward direction, the right travel lever 26DR causes a pilot pressure corresponding to the amount of operation to act on the right side pilot port of the control valve 172. When operated in the backward direction, the right travel lever 26DR causes a pilot pressure corresponding to the amount of operation to act on the left side pilot port of the control valve 172.

The operating pressure sensor 29DR detects the details of the operator's forward or backward operation of the right travel lever 26DR in the form of pressure, and outputs the detected value to the controller 30.

The proportional valve 31FL operates in response to a current command output from the controller 30. The proportional valve 31FL controls a pilot pressure generated by hydraulic oil introduced to the left side pilot port of the control valve 172 from the pilot pump 15 through the proportional valve 31FL and the shuttle valve 32FL. The proportional valve 31FR operates in response to a current command output from the controller 30. The proportional valve 31FR controls a pilot pressure generated by hydraulic oil introduced to the right side pilot port of the control valve 172 from the pilot pump 15 through the proportional valve 31FR and the shuttle valve 32FR. The proportional valves 31FL and 31FR can control the pilot pressure such that the control valve 172 can stop at a desired valve position.

With the above-described configuration, the controller 30 can supply hydraulic oil, discharged by the pilot pump 15, to the right side pilot port of the control valve 172 through the proportional valve 31FL and the shuttle valve 32FL, independent of the operator's rightward/forward operation. That is, the right crawler can automatically move forward. Furthermore, the controller 30 can supply hydraulic oil, discharged by the pilot pump 15, to the left side pilot port of the control valve 172 through the proportional valve 31FR and the shuttle valve 32FR, independent of the operator's rightward/backward operation. That is, the right crawler can automatically move backward.

The proportional valve 33FL operates in response to a control command (current command) output from the controller 30. The proportional valve 33FL reduces a pilot pressure generated by hydraulic oil introduced to the left side pilot port of the control valve 172 from the pilot pump 15 through the right travel lever 26DR, the proportional valve 33FL, and the shuttle valve 32FL. The proportional valve 33FR operates in response to a control command (current command) output from the controller 30. The proportional valve 33FR reduces a pilot pressure generated by hydraulic oil introduced to the right side pilot port of the control valve 172 from the pilot pump 15 through the right travel lever 26DR, the proportional valve 33FR, and the shuttle valve 32FR. The proportional valves 33FL and 33FR can control the pilot pressure such that the control valve 172 can stop at a desired valve position.

With the above-described configuration, the controller 30 can reduce a pilot pressure acting on the right side pilot port of the control valve 172 so as to forcibly stop the rightward/forward movement of the lower traveling body 1 on an as-needed basis, even when the rightward/forward operation is performed by the operator. The same applies to a case where the controller 30 forcibly stops the rightward/backward movement of the lower traveling body 1 when the rightward/backward operation is performed by the operator.

Alternatively, the controller 30 can forcibly stop the rightward/forward movement of the lower traveling body 1 by controlling the proportional valve 31FL, increasing a pilot pressure acting on the left side pilot port of the control valve 172, located on the opposite side from the right side pilot port of the control valve 172, and forcibly returning the control valve 172 to a neutral position on an as needed basis, even when the rightward/forward operation is performed by the operator. In this case, the proportional valve 33FR may be omitted. The same applies to a case where the controller 30 forcibly stops the rightward/backward movement of the lower traveling body 1 when the rightward/backward operation is performed by the operator.

In the above-described embodiment, a hydraulic operating lever including a hydraulic pilot circuit is adopted. However, instead of such a hydraulic operating lever including a hydraulic pilot circuit, an electric operating lever including an electric pilot circuit may be adopted. In this case, the amount of lever operation of the electric operating lever is input into the controller 30 as an electrical signal. Further, a solenoid valve is placed between the pilot pump 15 and a pilot port of each control valve. The solenoid valve is configured to operate in response to an electrical signal from the controller 30. With this configuration, when a manual operation using the electric operating lever is performed, the controller 30 can move each of the control valves by controlling the solenoid valve using an electrical signal corresponding to the amount of lever operation so as to increase or decrease a pilot pressure. Note that each of the control valves may be constituted of a solenoid spool valve. In this case, the solenoid spool valve operates in response to an electrical signal from the controller 30 corresponding to the amount of lever operation of the electrical operating lever.

Figure 5:
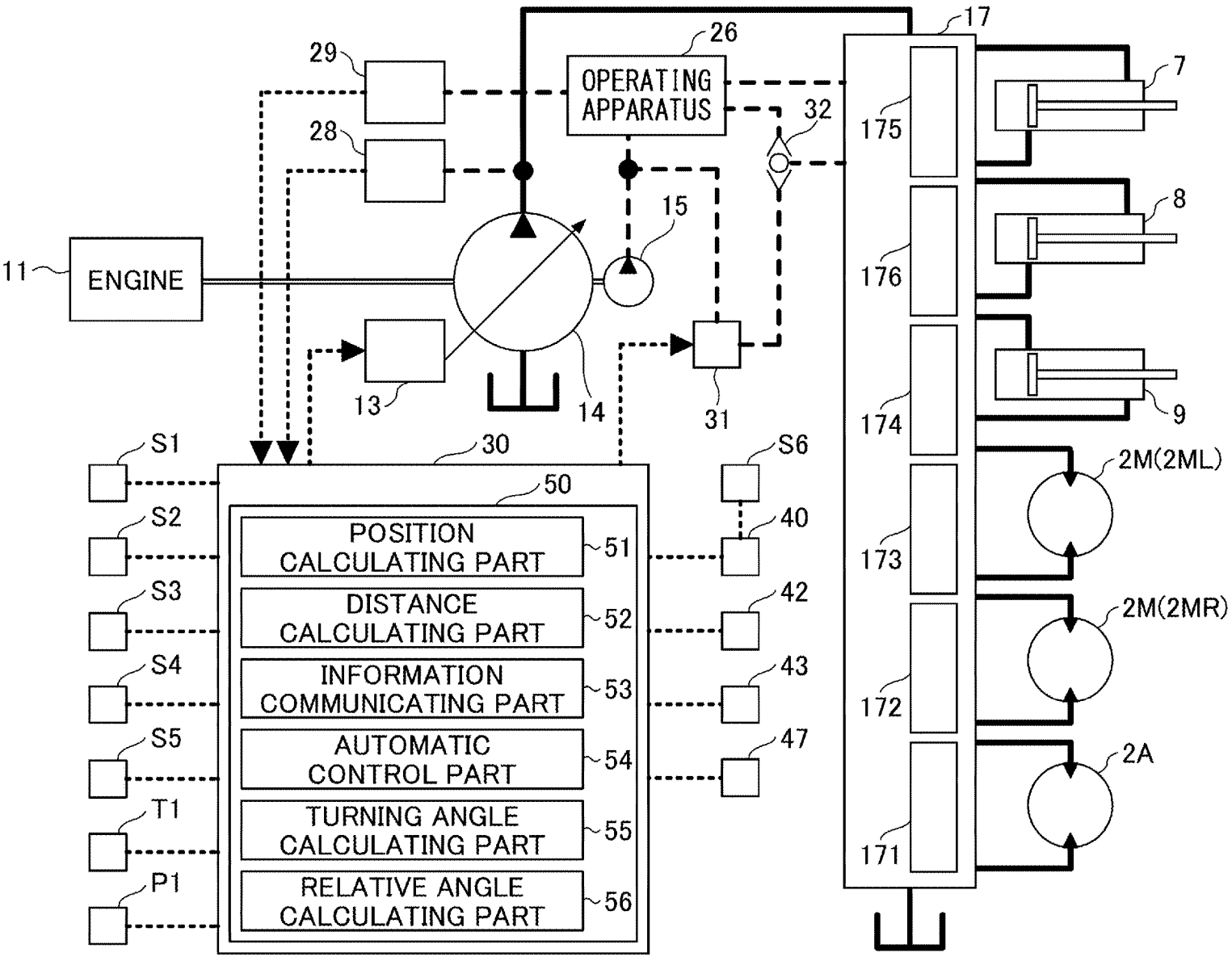
FIG. 5 is a block diagram illustrating another example configuration of the basic system of the shovel of FIG. 1.

Next, another configuration example of the machine guidance device 50 will be described with reference to FIG. 5. FIG. 5 is a block diagram illustrating another example configuration of the basic system of the shovel 100 and corresponds to FIG. 2. The basic system of FIG. 5 differs from the basic system of FIG. 2 in that the machine guidance device 50 includes a turning angle calculating part 55 and a relative angle calculating part 56. However, the other elements of the basic system of FIG. 5 are the same as those of the basic system of FIG. 2. Thus, the description of the same elements will not be repeated, and only the differences will be described in detail.

The turning angle calculating part 55 calculates the turning angle of the upper turning body 3. This is to identify the current orientation of the upper turning body 3. In the present embodiment, the turning angle calculating part 55 calculates, as the turning angle, the angle of the longitudinal axis of the upper turning body 3 with respect to the reference direction based on the output of the GNSS compass that serves as the positioning device P1. The turning angle calculating part 55 may calculate the turning angle based on the output of the turning angular velocity sensor S5. If a reference point is set at the construction site, the turning angle calculating part 55 may use a direction in which the reference point is viewed from the turning axis as the reference direction.

The turning angle indicates a direction in which an attachment operation surface extends. The attachment operation surface is, for example, a virtual plane that traverses the attachment and is positioned perpendicular to a turning plane. The turning plane is, for example, a virtual plane including the bottom of a turning frame perpendicular to the turning axis. The machine guidance device 50, for example, determines that the upper turning body front-faces the intended work surface when determining that the attachment operation plane includes the normal to the intended work surface.

The relative angle calculating part 56 calculates the relative angle as the turning angle necessary to cause the upper turning body 3 to front-face the intended work surface. The relative angle is, for example, a relative angle formed between the direction of the longitudinal axis of the upper turning body 3 when the upper turning body 3 front-faces the intended work surface and the current direction of the longitudinal axis of the upper turning body 3. In the present embodiment, the relative angle calculating part 56 calculates the relative angle based on the data on the intended work surface stored in the storage device 47 and the turning angle calculated by the turning angle calculating part 55.

When the turning operating lever is operated while the predetermined switch such as the MC switch or the like is pressed down, the automatic control part 54 determines whether the turning operating lever is operated in a direction in which the upper turning body 3 front-faces the intended work surface. When the automatic control part 54 determines that the turning operating lever is operated in the direction in the direction in which the upper turning body 3 front-faces the intended work surface, the automatic control part 54 sets the relative angle calculated by the relative angle calculating part 56 as the target angle. When the turning angle, changed after the turning operating lever is operated, reaches the target angle, the automatic control part 54 determines that the upper turning body 3 front-faces the intended work surface, and stops the movement of the turning hydraulic motor 2A.

Accordingly, similar to the machine guidance device 50 of FIG. 2, the machine guidance device 50 of FIG. 5 can cause the upper turning body 3 to front-face the intended work surface.

Figure 6:
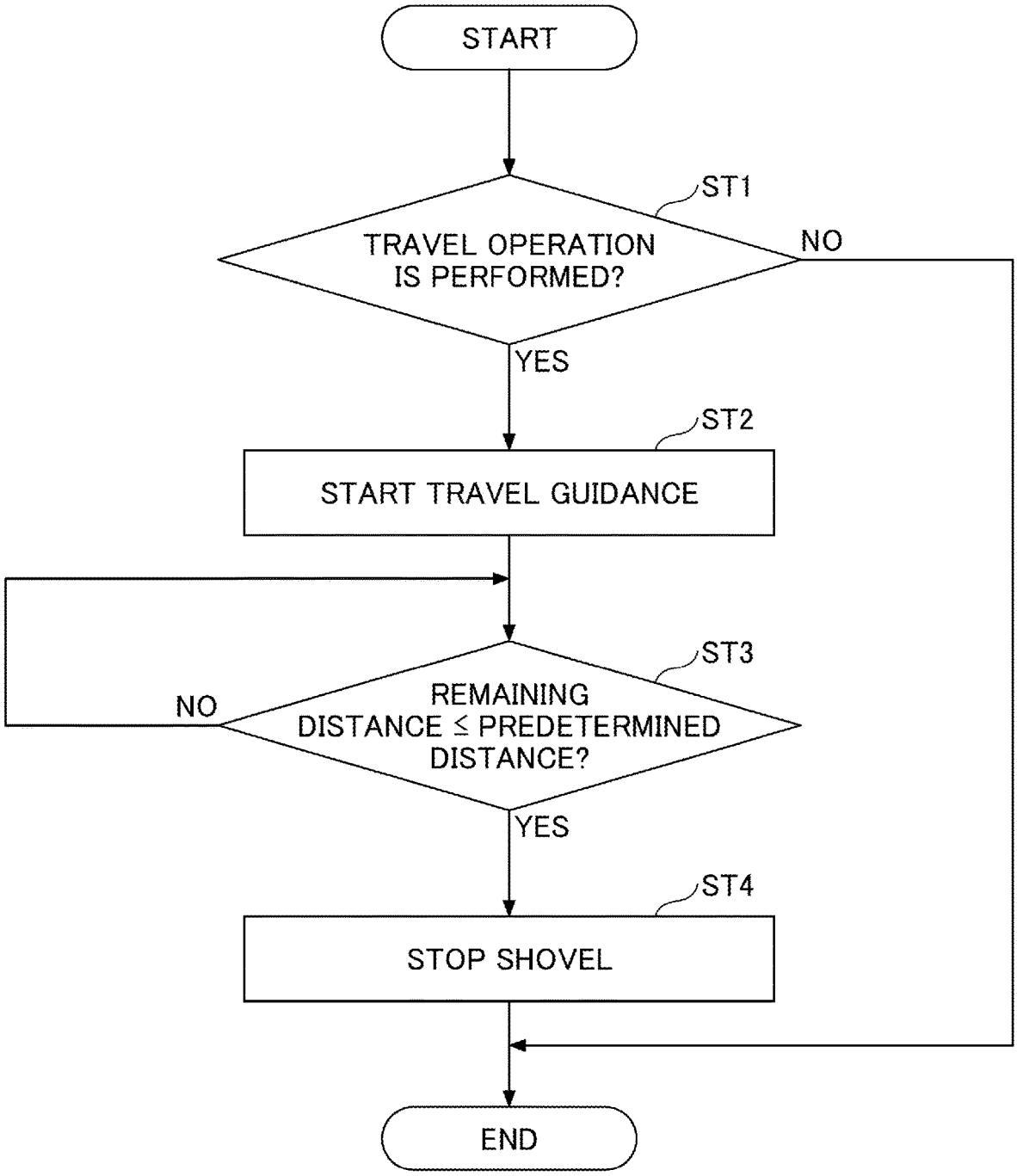
FIG. 6 is a flowchart of a travel operation assist process.

Next, a process in which the controller 30 assists a travel operation performed by the operator (hereinafter referred to as a "travel operation assist process") will be described with reference to FIG. 6. FIG. 6 is a flowchart of the travel operation assist process. For example, the controller 30 repeatedly executes the travel operation assist process at predetermined control intervals while the MC switch is pressed.

First, the controller 30 determines whether the travel operation is performed (step ST1). In the present embodiment, the machine guidance device 50 of the controller 30 determines whether a travel lever 26D or a travel pedal is operated based on the outputs of the operating pressure sensors 29DL and 29DR.

In response to determining that the travel operation is not performed (no in step ST1), the controller 30 ends the current travel operation assist process.

In response to determining that the travel operation is performed (yes in step ST1), the controller 30 starts travel guidance (step ST2). The travel guidance is a function for using visual information and auditory information to notify the operator of the remaining distance, which is the linear distance between an adjacent virtual plane and the shovel center point, while the shovel 100 is traveling. Note that each time the shovel 100 reaches an adjacent virtual plane PS, the controller 30 sets the next adjacent virtual plane PS located in an unfinished slope area as the next target virtual plane. The target virtual plane is a virtual plane referenced to derive the remaining distance. The distance between the two adjacent virtual planes is set based on at least one of the type of the bucket 6, the size of the bucket 6, and the characteristics of soil. In the present embodiment, the machine guidance device 50 starts the travel guidance so as to notify the operator of the remaining distance by using intermittent sounds through the audio output device 43. Specifically, the machine guidance device 50 reduces the interval between intermittent sounds as the remaining distance decreases such that the operator can be notified of changes in the remaining distance.

Thereafter, the controller 30 determines whether the remaining distance is less than or equal to a predetermined distance (step ST3). In the present embodiment, the machine guidance device 50 determines whether the remaining distance is zero.

When determining that the remaining distance is greater than the predetermined distance (no in step ST3), the controller 30 repeatedly performs step ST3 until the remaining distance becomes less than or equal to the predetermined distance.

When determining that the remaining distance is less than or equal to the predetermined distance (yes in step ST3), the controller 30 stops the travel of the shovel 100 (step ST4). In the present embodiment, the machine guidance device 50 forcibly returns the control valves 171 and 172 to neutral positions by outputting a predetermined current command to each of the proportional valves 31EL, 31ER, 31FL, and 31ER. In this manner, the rotation of each of the left traveling hydraulic motor 2ML and the right traveling hydraulic motor 2MR can be stopped. Accordingly, the machine guidance device 50 can stop the travel of the shovel 100 by stopping the movement of each of the left crawler and the right crawler.

The machine guidance device 50 may slow the shovel 100 when the remaining distance becomes less than or equal to another predetermined value that is greater than the above-described predetermined value. In this manner, a sudden stop of the shovel 100 can be prevented when the remaining distance becomes less than or equal to the above-described predetermined value. For example, the machine guidance device 50 may limit the deceleration of the shovel 100 by slowing the shovel 100 in a predetermined deceleration pattern. The movement of the shovel 100 during slope forming work often causes the operator to move in the lateral direction. Therefore, in order to minimize lateral movement of the operator, the machine guidance device 50 may set a predetermined deceleration pattern so as to gradually slow the shovel 100 by adjusting the deceleration of the shovel 100 in accordance with the remaining distance.

Note that the controller 30 may skip steps ST3 and ST4. That is, the controller 30 may simply start the travel guidance. Alternatively, the controller 30 may skip step ST2. That is, the controller 30 may simply stop the shovel 100 when the remaining distance becomes less than or equal to the predetermined distance without starting the travel guidance.

Figure 7A:
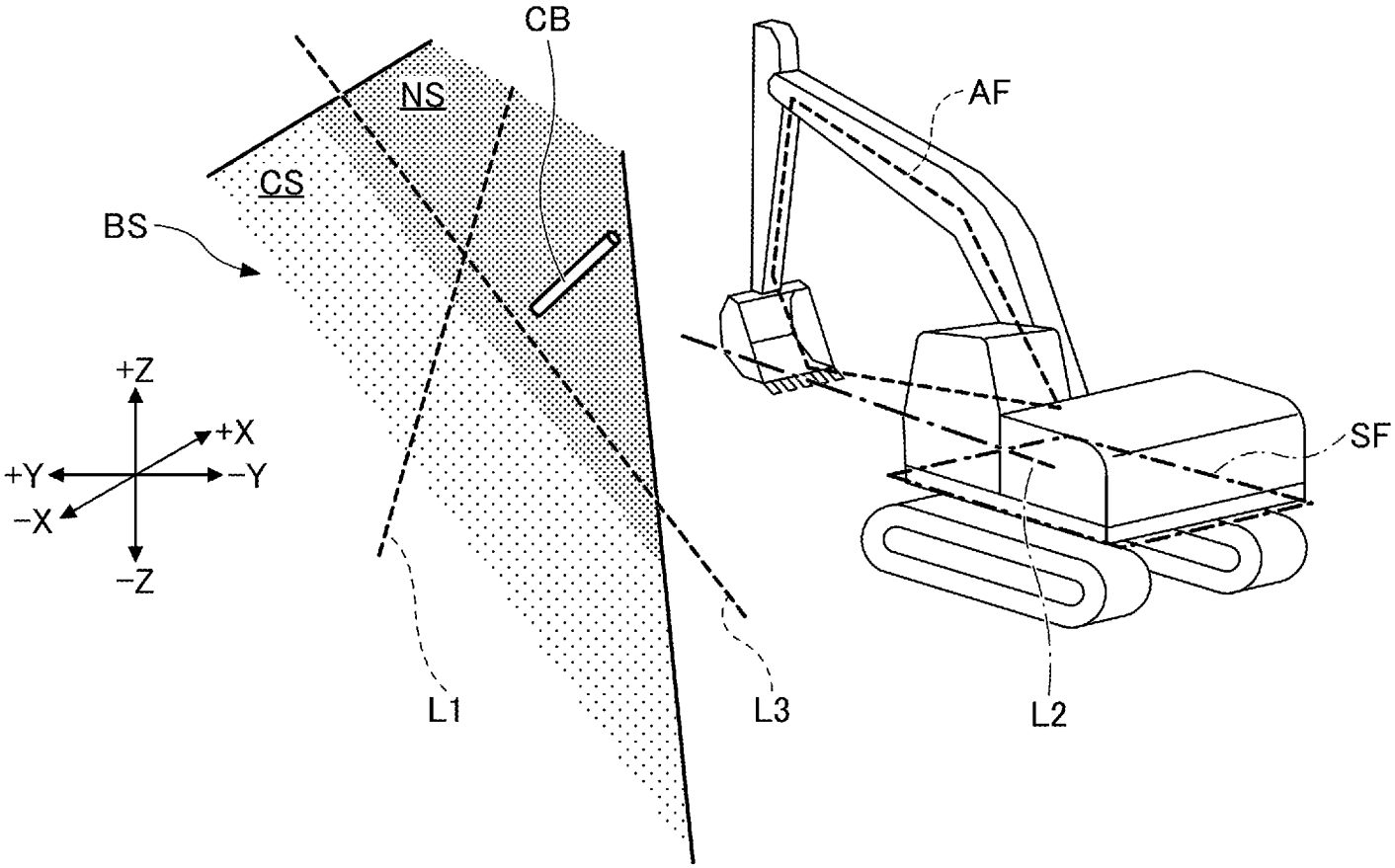
FIG. 7A is a perspective view of the shovel when a front-facing process is performed.
Figure 7B:
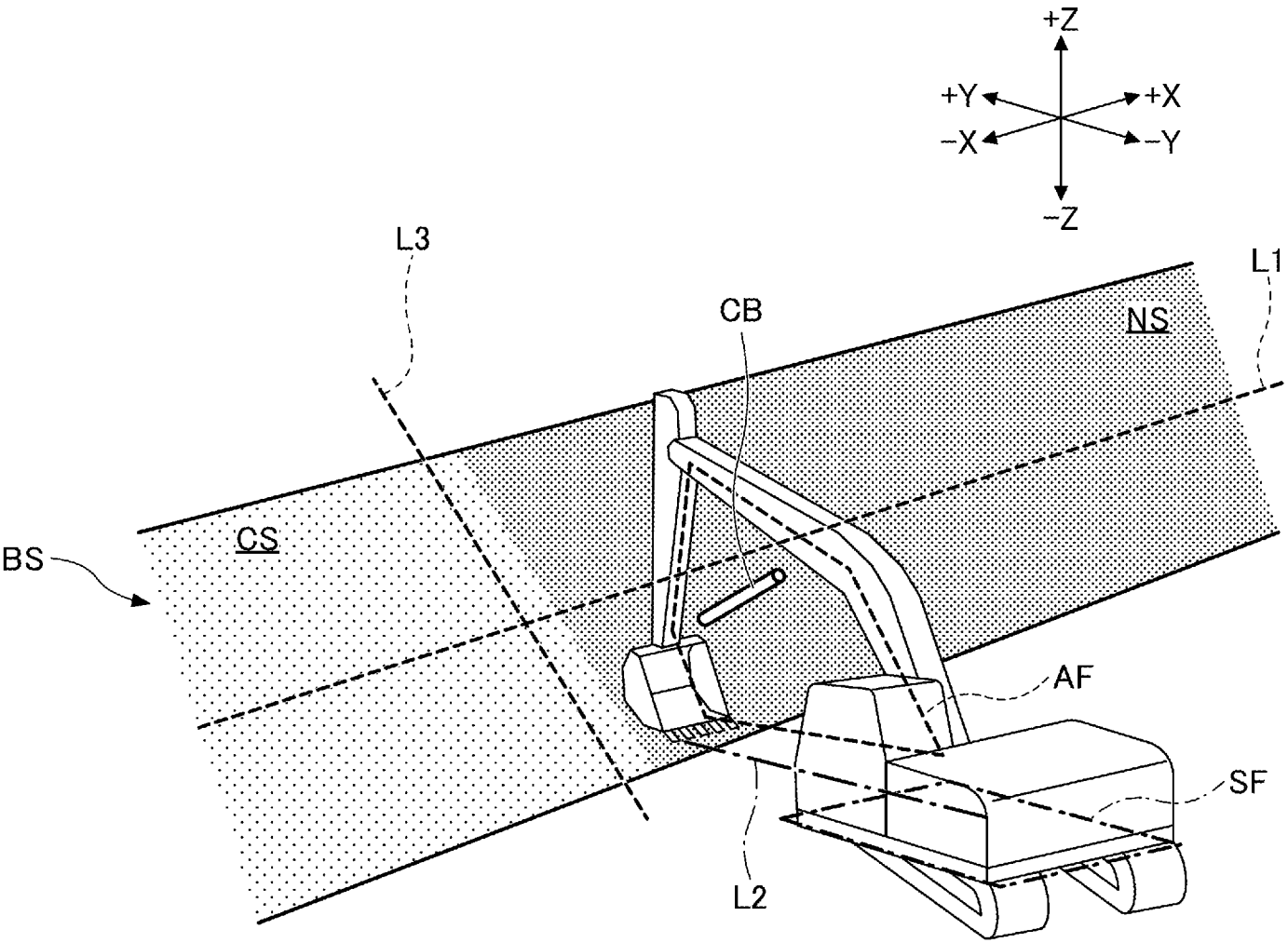
FIG. 7B is a perspective view of the shovel when the front-facing process is performed.

Next, an example of a process in which the controller 30 causes the upper turning body 3 to front-face the intended work surface (hereinafter referred to as a "front-facing process") will be described with reference to FIG. 7A and FIG. 7B. FIG. 7A and FIG. 7B are left-rear perspective views of the shovel 100 when the front-facing process is performed. FIG. 7A depicts a state in which the upper turning body 3 does not front-face the intended work surface, and FIG. 7B depicts a state in which the upper turning body 3 front-faces the intended work surface. In FIG. 7A and FIG. 7B, the intended work surface is an upward slope BS as illustrated in FIG. 1, for example. An area NS illustrated in FIG. 7A and FIG. 7B represents an unfinished area of the upward slope BS, that is, an area where ground surface ES does not coincide with the upward slope BS as illustrated in FIG. 1, and an area CS illustrated in FIG. 7A and FIG. 7B represents a finished area of the upward slope BS, that is, an area where the ground surface ES coincides with the upward slope BS.

The state in which the upper turning body 3 front-faces the intended work surface, includes, for example, a state in which an angle formed between a line segment L1 representing the direction (extending direction) of the intended work surface and a line segment L2 representing the longitudinal axis of the upper turning body 3 is 90 degrees on a horizontal plane. The extending direction of the slope as the direction of the intended work surface, which is represented by the line segment L1, is a direction orthogonal to a slope length direction, for example. The slope length direction is, for example, a direction indicated by a straight line from the upper end (top) to the lower end (toe) of the slope. The state in which the upper turning body 3 front-faces the intended work surface may be defined as a state in which an angle formed between the line segment L2 representing the longitudinal axis of the upper turning body 3 and a line segment L3 perpendicular to the direction (the extending direction) of the intended work surface is 0 degrees on the horizontal plane. A direction represented by the line segment L3 corresponds to a direction of a horizontal component of a perpendicular line drawn to the intended work surface.

A cylinder CB in FIG. 7A and FIG. 7B represents a portion of the normal to the intended work surface (upward slope BS), a dash-dot line in FIG. 7A and FIG. 7B represents a turning plane SF, and a dashed line in FIG. 7A and FIG.

7B represents an attachment operation plane AF. The attachment operation plane AF is perpendicular to the turning plane SF. As illustrated in FIG. 7B, when the upper turning body 3 is in a state of front-facing the intended work surface, the attachment operation plane AF is arranged such that the attachment operation plane AF includes the portion of the normal as represented by the cylinder CB, that is, the attachment operation plane AF extends along the portion of the normal.

The automatic control part 54, for example, sets the turning angle formed when the attachment operation plane AF and the intended work surface (upward slope BS) are perpendicular to each other, as the target angle. The automatic control part 54 detects the current turning angle based on the output of the positioning device P1 or the like, and calculates a difference between the target angle and the current turning angle (detected value). The automatic control part 54 operates the turning hydraulic motor 2A such that the difference is less than or equal to a predetermined value or is zero. Specifically, when the difference between the target angle and the current turning angle is less than or equal to the predetermined value or is zero, automatic control part 54 determines that the upper turning body 3 front-faces the intended work surface. When the turning operating lever is operated while the predetermined switch is pressed, the automatic control part 54 determines whether the turning operating lever is operated in a direction in which the upper turning body 3 front-faces the intended work surface. For example, when the turning operating lever is operated in a direction in which the difference between the target angle and the current turning angle increases, the automatic control part 54 does not perform the front-facing control. When the turning operation lever is operated in a direction in which the difference between the target angle and the current turning angle decreases, the automatic control part 54 performs the front-facing control. In this manner, the turning hydraulic motor 2A can be operated such that the difference between the target angle and the current turning angle is reduced. Then, the automatic control part 54 stops the turning hydraulic motor 2A when the difference between the target angle and the current turning angle is less than or equal to the predetermined value or is zero.

On the basis of the above description of FIG. 7A and FIG. 7B, a flow of the front-facing process will be described again. First, the machine guidance device 50 included in the controller 30 determines whether the upper turning body 3 front-faces the intended work surface. In the present embodiment, the machine guidance device 50 determines whether the upper turning body 3 front-faces the intended work surface based on the information on the intended work surface stored in the storage device 47 in advance and the output of the positioning device P1, which serves as the orientation detector. The information on the intended work surface includes information on the direction of the intended work surface. The positioning device P1 outputs information on the direction of the upper turning body 3. For example, as illustrated in FIG. 7A, in a state in which the attachment operation plane AF does not include the normal to the intended work surface, the machine guidance device 50 determines that the upper turning body 3 of the shovel 100 does not front-face the intended work surface. In such a state, the angle formed between the line segment L1 representing the direction of the intended work surface and the line segment L2 representing the direction of the upper turning body 3 is an angle other than 90 degrees.

When determining that the upper turning body 3 front-faces the intended work surface, the machine guidance device 50 ends the current front-facing process without performing the front-facing control.

When determining that the upper turning body 3 does not front-face the intended work surface, the machine guidance device 50 determines whether an obstacle is present around the shovel 100. In the present embodiment, the machine guidance device 50 performs image recognition processing on an image captured by the camera S6, and determines whether the captured image includes an image of a predetermined obstacle. Examples of the predetermined obstacle include a person, an animal, a machine, and a building, for example. Then, when determining that an image of a predetermined area that is set around the shovel 100 does not include an image of the predetermined obstacle, the machine guidance device 50 determines that no obstacle is present around the shovel 100. The predetermined area includes, for example, an area in which there can be an object that contacts the shovel 100 when the shovel 100 is moved to cause the upper turning body 3 to front-face the intended work surface. However, the predetermined area may be set as a wider area, such as an area within a predetermined distance from the turning axis, for example.

When determining that an obstacle is present around the shovel 100, the machine guidance device 50 ends the current front-facing process without performing the front-facing control. This is to prevent the shovel 100 from contacting the obstacle by performing the front-facing control. In this case, the machine guidance device 50 may output an alarm.

When determining that no obstacle is present around the shovel 100, the machine guidance device 50 performs the front-facing control. In the examples of FIG. 7A and FIG. 7B, the automatic control part 54 of the machine guidance device 50 outputs a current command to the proportional valve 31BL (see FIG. 4B). The pilot pressure generated by the hydraulic oil passing through the proportional valve 31BL and the shuttle valve 32BL from the pilot pump 15 is applied to the left side pilot port of the control valve 173. The control valve 173 receiving the pilot pressure at the left side pilot port is displaced in the right direction and causes the hydraulic oil discharged by the left main pump 14L to flow into a first port 2A1 of the turning hydraulic motor 2A. The control valve 173 causes the hydraulic oil that flows out from a second port 2A2 of the turning hydraulic motor 2A to flow out to the hydraulic oil tank. As a result, the turning hydraulic motor 2A rotates in a forward direction and causes the upper turning body 3 to turn in the left direction around the turning axis. Thereafter, the automatic control part 54 stops the output of the current command to the proportional valve 31BL at 90 degrees of the angle formed between line segment L1 and the line segment L2 or at 0 degrees of the angle formed between the line segment L2 and the line segment L3, and reduces the pilot pressure applied to the left side pilot port of the control valve 173. The control valve 173 is displaced in the left direction, returns to a neutral position, and blocks the flow of the hydraulic oil from the left main pump 14L toward the first port 2A1 of the turning hydraulic motor 2A. The control valve 173 also blocks the flow of the hydraulic oil from the second port 2A2 of the turning hydraulic motor 2A toward the hydraulic oil tank. As a result, the turning hydraulic motor 2A stops the rotation in the forward direction, and stops the turning of the upper turning body 3 in the left direction.

Figure 8:
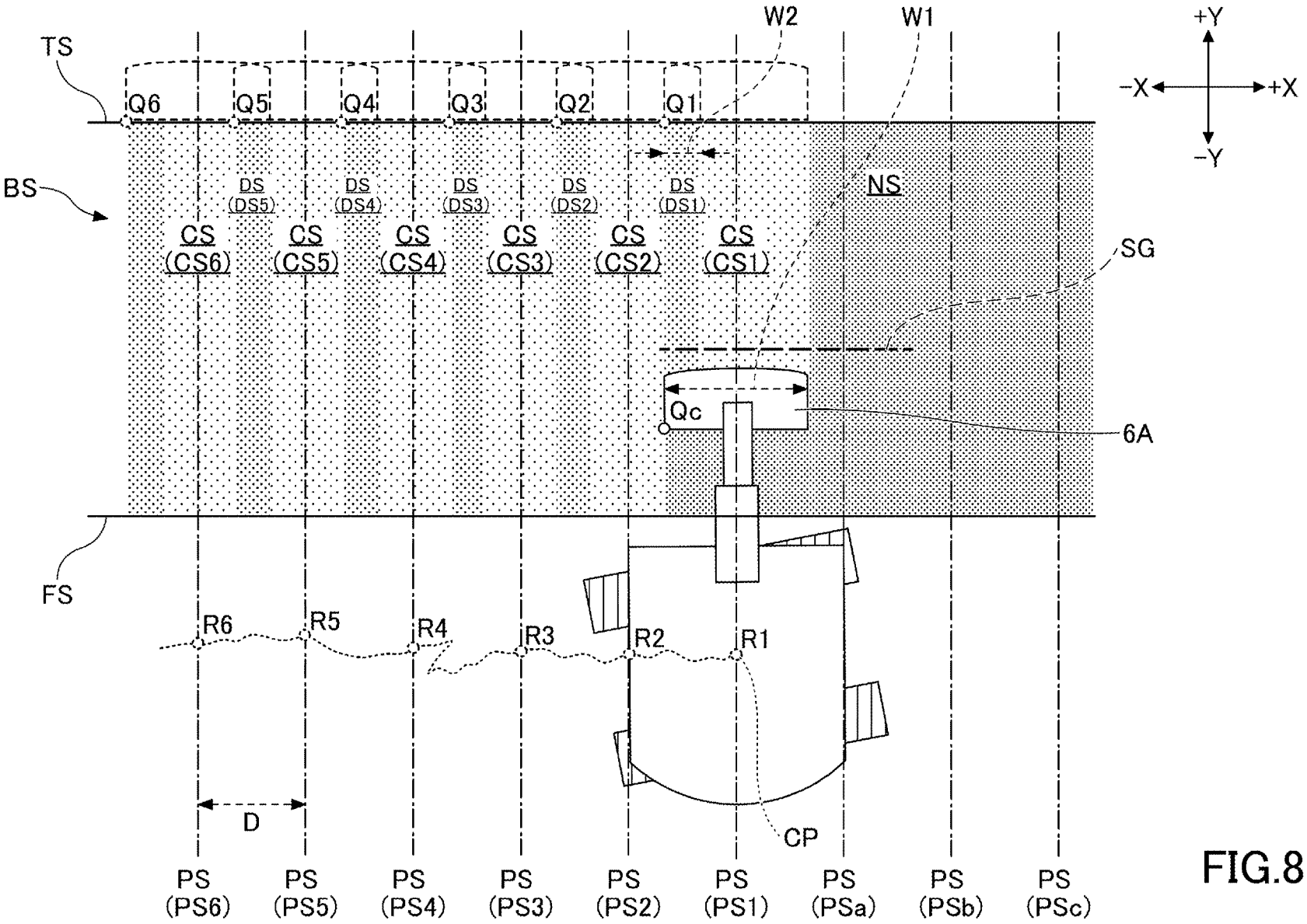
FIG. 8 is a top view of the shovel performing work for forming an upward slope.

Next, an example of the movement of the shovel 100 when the travel operation assist process is performed will be described with reference to FIG. 8. FIG. 8 is a top view of the shovel 100 performing work for forming an upward slope BS that extends linearly along the X axis. In the example of FIG. 8, a slope bucket 6A serving as an end attachment is attached to the tip of the arm 5. The slope bucket 6A has a width W1. The operator performs work such that the upward slope BS is made flat from the top TS to the toe FS with a single stroke of the excavation attachment. The operator repeats a stroke of the excavation attachment and the travel of the lower traveling body 1 such that a wide slope area is finished flat. Specifically, the operator operates the shovel 100 such that a slope area contacted by the slope bucket 6A during the current stroke overlaps with a slope area contacted by the slope bucket 6A during the previous stroke by a predetermined width W2. An area NS in FIG. 8 represents an unfinished area of the upward slope BS, that is, an area where the ground surface ES does not coincide with the upward slope BS as illustrated in FIG. 1. An area CS in FIG. 8 represents a finished area of the upward slope BS, that is, an area where the ground surface ES coincides with the upward slope BS as illustrated in FIG. 1. An area DS represents an overlapping area as described above, that is, an area contacted by the slope bucket 6A during each of two consecutive strokes within the area CS. In the example of FIG. 8, the area CS includes areas CS1 through CS6, and the area DS includes areas DS1 through DS5. The area DS1 represents an area where the area CS1 overlaps with the area CS2, and the area DS2 represents an area where the area CS2 overlaps with the area CS3. The same applies to the areas DS3 through DS5.

FIG. 8 depicts the upward slope BS finished with the current stroke and the past five strokes of the excavation attachment. A point Qc represents the current position of the left edge of the tip of the slope bucket 6A. A point Q1 represents the position of the left edge of the tip of the slope bucket 6A when the current stroke is started. Points Q2 through Q6, indicated by dash circles, represent the positions of the left edge of the tip of the slope bucket 6A when the past five strokes are started. A point R1 represents the current position of the shovel center point CP. Points R2 through R6 represent the respective positions of the shovel center point CP when the past five strokes are started. A plurality of virtual planes PS indicated by dash-dot lines are virtual planes each including the normal to the upward slope BS. The virtual planes PS are arranged at equal intervals, extend in parallel to each other, and spaced apart a distance less than the width W1 of the slope bucket 6A from each other. The virtual planes PS may be arranged at equal intervals, or may be arranged at unequal intervals. In the present embodiment, the virtual planes PS are set beforehand, but may be set dynamically.

Specifically, the virtual planes PS include virtual planes PS1 through PS6 and virtual planes PSa through PSc. The virtual planes PS1 through PS6 are examples of virtual planes PS currently and previously used, and pass through the points R1 through R6 corresponding to the positions of the shovel center point CP and through the attachment of the shovel along the longitudinal direction of the attachment when the current and the past five strokes are started. The virtual planes PSa through PSc are examples of virtual planes PS to be used in the future, and pass through points corresponding to the positions of the shovel center point CP and through the attachment of the shovel along the longitudinal direction of the attachment when the next three strokes are started.

The machine guidance device 50 starts the travel guidance each time the travel lever 26D is operated while the MC switch is pressed, and stops the shovel 100 each time a predetermined part (the shovel center point CP) of the shovel 100 reaches a virtual plane PS, that is, each time the shovel 100 is moved a predetermined distance D. The predetermined distance D is set based on two adjacent virtual planes PS. In this manner, each time the shovel 100 is moved the predetermined distance D, that is, each time the shovel 100 reaches an adjacent virtual plane PS, the machine guidance device 50 sets the next adjacent virtual plane PS located in an unfinished area of the slope as the next target virtual plane. The predetermined distance D, which is the distance between such two adjacent virtual planes, is set based on at least one of the type of the bucket 6, the size of the bucket 6, and the characteristics of soil.

Specifically, the machine guidance device 50 may be configured to set a predetermined condition on the movement of the lower traveling body 1, and control the traveling hydraulic motor 2M to stop the movement of the lower traveling body 1 when the predetermined condition is satisfied. In this case, the predetermined condition includes, for example, the shovel center point CP having reached a virtual plane PS while the shovel 100 is traveling.

For example, based on the output of the positioning device P1, when the machine guidance device 50 determines that the shovel center point CP has reached a virtual plane PS located closest to the +X side while the shovel 100 is traveling, the machine guidance device 50 stops the shovel 100. In the above-described embodiment, the areas extending in a direction parallel to the slope are depicted as areas of movement of the shovel 100. However, the areas of movement of the shovel 100 may extend in a direction perpendicular to the slope (in the direction of the longitudinal axis of the upper turning body 3). In this case, the range of movement of the lower traveling body 1 in the direction perpendicular to the slope is limited such that the top TS and the toe FS of the slope are included in the operating range of the attachment. For example, if the shovel 100 is located too far apart from the slope and the bucket 6 is unlikely to reach the top TS, the machine guidance device 50 may slow or stop the shovel 100 by way of restriction control, or may notify the operator of the shovel 100 that the bucket 6 is unlikely to reach the top TS.

The actual travel distance until the shovel 100 is forcibly stopped is greater than or equal to the distance D between two virtual planes. This is because the shovel 100 does not necessarily take the shortest route between the two virtual planes. Specifically, the actual travel distance until the shovel 100 is forcibly stopped increases if the shovel 100 weaves or repeatedly moves forward and backward.

Figure 9A:
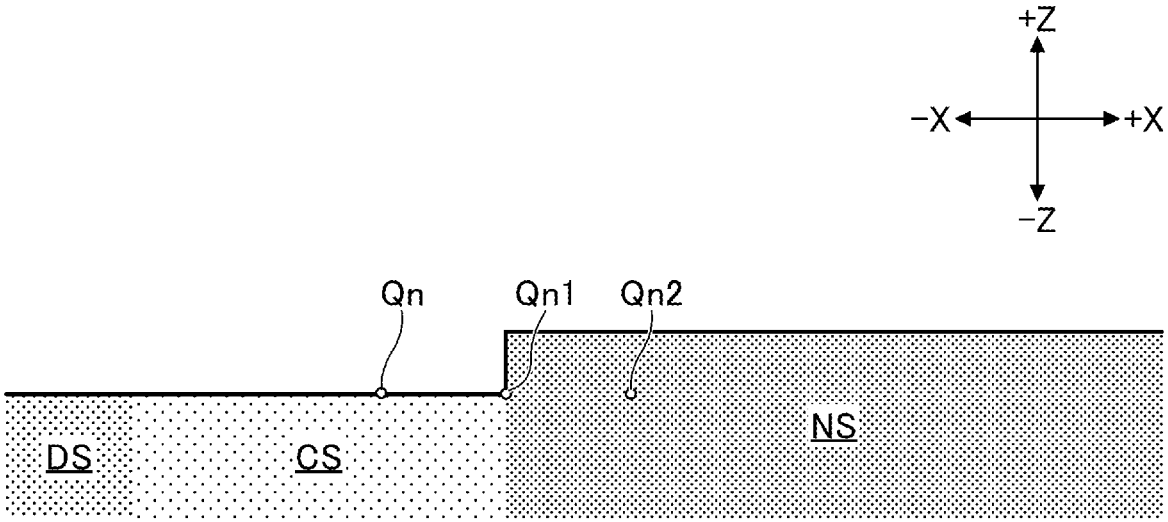
FIG. 9A is a diagram illustrating a vertical cross section of a slope including a line segment SG indicated by a dashed line in FIG. 8.
Figure 9B:
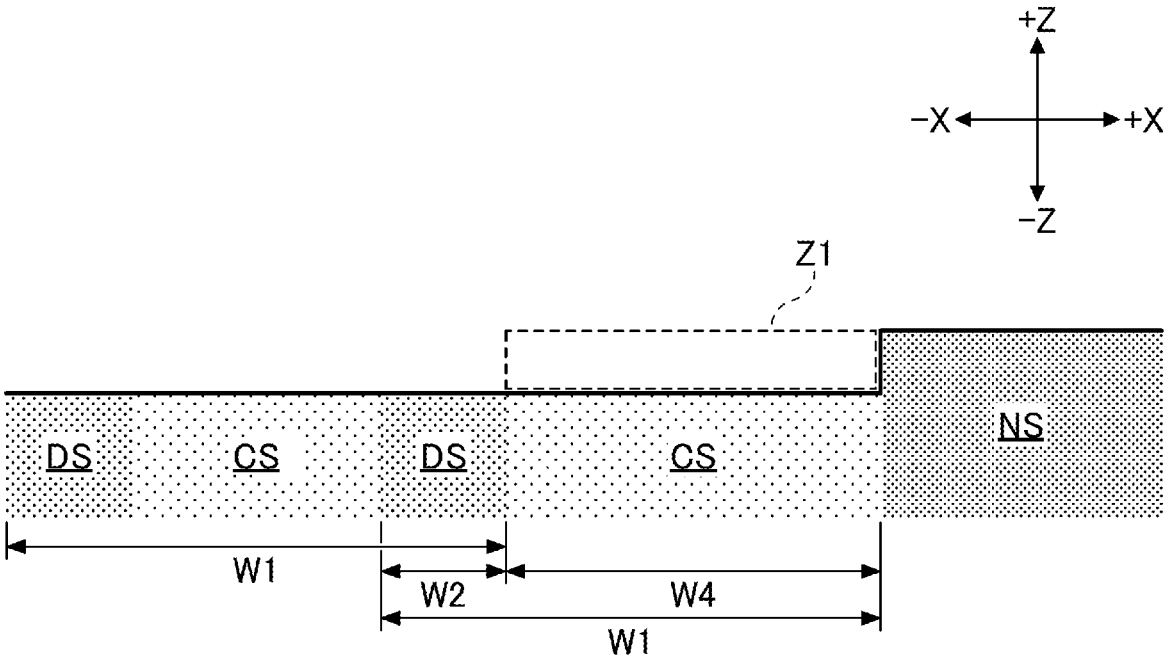
FIG. 9B is a diagram illustrating a vertical cross section of the slope including the line segment SG indicated by the dashed line in FIG. 8.
Figure 9C:
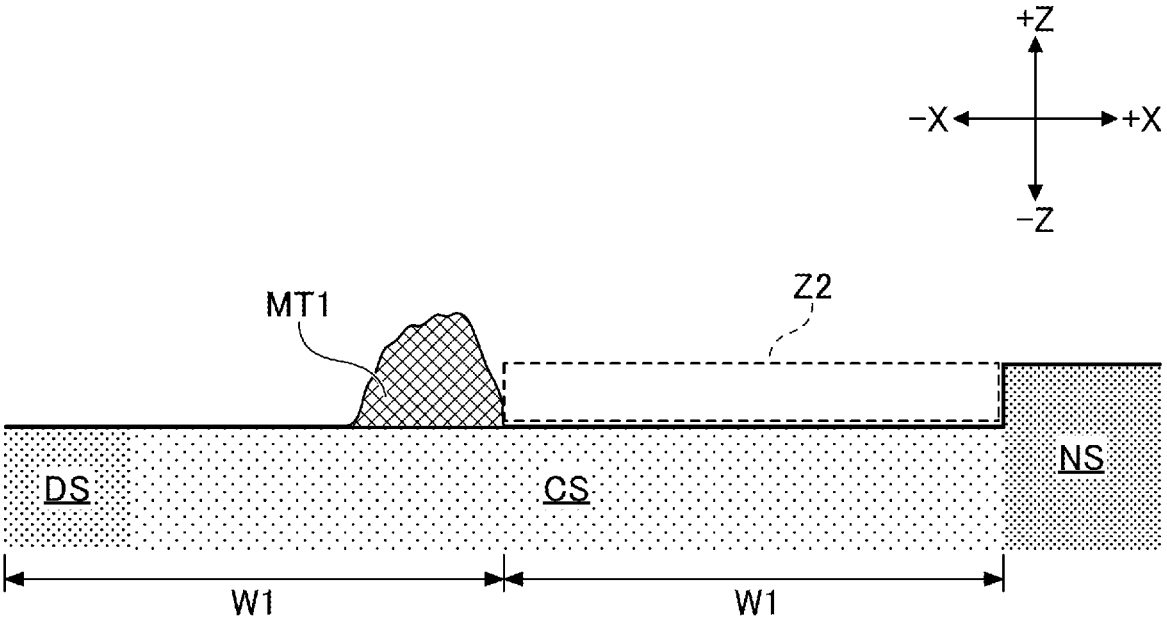
FIG. 9C is a diagram illustrating a vertical cross section of the slope including the line segment SG indicated by the dashed line in FIG. 8.
Figure 9D:
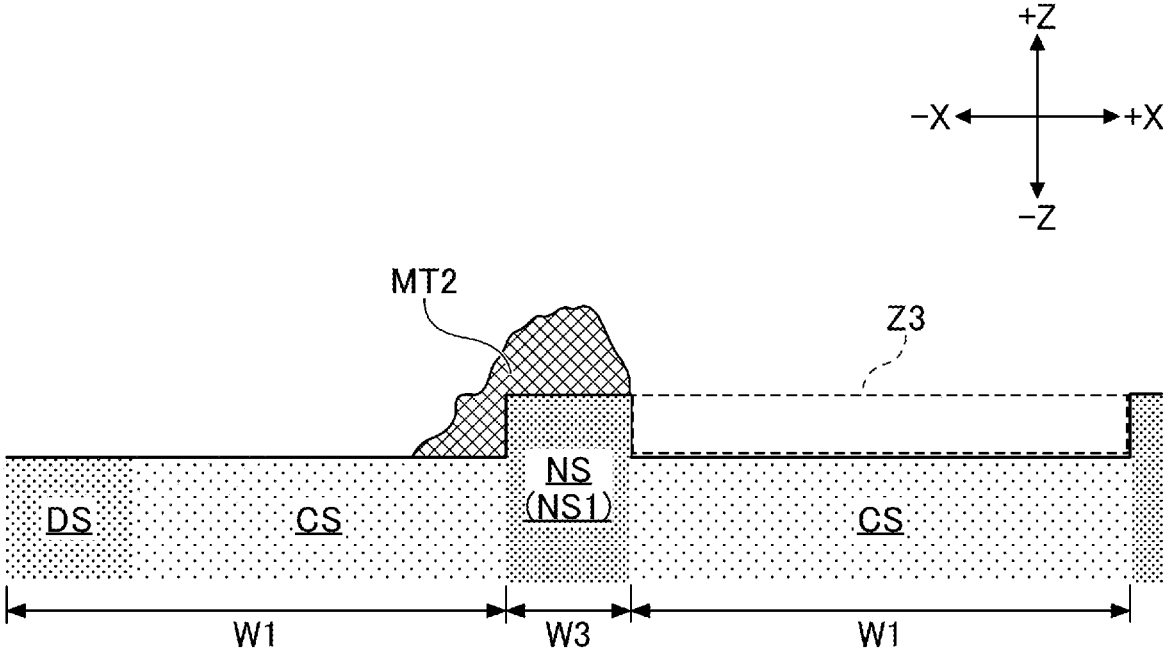
FIG. 9D is a diagram illustrating a vertical cross section of the slope including the line segment SG indicated by the dashed line in FIG. 8.

Next, effects of generating an area DS (see FIG. 8), which is a slope area contacted by the slope bucket 6A during two consecutive strokes of the excavation attachment, will be described with reference to FIG. 9A through FIG. 9D. FIG. 9A through FIG. 9D are diagram illustrating vertical cross sections of the slope including a line segment SG indicated by a dashed line in FIG. 8. Specifically, FIG. 9A depicts a vertical cross section of the slope after the current stroke is completed. FIG. 9B depicts a vertical cross section of the slope after the next excavation stroke is completed such that an area DS having a width W2 is generated. FIG. 9C depicts a vertical cross section of the slope after the next excavation stroke is completed such that the width W2 of the overlapping area is zero, that is, no area DS is generated. FIG. 9D depicts a vertical cross section of the slope where a gap having a width W3 is formed between two areas formed with the current stroke and the next stroke and both having a width W1. In FIG. 9A, points Qn, Qn1, and Qn2 represent the respective positions of the left edge of the tip of the slope bucket 6A at the time of the next stroke. A state of the slope illustrated in FIG. 9B is caused by the left edge of the tip of the slope bucket 6A passing through the point Qn during the next stroke. A state of the slope illustrated in FIG. 9C is caused by the left edge of the tip of the slope bucket 6A passing through the point Q1 during the next stroke. A state of the slope illustrated in FIG. 9D is caused by the left edge of the tip of the slope bucket 6A passing through the point Q2 during the next stroke.

Specifically, if the left edge of the tip of the slope bucket 6A passes through the point Qn during the next stroke, the slope bucket 6A excavates soil in an area Z1 having a width W4 (=W1−W2) indicated by a dashed line in FIG. 9B. In this case, all the excavated soil can be loaded into the slope bucket 6A while the slope bucket 6A is moved from the top TS to the toe FS, without causing the soil to fall out of the slope bucket 6A. This is because no accumulated soil is present over the area DS, and thus, the amount (volume) of the soil loaded into the slope bucket 6A is smaller than that when the entire width of the slope bucket 6A is utilized to excavate soil.

If the left edge of the tip of the slope bucket 6A passes through the point Qn1 during the next stroke, the slope bucket 6A excavates soil in an area Z2 having the width W1 indicated by a dashed line in FIG. 9C. In this case, all the excavated soil would not be loaded into the slope bucket 6A while the slope bucket 6A is moved from the top TS to the toe FS, thereby causing the soil to fall out of the slope bucket 6A. This is because the entire width of the slope bucket 6A is utilized to excavate the soil, and thus, the amount (volume) of the soil loaded into the slope bucket 6A is larger than that illustrated in FIG. 9B. In FIG. 9C, MT1 represents soil that fell from the left edge of the tip of the slope bucket 6A and was accumulated in an area CS. In the example of FIG. 9C, the operator would be required to move the shovel 100 to the −X side and then remove the soil MT1 accumulated in the area CS with an additional stroke of the excavation attachment.

If the left edge of the tip of the slope bucket 6A passes through the point Qn2 during the next stroke, the slope bucket 6A excavates soil in an area Z3 having the width W1 indicated by a dashed line in FIG. 9C. Similar to FIG. 9C, in this case, all the excavated soil would not be loaded into the slope bucket 6A while the slope bucket 6A is moved from the top TS to the toe FS, thereby causing the soil to fall out of the slope bucket 6A. This is because the entire width of the slope bucket 6A is utilized to excavate the soil, and thus, the amount (volume) of the soil loaded into the slope bucket 6A is larger than that illustrated in FIG. 9B. In FIG. 9D, MT2 represents soil that fell from the left edge of the tip of the slope bucket 6A and was accumulated in an area NS1 and the area CS. The area NS1 is located between the area having the width W1 and formed with the current stroke and the area having the width W1 and formed with the next stroke. In the example of FIG. 9D, the operator would be required to move the shovel 100 to the −X side and then remove the soil MT2 accumulated in the area NS1 and the area CS with an additional stroke of the excavation attachment.

As described above, if the amount of soil loaded into the slope bucket 6A with a single stroke exceeds the capacity of the slope bucket 6A, some of the soil excavated by the slope bucket 6A would fall into the finished area CS. As a result, the operator would be required to move the shovel 100 and then remove the soil accumulated in the area CS with an additional stroke of the excavation attachment.

Note that even if an area DS is generated as illustrated in FIG. 9B, there would be a case where soil would fall into the area CS if the width W2 of the area CS is insufficient, as with the case of FIG. 9C in which no area DS is generated. Such a case would tend to occur if the operator manually performs an operation for moving the shovel 100. Specifically, such a case would occur if the operator manually performs a travel operation and the shovel 100 is moved excessively.

In light of the above, the machine guidance device 50 controls the travel of the shovel 100 during each stroke by appropriately arranging the virtual planes PS, such that the amount of soil loaded into the slope bucket 6A during a single stroke does not exceed the capacity of the slope bucket 6A. Specifically, as illustrated in FIG. 8, the machine guidance device 50 forcibly stops the travel of the shovel 100 when the shovel center point CP reaches a virtual plane PS. As a result, as illustrated in FIG. 9B, the upper turning body 3 can be positioned such that a slope area contacted by the slope bucket 6A during the current stroke overlaps with a slope area contacted by the slope bucket 6A during the previous stroke by the predetermined width W2.

The same applies to a case where the target travel distance is set. In this case, the machine guidance device 50 controls the travel of the shovel 100 during each stroke by setting the target travel distance to an appropriate value, such that the amount of soil loaded into the slope bucket 6A during a single stroke does not exceed the capacity of the slope bucket 6A. Specifically, the machine guidance device 50 forcibly stops the travel of the shovel 100 when a travel distance calculated based on the output of the positioning device P1 reaches the target travel distance.

Figure 10:
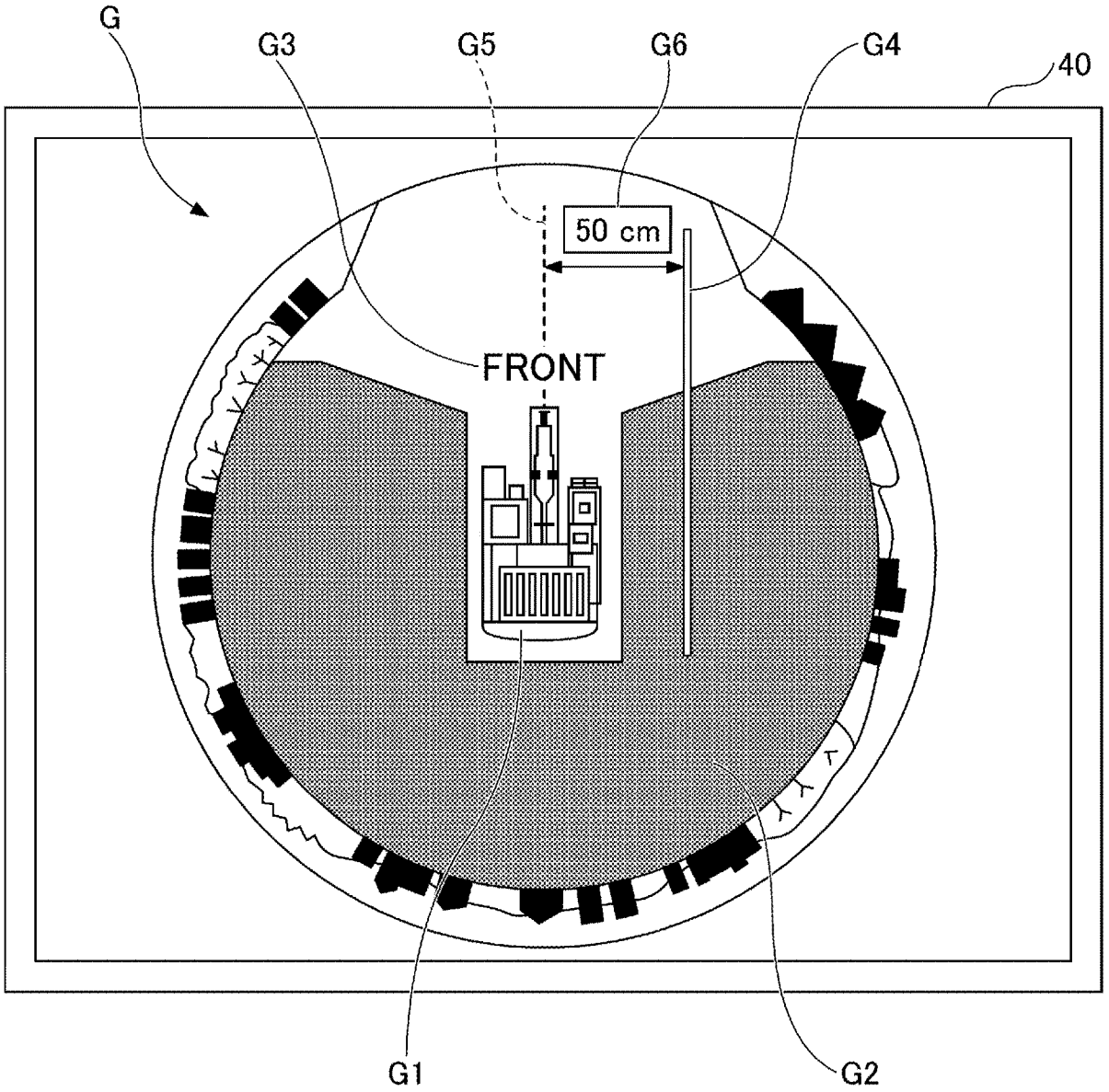
FIG. 10 is a diagram illustrating an example configuration of a travel guidance image.

Next, a travel guidance image G, displayed on the display device 40 when the travel guidance is started, will be described with reference to FIG. 10. FIG. 10 is a diagram illustrating an example configuration of the travel guidance image G. The travel guidance image G includes images G1 through G6.

An image G1 is a shovel graphic shape representing the shape of the shovel 100 immediately from above. In the present embodiment, the shovel graphic shape is disposed approximately at the center of the travel guidance image G, and is disposed such that a graphic shape representing the excavation attachment is directed to the upper side of the display device 40.

An image G2 is an overhead view image of an area surrounding the shovel 100. In the present embodiment, the controller 30 generates an overhead view image by subjecting respective images captured by the back camera S6B, the front camera S6F, the left camera S6L, and the right camera S6R to viewpoint change processing. As illustrated in FIG. 10, the overhead view image as the image G2 is disposed to surround the shovel graphic shape as the image G1.

An image G3 is a text indicating where an image of a feature in front of, behind, to the left, and to the right of the shovel 100 is displayed in the travel guidance image G. In the present embodiment, the image G3 is a text message "FRONT", and indicates that the image of the feature in front of the shovel 100 is displayed on the upper side of the travel guidance image G. This also indicates that images of features behind, to the left, and to the right of shovel 100 are displayed on the lower side, the left side, and the right side of the travel guidance image G, respectively.

An image G4 is a graphic shape representing a virtual plane PS located to the right of the shovel 100. In the present embodiment, the image G4 is a line segment representing a virtual plane PS located closest to the right of the shovel 100.

An image G5 is a graphic shape representing the position of the shovel 100 with respect to the virtual plane PS. In the present embodiment, the image G5 is a dashed line representing a line segment parallel to the virtual plane PS and passing through the shovel center point CP.

An image G6 is a graphic shape representing the distance between the shovel center point CP and the virtual plane PS. In the present embodiment, the image G6 is combination of a two-way arrow and a text box. The text box displays a value of the linear distance between the shovel center point CP and the virtual plane PS. In the example of FIG. 10, the linear distance is "50 cm". The two-way arrow is disposed between the image G4 (line segment) and the image G5 (dashed line), and the value "50 cm" displayed in the text box indicates the linear distance between the shovel center point CP and the virtual plane PS. The value of the linear distance displayed in the text box is updated as the shovel 100 moves. The display position of the image G4 may change as the value of the linear distance increases or decreases, or does not necessarily change even if the value of the linear distance changes.

By looking at the travel guidance image G, the operator can intuitively understand the extent to which the shovel 100 should be moved, such that the amount of soil to be loaded into the slope bucket 6A during the next stroke does not exceed the capacity of the slope bucket 6A.

Figure 11:
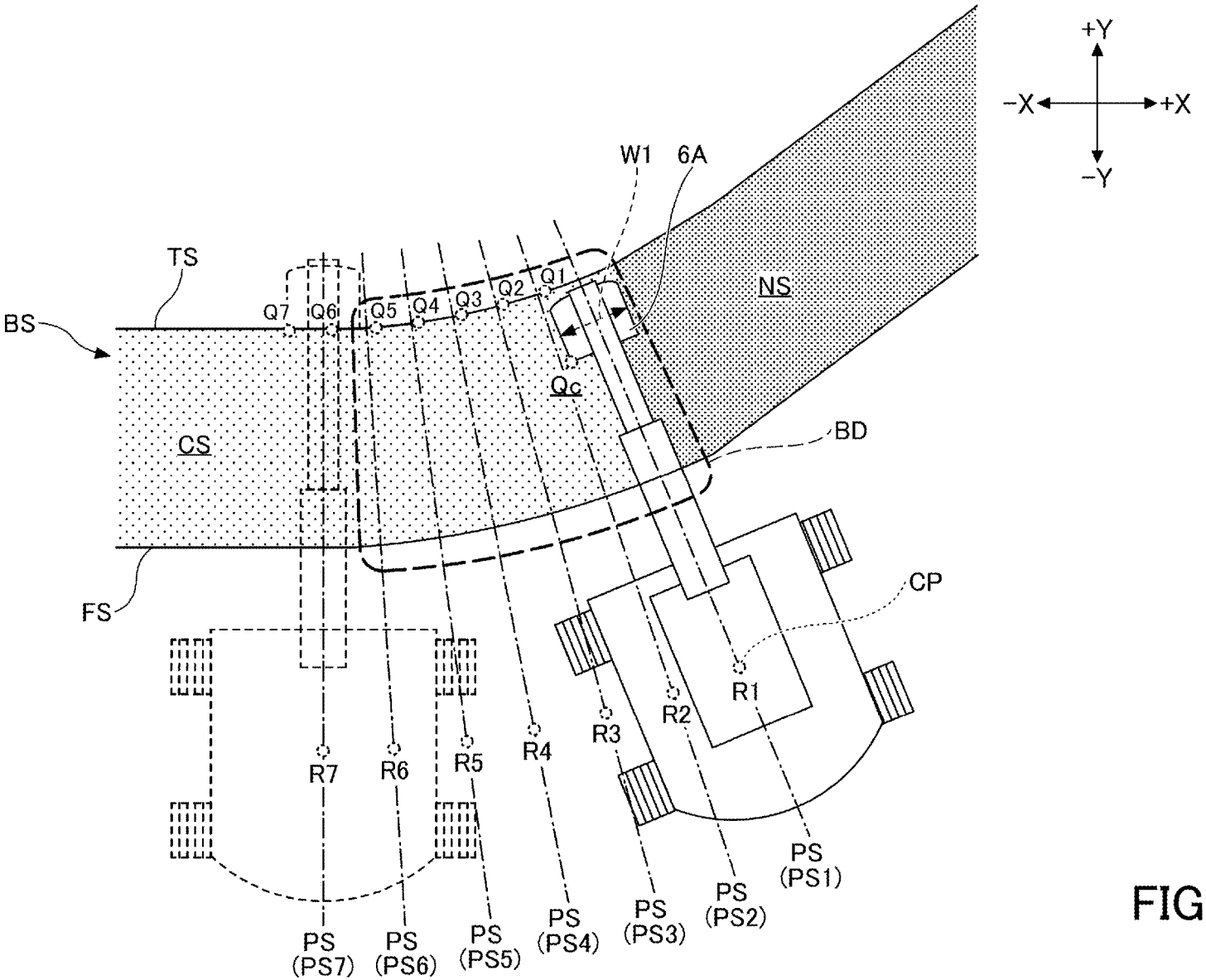
FIG. 11 is a top view of the shovel performing work for forming an upward slope that includes a curve.

Next, another example of the movement of the shovel 100 when the travel operation assist process is performed will be described with reference to FIG. 11. FIG. 11 is a top view of the shovel 100 performing work for forming an upward slope BS that includes a curve BD. In the example of FIG. 11, a slope bucket 6A serving as an end attachment is attached to the tip of the arm 5. The slope bucket 6A has a width W1. The operator performs work such that the upward slope BS is made flat from the top TS to the toe FS with a single stroke of the excavation attachment. Specifically, the operator operates the shovel 100 such that a slope area contacted by the slope bucket 6A during the current stroke overlaps with a slope area contacted by the slope bucket 6A during the previous stroke by a predetermined width, as illustrated in FIG. 8. An area NS in FIG. 11 represents an unfinished area of the upward slope BS, that is, an area where the ground surface ES does not coincide with the upward slope BS as illustrated in FIG. 1. An area CS in FIG. 8 represents a finished area of the upward slope BS, that is, an area where the ground surface ES coincides with the upward slope BS as illustrated in FIG. 1.

FIG. 11 depicts the upward slope BS that includes slope areas finished with the current stroke and the past six strokes of the excavation attachment. A point Qc represents the current position of the left edge of the tip of the slope bucket 6A. A point Q1 represents the position of the left edge of the tip of the slope bucket 6A when the current stroke is started. Points Q2 through Q7 represent the positions of the left edge of the tip of the slope bucket 6A when the past six strokes are started. The position of the shovel indicated by dashed line indicates the position of the shovel 100 when the first stroke is started. A point R1 represents the current position of the shovel center point CP. Points R2 through R7 represent the positions of the shovel center point CP when the past six strokes are started. A plurality of virtual planes PS are virtual planes each including the normal to the upward slope BS. The virtual planes PS are spaced apart a distance less than the width W1 of the slope bucket 6A from each other, and extend in parallel to each other in the extending direction of the upward slope BS. In addition, each of the virtual plane PS passes through the center of curvature of the curve BD. Further, at the top TS or the toe FS of the upward slope BS, the virtual planes PS may be arranged at equal intervals or may be arranged at unequal intervals. The virtual planes PS may be set beforehand or may be set dynamically.

Specifically, the virtual planes PS include virtual planes PS1 through PS7. The virtual plane PS1 passes through the center of curvature and the point R1. The same applies to the virtual planes PS2 through PS7.

The machine guidance device 50 starts the travel guidance each time the travel lever 26D is operated while the MC switch is pressed, and stops the shovel 100 each time the predetermined part of the shovel 100 reaches a virtual plane PS, that is, each time the shovel 100 is moved a predetermined distance.

Specifically, based on the output of the positioning device P1, when the machine guidance device 50 determines that the shovel center point CP has reached a virtual plane PS located closest to the +X side while the shovel 100 is traveling, the machine guidance device 50 stops the travel of the shovel 100. Therefore, when the shovel 100 performs work at the top TS of the curve BD, the actual travel distance of the shovel 100 (for example, the distance between the point R5 and the point R4) is greater than the moving distance (for example, the distance between the point Q5 and the point Q4) of the slope bucket 6A. In the above-described embodiment, the areas extending in a direction parallel to the slope are depicted as areas of movement of the shovel 100. However, the areas of movement may extend in a direction perpendicular to the slope (in the direction of the longitudinal axis of the upper turning body 3). In this case, the range of movement of the lower traveling body 1 in the direction perpendicular to the slope is limited such that the top TS and the toe FS of the slope are included in the operating range of the attachment. For example, if the shovel 100 is located too far apart from the slope and the bucket 6 is unlikely to reach the top TS, the machine guidance device 50 may slow or stop the shovel 100 by way of restriction control, or may notify the operator of the shovel 100 that the bucket 6 is unlikely to reach the top TS.

As described above, even when the upward slope BS includes the curve BD, the machine guidance device 50 can perform the travel operation assist process in a manner similar to the case of the upward slope BS that linearly extends.

Figure 12:
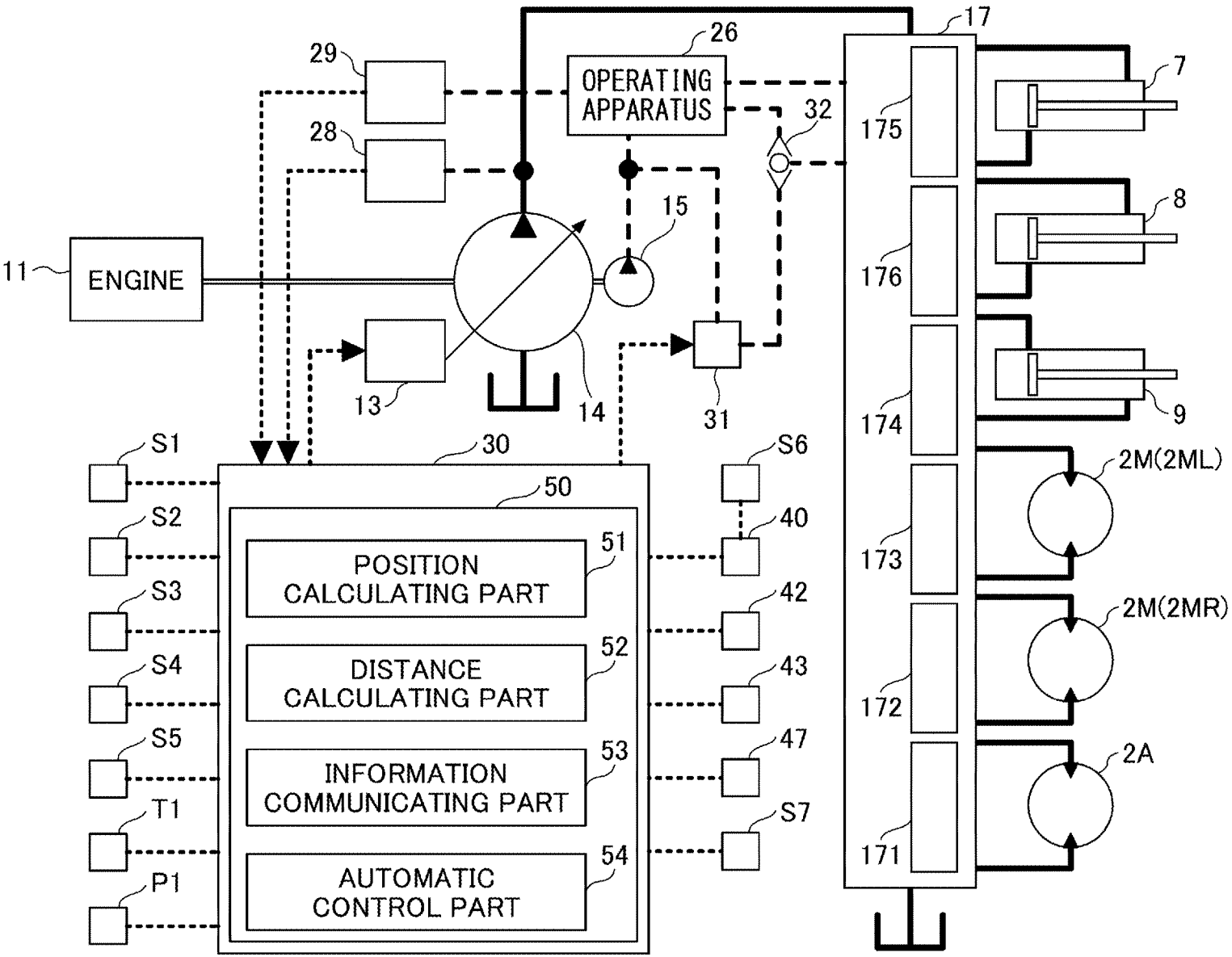
FIG. 12 is a block diagram illustrating yet another example configuration of the basic system of the shovel of FIG. 1.

Next, yet another example configuration of the machine guidance device 50 will be described with reference to FIG. 12. FIG. 12 is a block diagram illustrating yet another example configuration of the basic system of the shovel 100, which corresponds to FIG. 2. The basic system of FIG. 12 differs from the basic system of FIG. 12 in that a space recognition device S7 is included. However, the other elements of the basic system of FIG. 12 are the same as those of the basic system of FIG. 2. Thus, the description of the same elements will not be repeated, and only the differences will be described in detail. In the example of FIG. 12, the shovel 100 performs work for forming an upward slope BS that extends linearly along the X-axis (see FIG. 8.

The space recognition device S7 is configured to be able to detect a feature located in a space around the shovel 100. In the present embodiment, the space recognition device S7 is lidar. The space recognition device S7 may be a distance image sensor. Specifically, the space recognition device S7 includes front lidar that recognizes a feature located in a space in front of the shovel 100, left lidar that recognizes a feature located in a space to the left of the shovel 100, right lidar that recognizes a feature located in a space to the right of the shovel 100, and back lidar that recognizes a feature located behind the shovel 100.

The front lidar is attached to, for example, the ceiling of the cabin 10, namely, the inside of the cabin 10. The front lidar may alternatively be attached to the roof of the cabin 10, namely, the outside of the cabin 10. The left lidar is attached to the left end of the upper surface of the upper turning body 3. The right lidar is attached to the right end of the upper surface of the upper turning body 3. The back lidar is attached to the back end of the upper surface of the upper turning body 3.

The machine guidance device 50 is configured to dynamically determine the position of a virtual plane PS, based on the volume of soil loaded into the slope bucket 6A during work using excavation attachment, which is performed immediately after the lower traveling body 1 is moved. That is, the machine guidance device 50 is configured to dynamically determine the distance D between a virtual plane PS determined at the previously time and a virtual plane PS to be determined at the current time. Typically, the machine guidance device 50 is configured to determine the distance D such that the volume of soil loaded into the slope bucket 6A during work using excavation attachment, which is performed immediately after the lower traveling body 1 is moved, is approximately equal to the capacity of the slope bucket 6A.

The volume of soil loaded into the slope bucket 6A is calculated based on, for example, data on the intended work surface, data on the current ground surface ES, data on the size of the slope bucket 6A, and data on the distance between a work start position and a work end position. Typically, the data on the current ground surface ES includes data on an area CS finished with the immediately previous stroke and data on an area NS to be finished with the next stroke.

The data on the intended work surface is, for example, data on the upward slope BS, and is stored in the storage device 47. The data on the current ground surface ES is, for example, derived based on the output of the space recognition device S7. The data on the size of the slope bucket 6A is, for example, stored in the storage device 47. The data on the size of the slope bucket 6A includes, for example, the capacity and the width W1 of the slope bucket 6A. The data on the distance between the work start position and the work end position includes, for example, data on the slope length that is the linear distance between the top TS and the toe FS.

The data on the current ground surface ES may be derived based on the output of the camera S6. Alternatively, the data on the current ground surface ES may be derived based on the past transition (operation history) of the orientation of the excavation attachment, which is calculated based on the outputs of the boom angle sensor S1, the arm angle sensor S2, and the bucket angle sensor S3. In this case, the space recognition device S7 may be omitted.

The machine guidance device 50 can derive the thickness of soil present between the intended work surface and the current ground surface ES based on the data on the intended work surface and the data on the current ground surface ES. Then, based on the thickness of the soil, the width W1 of the slope bucket 6A, and the slope length, the machine guidance device 50 can derive the volume of the soil loaded into the slope bucket 6A during work using the excavation attachment, which is performed immediately after the lower traveling body 1 is moved.

The volume of the soil loaded into the slope bucket 6A decreases as the width W2 of an area DS increases. This is because no accumulated soil is present over the area DS.

Based on the above-described relationship, the machine guidance device 50 can derive the width W2 that satisfies, for example, a condition that the volume of soil loaded into the slope bucket 6A does not exceed the capacity of the slope bucket 6A. That is, the machine guidance device 50 can derive the width W2 that satisfies a condition that soil does not fall out of the slope bucket 6A during work using the excavation attachment, which is performed immediately after the lower traveling body 1 is moved.

Upon determining the width W2 that satisfies the above-described condition, the machine guidance device 50 can derive the distance D between virtual planes in real time.

Upon determining the distance D between the virtual planes, the machine guidance device 50 can determine the position of a new virtual plane PS, and continuously monitor the positional relationship between the new virtual plane PS and the shovel center point CP. Then, the machine guidance device 50 can stop the travel of the shovel 100 by stopping the rotation of the traveling hydraulic motor 2M upon determining that the shovel center point CP has reached the virtual plane PS.

Next, a configuration of an autonomous operation function of the shovel 100 will be described with reference to FIG. 13A through FIG. 13C.

Figure 13A:
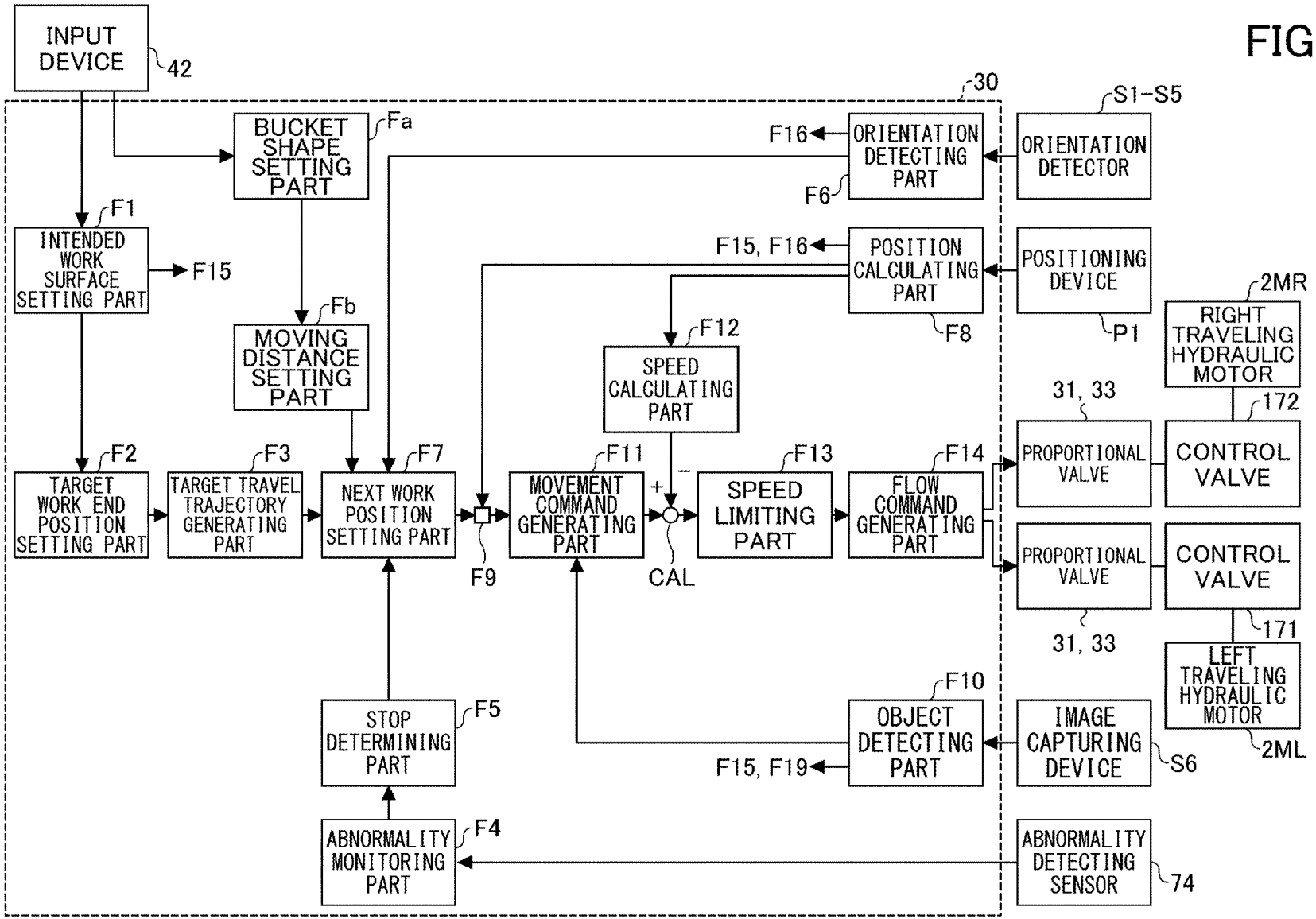
FIG. 13A is a diagram illustrating an example configuration of an autonomous operation function of the shovel.
Figure 13B:
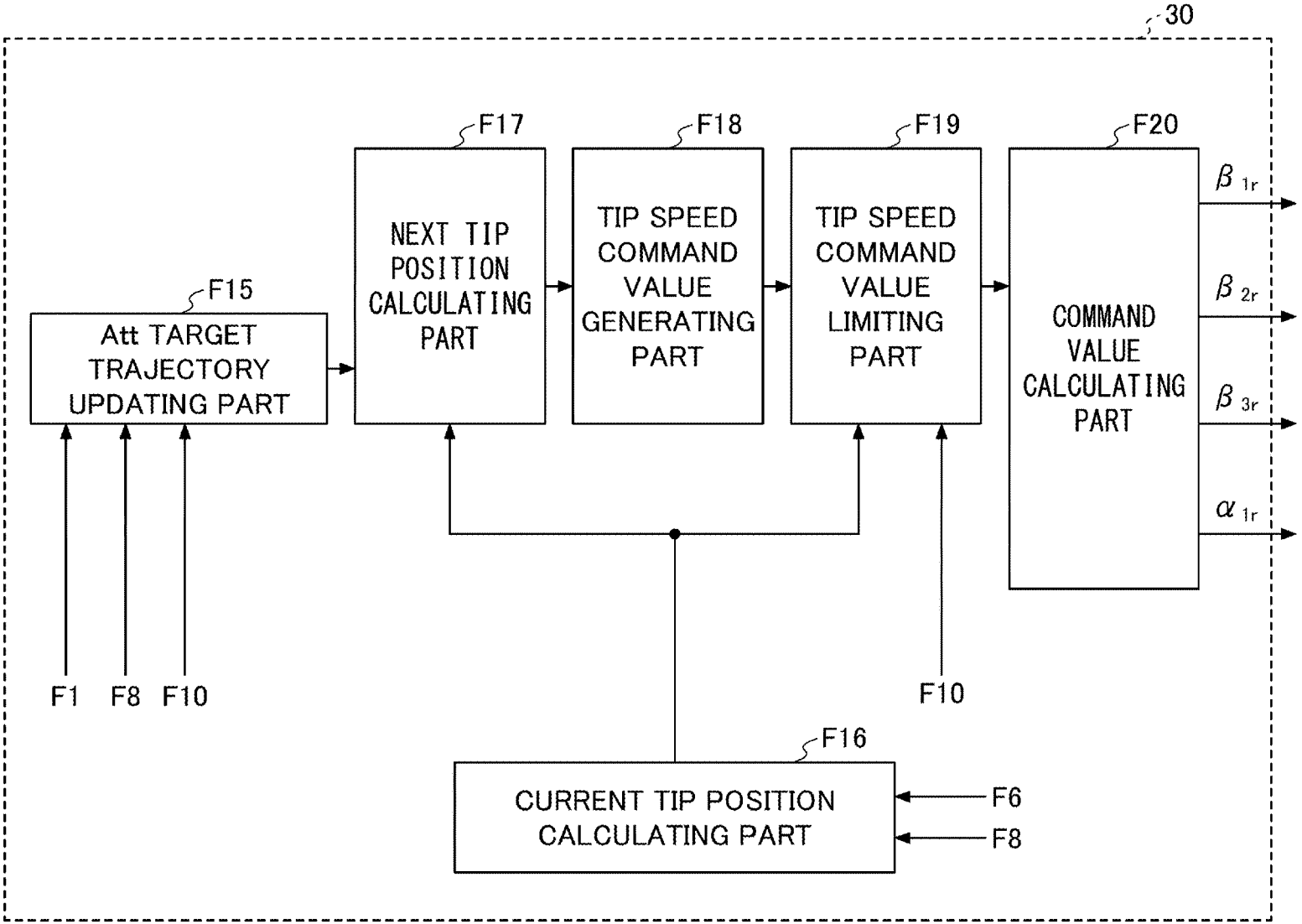
FIG. 13B is a diagram illustrating an example configuration of the autonomous operation function of the shovel.
Figure 13C:
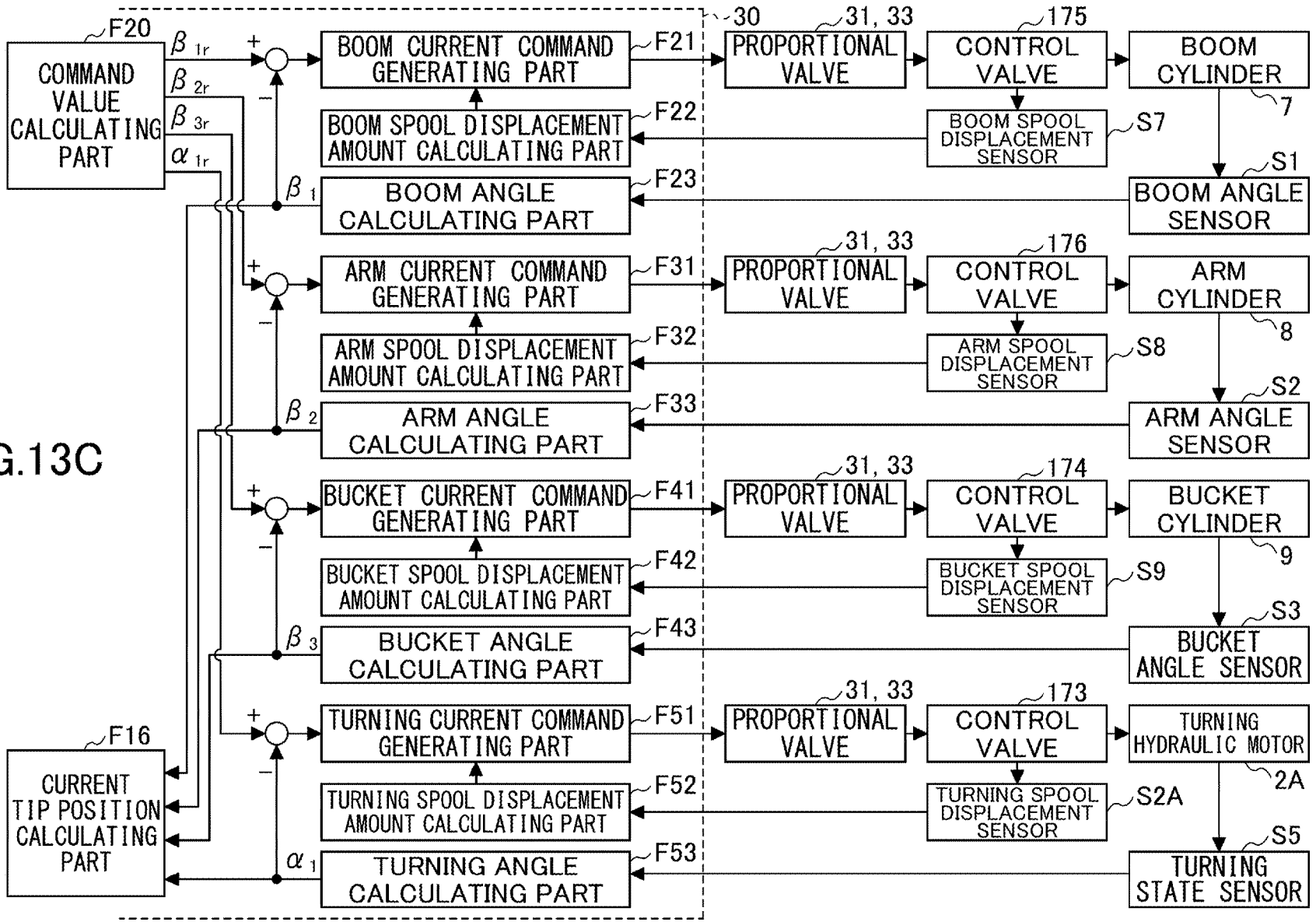
FIG. 13C is a diagram illustrating an example configuration of the autonomous operation function of the shovel.

FIG. 13A through FIG. 13C are diagrams illustrating an example configuration of an autonomous operation function of the shovel 100. Specifically, FIG. 13A is a diagram illustrating an example configuration of the autonomous operation function related to the lower traveling body 1. FIG. 13B and FIG. 13C are diagrams illustrating example configurations of the autonomous operation function related to the upper turning body 3 and the attachment.

In the present example, the controller 30 is configured to receive signals output from at least one of an orientation detector, the input device 42, an image capturing device (camera S6), the positioning device P1, an abnormality detecting sensor 74, and the like, execute various computations, and output control signals to the proportional valve 31, the proportional valve 33, and the like. The orientation detector includes the boom angle sensor S1, the arm angle sensor S2, the bucket angle sensor S3, the body tilt sensor S4, and a turning state sensor (turning angular velocity sensor S5).

The controller 30 includes an intended work surface setting part F1, a target work end position setting part F2, a target travel trajectory generating part F3, an abnormality monitoring part F4, a stop determining part F5, an orientation detecting part F6, a next work position setting part F7, a position calculating part F8, a comparison part F9, an object detecting part F10, a movement command generating part F11, a speed calculating part F12, a speed limiting part F13, a flow command generating part F14, a bucket shape setting part Fa, and a moving distance setting part Fb as functional elements. Further, the controller 30 includes an Att target trajectory updating part F15, a current tip position calculating part F16, a next tip position calculating part F17, a tip speed command value generating part F18, a tip speed command value limiting part F19, a command value calculating part F20, a boom current command generating part F21, a boom spool displacement amount calculating part F22, a boom angle calculating part F23, an arm current command generating part F31, an arm spool displacement amount calculating part F32, an arm angle calculating part F33, a bucket current command generating part F41, a bucket spool displacement amount calculating part F42, a bucket angle calculating part F43, a turning current command generating part F51, a turning spool displacement amount calculating part F52, and a turning angle calculating part F53 as functional elements.

Although the functional elements of the controller 30 are illustrated as separate components for explanation purposes, the functional elements are not necessarily physically separated, and may be entirely or partially implemented by a common software component or hardware component.

Further, one or more functional elements of the controller 30 may be functional elements of, for example, a management apparatus 300, which will be described later, or any other control apparatus. That is, the functional elements may be implemented by any control apparatus. For example, the target work end position setting part F2, the target travel trajectory generating part F3, and the movement command generating part F11 may be implemented by the management apparatus 300 provided outside the shovel 100.

The intended work surface setting part F1 sets the intended work surface based on the output of the input device 42, that is, based on an operation received by the input device 42. The intended work surface setting part F1 may set the intended work surface based on information received by an external apparatus (such as the management apparatus 300 as will be described later) through the communication device T1.

The target work end position setting part F2 is configured to set a target position (hereinafter referred to as a "target work end position") corresponding to an end position of predetermined work, which is used during autonomous travel of the shovel 100 (lower traveling body 1). For example, the target work end position setting part F2 may set the target work end position, corresponding to a work end position on a slope during construction work of the slope, while causing the shovel 100 to autonomously travel in parallel to the intended work surface. The target work end position may be included in the information on the intended work surface stored in the input device 42, or may be automatically generated based on the intended work surface.

The target travel trajectory generating part F3 is configured to generate a target travel trajectory, which is used during autonomous travel of the shovel 100 (lower traveling body 1), based on the shape of the intended work surface and the target work end position. Further, the target travel trajectory generating part F3 may set a tolerance range for the generated target travel trajectory.

The bucket shape setting part Fa is configured to set information on the shape of the bucket. In the example of FIG. 13A, the bucket shape setting part Fa sets information on the shape of the bucket based on the output of the input device 42, that is, based on an operation received by the input device 42. The information on the shape of the bucket is, for example, information on the width of the backet, the back surface angle of the bucket, or the like. The back surface angle of the bucket is an angle formed between a line segment, connecting an arm top pin and the tip of the bucket 6, and the back surface of the bucket 6. With this configuration, when the slope bucket 6A is attached to the tip of the arm 5, the bucket shape setting part Fa can recognize that the width (see the "width W1" in FIG. 8) of the slope bucket 6A is greater than when the typical bucket 6 is attached.

The moving distance setting part Fb is configured to be able to set the moving distance of the shovel 100. In the example of FIG. 13A, the moving distance setting part Fb sets the moving distance of the shovel 100, based on the information on the shape of the bucket set by the bucket shape setting part Fa. For example, when work for forming a slope is performed, the moving distance setting part Fb sets the moving distance (see the "distance D" in FIG. 8) of the shovel 100 based on the width (see the "width W1" in FIG. 8) of the slope bucket 6A.

The abnormality monitoring part F4 is configured to monitor the abnormality of the shovel 100. In the present example, the abnormality monitoring part F4 determines the degree of abnormality of the shovel 100 based on the output of the abnormality detecting sensor 74. For example, the abnormality detecting sensor 74 may include at least one of a sensor for detecting an error in the engine 11, a sensor for detecting an error related to the temperature of the hydraulic oil, a sensor for detecting an error in the controller 30, and the like.

The stop determining part F5 is configured to determine whether it is necessary to stop the shovel 100 based on various kinds of information. In the present example, the stop determining part F5 determines whether it is necessary to stop the shovel 100 during autonomous travel based on the output of the abnormality monitoring part F4. Specifically, the stop determining part F5 may determine that it is necessary to stop the shovel 100 during autonomous travel when the degree of abnormality of the shovel 100 determined by the abnormality monitoring part F4 exceeds a predetermined threshold. In this case, the controller 30 performs restriction control of the traveling hydraulic motor 2M, serving as a traveling actuator, so as to slow or stop the rotation of the traveling hydraulic motor 2M. Conversely, when the degree of abnormality of the shovel 100 determined by the abnormality monitoring part F4 is less than or equal to the predetermined threshold, the stop determining part F5 determines that it is not necessary to stop the shovel 100 during autonomous travel, that is, the autonomous travel of the shovel 100 can be continued. Further, when a person (operator) is in the cabin of the shovel 100, the stop determining part F5 may determine whether to cancel autonomous travel in addition to whether it is necessary to stop the shovel 100.

The orientation detecting part F6 is configured to detect information on the orientation of the shovel 100. Further, the orientation detecting part F6 may determine whether the shovel 100 is in an orientation suitable for traveling. The orientation detecting part F6 may be configured to allow the shovel 100 to autonomously travel when determining that the shovel 100 is in a an orientation suitable for traveling.

The next work position setting part F7 is configured to set a position where subsequent work is to be performed (hereinafter referred to as an "target intermediate position"). In the present example, when the orientation detecting part F6 determines that the shovel 100 is in an orientation suitable for traveling, and the stop determining part F5 determines that it is not necessary to stop the shovel 100, the next work position setting part F7 may set one or more target intermediate positions on the target travel trajectory. For example, the one or more target intermediate positions may be set based on the moving distance set by the moving distance setting part Fb.

The position calculating part F8 is configured to calculate the current position of the shovel 100. In the present example, the position calculating part F8 calculates the current position of the shovel 100 based on the output of the positioning device P1. When the shovel 100 performs slope work, the target work end position setting part F2 may set the end position of the slope work, as the final target position. Further, the next work position setting part F7 may divide the slope from the start position to the end position of the slope work to a plurality of sections, and set end points of the respective sections as target intermediate positions.

The comparison part F9 is configured to compare a target intermediate position set by the next work position setting part F7 to the current position of the shovel 100 calculated by the position calculating part F8.

The object detecting part F10 is configured to detect an object around the shovel 100. In the present example, the object detecting part F10 detects an object present in a monitoring area around the shovel 100, based on the output of the image capturing device (camera S6). When the object detecting part F10 detects an object (for example, a person) located in the travel direction of the shovel 100 during autonomous travel, the object detecting part F10 generates a stop command for stopping the shovel 100 during autonomous travel. Similarly, when the object detecting part F10 detects an object (for example, a person) in the monitoring area of the shovel 100 during autonomous travel, the object detecting part F10 may generate a stop command for stopping the autonomous travel of the shovel 100. The object detecting part F10 also detects an object (for example, a person) located outside the monitoring area of the shovel 100 during autonomous travel.

The movement command generating part F11 is configured to generate a command related to the movement of the lower traveling body 1. In the present example, the movement command generating part F11 generates a command related to the movement direction and a command related to the movement speed (hereinafter referred to as a "speed command") based on comparison results of the comparison part F9. For example, the movement command generating part F11 may be configured to generate a speed command corresponding to a higher speed as the difference between the target intermediate position and the current position of the shovel 100 increases. The movement command generating part F11 may be configured to generate a speed command that makes the difference close to zero.

In this manner, the controller 30 performs travel control that causes the shovel 100 to autonomously move to an intermediate position, perform predetermined work at the position, and autonomously move to the next intermediate position until reaching the final target position. Further, the movement command generating part F11 may change a speed command value when determining that the shovel 100 is located on an inclined ground based on terrain information, which is preliminarily input, and the detected value of the positioning device P1. For example, when determining that the shovel 100 is located on a downhill slope, the movement command generating part F11 may generate a speed command value corresponding to a speed that is slower than a normal speed. The movement command generating part F11 may obtain terrain information such as an inclination of the ground surface, based on the output of the image capturing device (camera S6). Similarly, the movement command generating part F11 may also generate a speed command value corresponding to a speed that is slower than the normal speed when the object detecting part F10 determines that the road surface is significantly uneven (for example, a large number of stones are present on the road surface) based on the output of the image capturing device (camera S6). As described above, the movement command generating part F11 may change a speed command value based on obtained information on the road surface on the traveling route. For example, when the shovel 100 moves from sand to gravel in a riverbed, the movement command generating part F11 may automatically change a speed command value. Accordingly, the movement command generating part F11 can change the travel speed based on the road surface condition. Further, the movement command generating part F11 may generate a speed command value based on the operation of the attachment. For example, when the shovel 100 is engaged in a slope work (specifically, when the excavation attachment AT is engaged in finishing work from the top to the toe of the slope), the next work position setting part F7 may determine whether to start to move the shovel 100 to the next target intermediate position when determining that the bucket 6 has reached the toe of the slope. Accordingly, the movement command generating part F11 can generate a speed command for the movement of the shovel 100 to the next target intermediate position. Further, the next work position setting part F7 may determine whether to start to move the shovel 100 to the next target intermediate position when determining that the boom 4 is raised to a predetermined height after the bucket 6 reaches the toe of the slope. Then, the movement command generating part F11 may generate a speed command for the movement of the shovel 100 to the next target intermediate position. In this manner, the movement command generating part F11 may set a speed command value based on the operation of the attachment.

The controller 30 may further include a mode setting part configured to set the operating mode of the shovel 100. In this case, when a crane mode is set or a slow mode, such as a slow speed high torque mode, is set as the operating mode of the shovel 100, the movement command generating part F11 generates a speed command value corresponding to the slow mode. As described above, the movement command generating part F11 may change a speed command value (travel speed) based on the state of the shovel 100.

The speed calculating part F12 is configured to calculate the current travel speed of the shovel 100. In the present example, the speed calculating part F12 calculates the current travel speed of the shovel 100 based on the transition of the current position of the shovel 100 calculated by the position calculating part F8.

The calculation part CAL is configured to calculate the difference between the travel speed corresponding to a speed command generated by the movement command generating part F11 and the current speed of the shovel 100 calculated by the speed calculating part F12.

The speed limiting part F13 is configured to limit the travel speed of the shovel 100. In the present example, when the speed difference calculated by the calculation part CAL exceeds a limit value, the speed limiting part F13 outputs the limit value instead of the speed difference. When the speed difference calculated by the calculation part CAL is less than or equal to the limit value, the speed limiting part F13 is configured to output the speed difference directly. The limit value may be a pre-registered value or a dynamically calculated value.

The flow command generating part F14 is configured to generate a command related to the flow rate of hydraulic oil supplied from the main pump 14 to the traveling hydraulic motor 2M. In the present example, the flow command generating part F14 generates a flow command based on the speed difference output by the speed limiting part F13. Basically, the flow command generating part F14 may be configured to generate a flow command corresponding to a higher flow rate as the speed difference increases. The flow command generating part F14 may be configured to generate a flow command that makes the speed difference, calculated by the calculation part CAL, close to zero.

The flow command generated by the flow command generating part F14 is a current command for the proportional valves 31 and 33. The proportional valves 31 and 33 operate in response to the current command to change a pilot pressure acting on the pilot port of the control valve 171. Therefore, the flow rate of hydraulic oil flowing into the left traveling hydraulic motor 2ML is adjusted to be the flow rate corresponding to the flow rate command generated by the flow command generating part F14. The proportional valves 31 and 33 also operate in response to the current command to change a pilot pressure acting on the pilot port of the control valve 172. Therefore, the flow rate of hydraulic oil flowing into the right traveling hydraulic motor 2MR is adjusted to be the flow rate corresponding to the flow rate command generated by the flow command generating part F14. As a result, the travel speed of the shovel 100 is adjusted to be the travel speed corresponding to the speed command generated by the movement command generating part F11. The travel speed of the shovel 100 is a concept that includes the travel direction. This is because the travel direction of the shovel 100 is determined based on the rotation speed and the rotation direction of the left traveling hydraulic motor 2ML and the rotation speed and the rotation direction of the right traveling hydraulic motor 2MR.

In the present example, the flow command generated by the flow command generating part F14 is output to the proportional valves 31 and 33. However, the configuration of the controller 30 is not limited to the above-described configuration. For example, typically, actuators other than the traveling hydraulic motor 2M such as the boom cylinder 7 are not operated during the travel operation of the shovel 100. Therefore, the flow command generated by the flow command generating part F14 may be output to the regulator 13 of the main pump 14. In this case, the controller 30 can control the travel operation of the shovel 100 by controlling the discharge quantity of the main pump 14. The controller 30 may control the steering of the shovel 100 by controlling each of the left regulator 13L and the right regulator 13R, that is, by controlling the discharge quantity of each of the left main pump 14L and the right main pump 14R. Further, the controller 30 may control the travel operation by controlling the amount of hydraulic oil supplied to each of the left traveling hydraulic motor 2ML and the right traveling hydraulic motor 2MR through the proportional valve 31, and may also control the travel speed by controlling the regulator 13.

In this manner, the controller 30 can achieve autonomous travel of the shovel 100 from the current position to the target work end position while causing the shovel 100 to perform work at a target intermediate position as appropriate.

The Att target trajectory updating part F15 is configured to generate a target trajectory of the end of the attachment, that is, a working part (such as the tip) of the bucket 6. Specifically, each time the shovel 100 autonomously moves, the Att target trajectory updating part F15 may update the target trajectory of the working part of the bucket 6, based on the position of the shovel 100 after movement, the relative shape of the intended work surface viewed from the position of the shovel 100 after movement, or the like. For example, the Att target trajectory updating part F15 may generate, as a target trajectory, a trajectory to be followed by the tip of the bucket 6 based on the shape of the intended work surface, the current position of shovel 100, the output (object data) of the object detecting part F10, or the like.

The current tip position calculating part F16 is configured to calculate the current tip position of the bucket 6. In the present embodiment, the current tip position calculating part F16 calculates the coordinate point of the tip of the bucket 6 as the current tip position, based on the output of the orientation detecting part F6 (such as a boom angle $\beta_1$, an arm angle $\beta_2$, a bucket angle $\beta_3$, and a turning angle $\alpha_1$) and the output of the position calculating part F8 (the current position of the shovel 100). The current tip position calculating part F16 may use the output of the body tilt sensor S4 to calculate the current tip position.

The next tip position calculating part F17 is configured to calculate the next tip position as a target tip position on a target trajectory of the tip of the bucket 6. In the present embodiment, the next tip position calculating part F17 calculates a tip position after a predetermined period of time as a target tip position, based on the details of an operation command corresponding to the autonomous operation function, the target trajectory generated by the Att target trajectory updating part F15, and the current tip position calculated by the current tip position calculating part F16.

The next tip position calculating part F17 may determine whether the deviation between the current tip position and the target trajectory of the tip of the bucket 6 is within an acceptable range. In the present example, the next tip position calculating part F17 determines whether the distance between the current tip position and the target trajectory of the tip of the bucket 6 is equal to or less than a predetermined value. If the distance is equal to or less than the predetermined value, the next tip position calculating part F17 determines that the deviation is within the acceptable range, and calculates the target tip position. If the distance exceeds the predetermined value, the next tip position calculating part F17 determines that the deviation is outside the acceptable range, and slows or stops the movement of an actuator irrespective of an operation command corresponding to the autonomous operation function. Accordingly, the controller 30 can prevent the execution of autonomous control from continuing while the tip position is outside the target trajectory.

The tip speed command value generating part F18 is configured to generate a command value related to the tip speed. In the present example, the tip speed command value generating part F18 calculates the tip speed required to move the current tip position to the next tip position in a predetermined period of time as a command value related to the tip speed, based on the current tip position calculating part F16 and the next tip position calculating part F17.

The tip speed command value limiting part F19 is configured to limit the command value related to the tip speed. In the present embodiment, if the tip speed command value limiting part F19 determines that the distance between the tip of the bucket 6 and a predetermined object (such as a dump truck) is less than a predetermined value, based on the current tip position calculated by the current tip position calculating part F16 and the output of the object detecting part F10, the tip speed command value limiting part F19 limits the command value related to the tip speed by a predetermined upper limit value. In this manner, the controller 30 reduces the tip speed if the tip approaches the dump truck 60. Accordingly, the controller 30 can decrease the tip speed when the tip of the bucket 6 approaches the dump truck.

The command value calculating part F20 is configured to calculate a command value for operating an actuator. In the present example, the command value calculating part F20 calculates a command value $\beta_{1r}$ associated with the boom angle $\beta_1$, a command value $\beta_{2r}$ associated with the arm angle $\beta_2$, a command value $\beta_{3r}$ associated with the bucket angle $\beta_3$, and a command value $\alpha_{1r}$ associated with the turning angle $\alpha_1$, based on the target tip position calculated by the next tip position calculating part F17, in order to move the current tip position to the target tip position.

The boom current command generating part F21, the arm current command generating part F31, the bucket current command generating part F41, and the turning current command generating part F51 are configured to generate current commands output to the proportional valves 31 and 33. In the present embodiment, the boom current command generating part F21 outputs a boom current command to the proportional valve 31 corresponding to the control valve 175. The arm current command generating part F31 outputs an arm current command to the proportional valve 31 corresponding to the control valve 176. The bucket current command generating part F41 outputs a bucket current command to the proportional valve 31 corresponding to the control valve 174. The turning current command generating part F51 outputs a turning current command to the proportional valve 31 corresponding to the control valve 173. Each of the boom current command generating part F21, the arm current command generating part F31, the bucket current command generating part F41, and the turning current command generating part F51 may output a pressure reduction command for reducing a pilot pressure, generated by the operating apparatus 26, to a corresponding proportional valve 33.

The boom spool displacement amount calculating part F22, the arm spool displacement amount calculating part F32, the bucket spool displacement amount calculating part F42, and the turning spool displacement amount calculating part F52 are each configured to calculate the amount of displacement of a spool that is included in a spool valve. In the present example, the boom spool displacement amount calculating part F22 calculates the amount of displacement of a boom spool that is included in the control valve 175 pertaining to the boom cylinder 7, based on the output of a boom spool displacement sensor S7. The arm spool displacement amount calculating part F32 calculates the amount of displacement of an arm spool that is included in the control valve 176 pertaining to the arm cylinder 8, based on the output of an arm spool displacement sensor S8. The bucket spool displacement amount calculating part F42 calculates the amount of displacement of a bucket spool that is included in the control valve 174 pertaining to the bucket cylinder 9, based on the output of a bucket spool displacement sensor S9. The turning spool displacement amount calculating part F52 calculates the amount of displacement of a turning spool that is included in the control valve 173 pertaining to the turning hydraulic motor 2A, based on the output of a turning spool displacement sensor S2A.

The boom angle calculating part F23, the arm angle calculating part F33, the bucket angle calculating part F43, and the turning angle calculating part F53 are configured to calculate the rotation angles (orientation angles) of the boom 4, the arm 5, the bucket 6, and the upper turning body 3. In the present example, the boom angle calculating part F23 calculates the boom angle $\beta_1$ based on the output of the boom angle sensor S1. The arm angle calculating part F33 calculates the arm angle $\beta_2$ based on the output of the arm angle sensor S2. The bucket angle calculating part F43 calculates the bucket angle $\beta_3$ based on the output of the bucket angle sensor S3. The turning angle calculating part F53 calculates the turning angle $\alpha_1$ based on the output of the turning state sensor S5. That is, the boom angle calculating part F23, the arm angle calculating part F33, the bucket angle calculating part F43, and the turning angle calculating part F53 may be included in the orientation detecting part F6, and may output the calculated results (the boom angle $\beta_1$, the arm angle $\beta_2$, the bucket angle $\beta_3$, and the turning angle $\alpha_1$) to the current tip position calculating part F16.

Specifically, the boom current command generating part F21 basically generates the boom current command to be output to the proportional valve 31, such that the difference between the command value $\beta_{1r}$ generated by the command value calculating part F20 and the boom angle $\beta_1$ calculated by the boom angle calculating part F23 is zero. At this time, the boom current command generating part F21 adjusts the boom current command such that the difference between a target boom spool displacement amount derived from the boom current command and the amount of displacement of the boom spool calculated by the boom spool displacement amount calculating part F22 is zero. The boom current command generating part F21 outputs the adjusted boom current command to the proportional valve 31 corresponding to the control valve 175.

The proportional valve 31 (proportional valves 31CL and 31CR in FIG. 4C) corresponding to the control valve 175 changes the opening area in accordance with the boom current command, and causes a pilot pressure commensurate with the size of the opening area to act on a pilot port of the control valve 175. The control valve 175 moves the boom spool in accordance with the pilot pressure, and causes hydraulic oil to flow into the boom cylinder 7. The boom spool displacement sensor S7 detects the displacement of the boom spool, and feeds back the detected result to the boom spool displacement amount calculating part F22 of the controller 30. The boom cylinder 7 extends or retracts in accordance with the flow of hydraulic oil to move up or down the boom 4. The boom angle sensor S1 detects the rotation angle of the vertically moving boom 4, and feeds back the detected result to the boom angle calculating part F23 of the controller 30. The boom angle calculating part F23 feeds back the calculated boom angle $\beta_1$ to the boom current command generating part F21.

The arm current command generating part F31 basically generates the arm current command to be output to the proportional valve 31, such that the difference between the command value $\beta_{2r}$ generated by the command value calculating part F20 and the arm angle $\beta_2$ calculated by the arm angle calculating part F33 is zero. At this time, the arm current command generating part F31 adjusts the arm current command such that the difference between a target arm spool displacement amount derived from the arm current command and the amount of displacement of the arm spool calculated by the arm spool displacement amount calculating part F32 is zero. The arm current command generating part F31 outputs the adjusted arm current command to the proportional valve 31 corresponding to the control valve 176.

The proportional valve 31 corresponding to the control valve 176 changes the opening area in accordance with the arm current command, and causes a pilot pressure commensurate with the size of the opening area to act on a pilot port of the control valve 176. The control valve 176 moves the arm spool in accordance with the pilot pressure to cause hydraulic oil to flow into the arm cylinder 8. The arm spool displacement sensor S8 detects the displacement of the arm spool, and feeds back the detected result to the arm spool displacement amount calculating part F32 of the controller 30. The arm cylinder 8 extends or retracts in accordance with the flow of hydraulic oil to open or close the arm 5. The arm angle sensor S2 detects the rotation angle of the opening or closing arm 5, and feeds back the detected result to the arm angle calculating part F33 of the controller 30. The arm angle calculating part F33 feeds back the calculated arm angle $\beta_2$ to the arm current command generating part F31.

The bucket current command generating part F41 basically generates the bucket current command to be output to the proportional valve 31 corresponding to the control valve 174, such that the difference between the command value $\beta_{3r}$ generated by the command value calculating part F20 and the bucket angle $\beta_3$ calculated by the bucket angle calculating part F43 is zero. At this time, the bucket current command generating part F41 adjusts the bucket current command such that the difference between a target bucket spool displacement amount derived from the bucket current command and the amount of displacement of the bucket spool calculated by the bucket spool displacement amount calculating part F42 is zero. The bucket current command generating part F41 outputs the adjusted bucket current command to the proportional valve 31 corresponding to the control valve 174.

The proportional valve 31 (proportional valves 31DL and 31DR in FIG. 4D) corresponding to the control valve 174 changes the opening area in accordance with the bucket current command, and causes a pilot pressure commensurate with the size of the opening area to act on a pilot port of the control valve 174. The control valve 174 moves the bucket spool in accordance with the pilot pressure to cause hydraulic oil to flow into the bucket cylinder 9. The bucket spool displacement sensor S9 detects the displacement of the bucket spool, and feeds back the detected result to the bucket spool displacement amount calculating part F42 of the controller 30. The bucket cylinder 9 extends or retracts in accordance with the flow of hydraulic oil to open or close the bucket 6. The bucket angle sensor S3 detects the rotation angle of the opening or closing bucket 6, and feeds back the detected result to the bucket angle calculating part F43 of the controller 30. The bucket angle calculating part F43 feeds back the calculated bucket angle $\beta_3$ to the bucket current command generating part F41.

The turning current command generating part F51 basically generates the turning current command to be output to the proportional valve 31 corresponding to the control valve 173, such that the difference between the command value $\alpha_{1r}$ generated by the command value calculating part F20 and the turning angle $\alpha_1$ calculated by the turning angle calculating part F53 is zero. At this time, the turning current command generating part F51 adjusts the turning current command such that the difference between a target turning spool displacement amount derived from the turning current command and the amount of displacement of the turning spool displacement amount calculating part F52 is zero. The turning current command generating part F51 outputs the adjusted turning current command to the proportional valve 31 corresponding to the control valve 173.

The proportional valve 31 (proportional valves 31BL and 31BR in FIG. 4B) corresponding to the control valve 173 changes the opening area in accordance with the turning current command, and causes a pilot pressure commensurate with the size of the opening area to act on a pilot port of the control valve 173. The control valve 173 moves the turning spool in accordance with the pilot pressure to cause hydraulic oil to flow into the turning hydraulic motor 2A. The turning spool displacement sensor S2A detects the displacement of the turning spool, and feeds back the detected result to the turning spool displacement amount calculating part F52 of the controller 30. The turning hydraulic motor 2A rotates in accordance with the flow of hydraulic oil to turn the upper turning body 3. The turning state sensor S5 detects the turning angle of the upper turning body 3, and feeds back the detected result to the turning angle calculating part F53 of the controller 30. The turning angle calculating part F53 feeds back the calculated turning angle $\alpha_1$ to the turning current command generating part F51.

As described above, the controller 30 forms a three-stage feedback loop for each working body. That is, the controller 30 forms a feedback loop associated with the amount of displacement of a spool, a feedback loop associated with the rotation angle of a working body, and a feedback loop associated with the tip position. Therefore, the controller 30 can control the movement of the working part (for example, the tip) of the bucket 6 with high accuracy, and execute the autonomous operation function to cause the shovel 100 to perform predetermined work (for example, construction work on a slope that serves as an intended work surface) at each target intermediate position.

Figure 14:
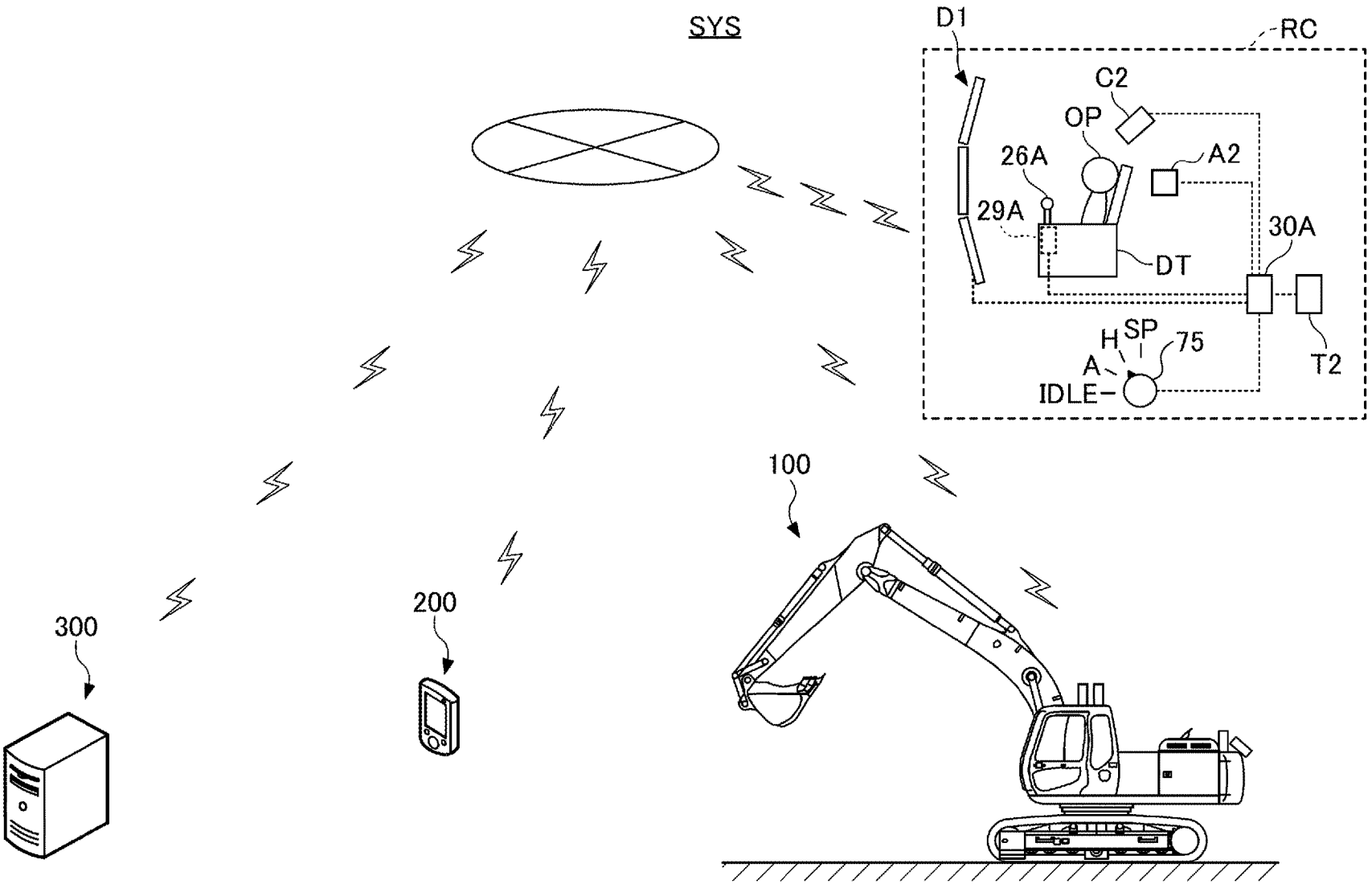
FIG. 14 is a schematic diagram illustrating an example of a construction system.

Next, a construction system SYS will be described with reference to FIG. 14. FIG. 14 is a schematic diagram illustrating an example of the construction system SYS. As illustrated in FIG. 14, the construction system SYS includes the shovel 100, an assist device 200, and the management apparatus 300. The shovel management system SYS is a system that manages one or more shovels 100. The construction system SYS is configured to assist construction work performed by one or more shovels 100.

Information obtained by the shovel 100 may be shared with a manager, other shovel operators, and the like, through the construction system SYS. The construction system SYS may be constituted by one or more shovels 100, one or more assist devices 200, and one or more management apparatuses 300. In the present example, the construction system SYS includes the one shovel 100, the one assist device 200, and the one management apparatus 300.

The assist device 200 is typically a portable terminal device, and is, for example, a laptop computer, a tablet terminal, a smartphone, or the like carried by a worker or the like at a construction site. The assist device 200 may be a portable terminal carried by the operator of the shovel 100. Alternatively, the assist device 200 may be a stationary terminal device.

The management apparatus 300 is typically a stationary terminal apparatus, and is, for example, a server computer installed in a management center or the like outside a construction site (what is known as a cloud server). The management apparatus 300 may be, for example, an edge server installed at a construction site. Further, the management apparatus 300 may be a portable terminal device (for example, a portable terminal such as a laptop computer terminal, a tablet terminal, or a smartphone).

At least one of the assist device 200 and the management apparatus 300 includes a monitor and an operating device for remote control. In this case, an operator using the assist device 200 or the management apparatus 300 may operate the shovel 100 while using the operating device for remote control. The operating device for remote control is communicably connected to the controller 30 installed in the shovel 100 through a wireless communication network such as a short-range communication network, a mobile communication network, a satellite communication network, or the like.

Furthermore, various information images displayed on the display device 40 installed in the cabin 10 (for example, image information showing the surroundings of the shovel 100, various settings screens, and the like) may be displayed on a display device connected to at least one of the assist device 200 and the management apparatus 300. The image information showing the surroundings of the shovel 100 may be generated based on an image captured by the image capturing device (camera S6). This enables a worker using the assist device 200, a manager using the management apparatus 300, or the like to remotely control the shovel 100 and configure various settings related to the shovel 100 while checking the surroundings of the shovel 100.

For example, in the construction system SYS, the controller 30 of the shovel 100 may transmit information on at least one of the time and location at which an autonomous travel switch is pressed, a target route used when the shovel 100 is caused to autonomously move (during autonomous travel), a trajectory actually followed by a predetermined part during autonomous travel, and the like, to at least one of the assist device 200 and the management apparatus 300. In this case, the controller 30 may transmit the output of a space recognition device such as an image capturing device (camera S6) (for example, an image captured by the image capturing device (camera S6)) to at least one of the assist device 200 and the management apparatus 300. The captured image may be multiple images captured during autonomous travel. Furthermore, the controller 30 may transmit information on at least one of data on the details of the movement of the shovel 100, data on the orientation of the shovel 100, data on the orientation of the excavation attachment, and the like, during autonomous travel to at least one of the assist device 200 and the management apparatus 300. This enables a worker using the assist device 200 or a manager using the management apparatus 300 to obtain information on the shovel 100 during autonomous travel.

In this manner, the types and positions of objects monitored outside the monitoring area of the shovel 100 are stored in a storage device of the assist device 200 or the management apparatus 300 in time series. Note that data (information) stored in the assist device 200 or the management apparatus 300 may be the types and positions of objects monitored outside the monitoring area of the shovel 100, but within monitoring areas of other shovels.

Accordingly, the construction system SYS may make it possible to share information on the shovel 100 obtained during autonomous travel with a manger and other shovel operators.

As illustrated in FIG. 14, the communication device T1 installed in the shovel 100 may be configured to transmit and receive information to and from a communication device T2 installed in a remote control room RC via wireless communication. In the example illustrated in FIG. 14, the communication device T1 and the communication device T2 are configured to transmit and receive information to and from each other via a fifth generation mobile communication network (5G network), an LTE network, a satellite network, or the like.

A remote controller 30A, a sound output device A2, an indoor image capturing device C2, a display device D1, the communication device T2, and the like are installed in the remote control room RC. In addition, in the remote control room RC, an operator seat DT is installed for an operator OP who remotely operates the shovel 100.

The remote controller 30A is an arithmetic device configured to execute various computations. In the present embodiment, similar to the controller 30, the remote controller 30A is constituted by a microcomputer including a CPU and a memory. Various functions of the remote controller 30A are implemented by the CPU executing a program stored in the memory.

The sound output device A2 is configured to output sounds. In the present embodiment, the sound output device A2 is a speaker, and is configured to output sounds collected by a sound collecting device (not illustrated) attached to the shovel 100.

The indoor image capturing device C2 is configured to capture an image in the remote control room RC. In the present embodiment, the indoor image capturing device C2 is a camera installed inside the remote control room RC, and is configured to capture an image of the operator OP seated on the operator seat DT.

The communication device T2 is configured to control wireless communication with the communication device T1 attached to the shovel 100.

In the present embodiment, the operator seat DT has a similar structure to that of an operator seat installed in the cabin of a typical shovel. Specifically, a left console box is provided on the left side of the operator seat DT, and a right console box is provided on the right side of the operator seat DT. In addition, a left operating lever is provided on the front end of the top surface of the left console box, and a right operating lever is provided on the front end of the top surface of the right console box. Further, a travel lever and a travel pedal are provided in front of the operator seat DT. Further, a dial 75 is provided at the center of the top surface of the right console box. The left operating lever, the right operating lever, the travel lever, the travel pedal, and the dial 75 constitute an operating apparatus 26A.

The dial 75 is a dial for adjusting the rotational speed of the engine 11, and is configured to be able to switch the engine rotational speed among the four levels, for example.

Specifically, the dial 75 enables the operator to switch the engine rotational speed among the four levels of SP mode, H mode, A mode, and idle mode. The dial 75 transmits data on the settings of the engine rotational speed to the controller 30.

The SP mode is a rotational speed mode selected when the operator OP wishes to prioritize workload, and uses the highest engine rotational speed. The H mode is a rotational speed mode selected when the operator OP wishes to satisfy both workload and fuel efficiency, and uses the second highest engine rotational speed. The A mode is a rotational speed mode selected when the operator OP wishes to operate the shovel with low noise while prioritizing fuel efficiency, and uses the third highest engine rotational speed. The idle mode is a rotational speed mode selected when the operator OP wishes to idle the engine, and uses the lowest engine rotational speed. The engine 11 is controlled to operate constantly at an engine rotational speed corresponding to a rotational speed mode selected through the dial 75.

The operating apparatus 26A is provided with an operating sensor 29A configured to detect the details of an operation using the operating apparatus 26A. The operating sensor 29A may be, for example, a tilt sensor that detects the inclination angle of an operating lever, or an angle sensor that detects the pivot angle around the pivot axis of an operating lever. The operating sensor 29A may be any other sensor such as a pressure sensor, a current sensor, a voltage sensor, or a distance sensor. The operating sensor 29A outputs information on the details of the detected operation using the operating apparatus 26A to the remote controller 30A. The remote controller 30A generates an operation signal based on the received information, and transmits the generated operation signal to the shovel 100. The operating sensor 29A may be configured to generate an operation signal. In this case, the operating sensor 29A may output the operation signal to the communication device T2 without going through the remote controller 30A.

The display device D1 is configured to display information on the situation surrounding the shovel 100. In the present embodiment, the display device D1 is a multi-display configured by nine monitors in a three-by-three array, and is configured to be able to display the situation in the front, to the left, and to the right of the shovel 100. Each of the monitors is a liquid crystal monitor, an organic electroluminescent (EL) monitor, or the like. However, the display device D1 may be one or more curved monitors or may a projector.

The display device D1 may be a display device wearable by the operator OP. For example, the display device D1 may be a head-mounted display, and may be configured to be able to transmit and receive information to and from the remote controller 30A via wireless communication. The head-mounted display may be connected to a remote controller by wire. The head-mounted display may be a transparent head-mounted display, or may be a non-transparent head-mounted display. The head-mounted display may be a monocular head-mounted display, or may be a binocular head-mounted display.

The display device D1 is configured to display images such that the operator OP in the remote control room RC can visually recognize the surroundings of the shovel 100. That is, the display device D1 displays images such that the operator OP in the remote control room RC can check the surroundings of the shovel 100 as if the operator OP is in the cabin 10 of the shovel 100.

Figure 15:
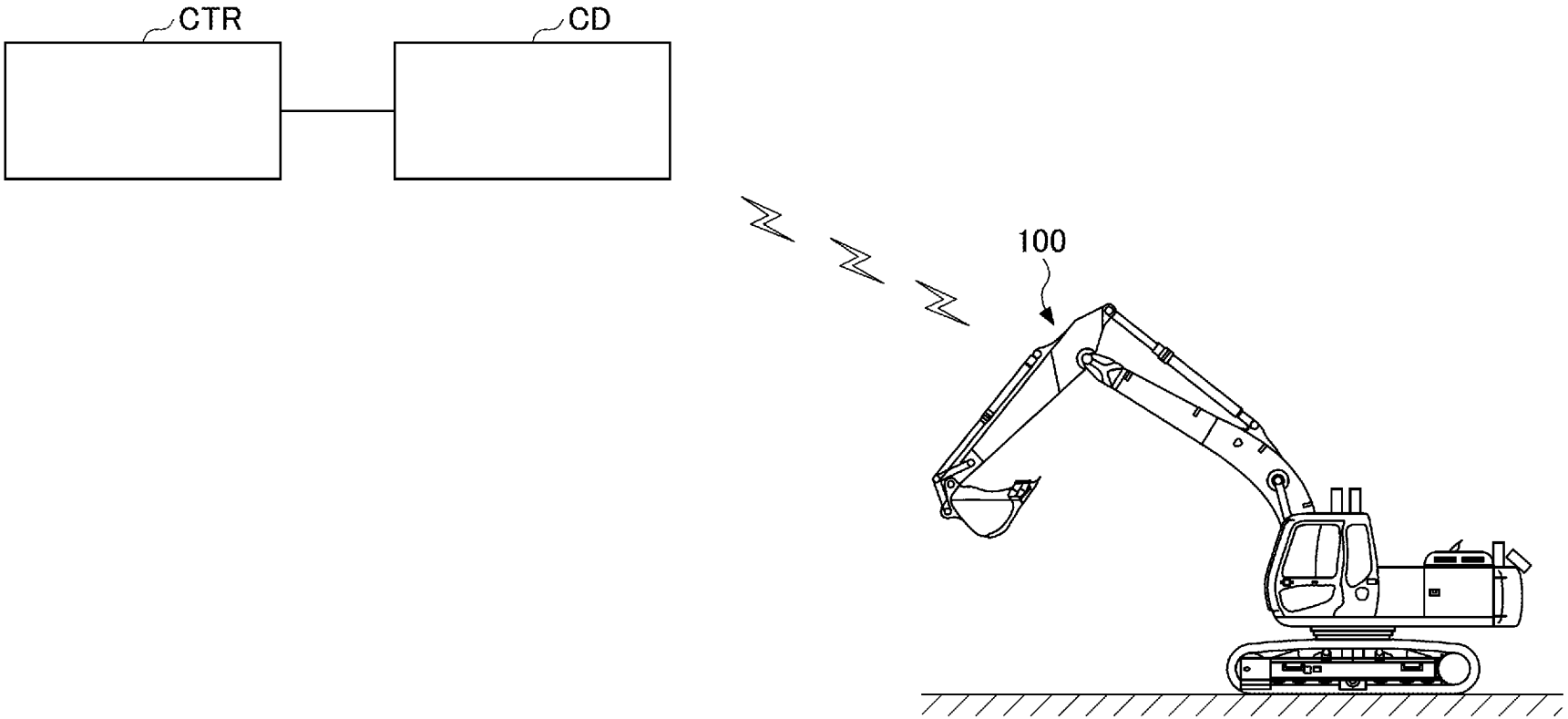
FIG. 15 is a schematic diagram illustrating another example of the construction system.

Next, another example configuration of the construction system SYS will be described with reference to FIG. 15. In the example of FIG. 15, the construction system SYS is configured to assist construction work performed by the shovel 100. Specifically, the construction system SYS includes a communication device CD that performs communication with the shovel 100, and a control device CTR. The control device CTR is configured to set a predetermined condition on the movement of the lower traveling body 1, and when the predetermined condition is satisfied, output information on stopping the movement of the lower traveling body 1 to the shovel 100 via the communication device CD.

Further, the control device CTR may be configured to set a predetermined condition on the movement of the lower traveling body 1, and when the predetermined condition is satisfied, output information on stopping the movement of the lower traveling body 1 to the shovel 100 via the communication device CD such that the traveling hydraulic motor 2M is controlled to stop the movement of the lower traveling body 1.

Accordingly, the shovel 100 according to an embodiment of the present invention includes the lower traveling body 1, the upper turning body 3 turnably mounted on the lower traveling body 1, the attachment attached to the upper turning body 3, and the controller 30 (control device) provided to the upper turning body 3. The controller 30 is configured to set a predetermined condition on the movement of the lower traveling body 1, and provide information on stopping the movement of the lower traveling body 1 when the predetermined condition is satisfied. Further, the controller 30 is configured to set a predetermined condition on the movement of the lower traveling body 1, and control the traveling hydraulic motor 2M to stop the movement of the lower traveling body 1 when the predetermined condition is satisfied.

With the above-described configuration, the movement of the shovel 100 during slope forming work or leveling work can be assisted. As illustrated in FIG. 8, the shovel 100 can position the upper turning body 3 such that a slope area contacted by the slope bucket 6A during the current stroke overlaps with a slope area contacted by the slope bucket 6A during the previous stroke by the predetermined width W2 during slope excavation work. Therefore, as described above with reference to FIG. 9A through FIG. 9D, the shovel 100 can prevent soil from falling out of the slope bucket 6A and being accumulated in the area CS, which is an already-finished slope area. In this case, the operator is not required to move the shovel 100 to the −X side and remove the soil accumulated in the area CS with an additional stroke of the excavation attachment. Accordingly, the shovel 100 can improve the work efficiency of slope forming work.

The above-described predetermined condition may include the lower traveling body 1 having moved a predetermined distance. In this case, the predetermined distance may be determined based on the distance between a predetermined part of the slope bucket 6A before the movement and the predetermined part of the slope bucket 6A after the movement or based on the distance between a predetermined part of the upper turning body 3 before the movement and the predetermined part of the upper turning body 3 after the movement. The predetermined distance may be utilized to position virtual planes PS as illustrated in FIG. 8.

Typically, the predetermined distance is less than the width of the end attachment such as the slope bucket 6A. With this configuration, in the shovel 100, the slope area contacted by the slope bucket 6A during the current stroke can securely overlap with the slope area contacted by the slope bucket 6A during the previous stroke.

As illustrated in FIG. 8, the predetermined distance is preferably determined such that the area CS2, which is an example of a first area where work using the excavation attachment is performed immediately before the movement of the lower traveling body 1, and the area CS1, which is an example of a second area where the work using the excavation attachment is performed immediately after the movement of the lower traveling body, overlap with each other. The area CS1, which is the example of the second area, preferably overlaps with the area CS2, which is the example of the first area, from when the work using the attachment, which is performed immediately after the movement of the lower traveling body 1, is started until when the work using the attachment is finished. That is, the predetermined distance is determined such that the area CS1 and the area CS2 overlap over the entire slope length from the top TS to the toe FS. However, the predetermined distance may be determined such that the area CS1 and the area CS2 overlap only in a portion, such as the first half or the second half, of the slope length, rather than overlapping over the entire slope length.

Typically, the area DS1 where the area CS1, which is the example of the second area, and the area CS2, which is the example of the first area, overlap with each other increases as the volume of soil loaded into the slope bucket 6A during the work using the attachment, which is performed immediately after the movement of the lower traveling body 1, increases. This is because as the area DS1 decreases, the width of an area that is newly excavated within the area NS increases, and the volume of soil loaded into the slope bucket 6A thus increases. Then, if the volume of the soil loaded into the slope bucket 6A exceeds the capacity of the slope bucket 6A, soil falling out of the slope bucket 6A would remain in the area CS2.

The above-described volume is preferably calculated based on data on the intended work surface, data on the current ground surface ES, data on the size of the slope bucket 6A, and data on the distance between a work start position and a work end position. In this case, the predetermined distance is preferably determined based on the volume.

The controller 30 is preferably configured to perform control that causes the upper turning body 3 to front-face the intended work surface during the movement of the lower traveling body 1.

Although the embodiments of the present invention have been described in detail above, the present invention is not limited to the above-described embodiments. Variations and replacements, may be applied to the above-described embodiments without departing from the scope of the present invention. Furthermore, the separately described features may be suitably combined as long as no technical contradiction occurs.

In the above-described embodiments, for example, the controller 30 causes the turning hydraulic motor 2A to automatically operate such that the upper turning body 3 front-faces the intended work surface. However, the controller 30 may cause a turning electric motor to automatically operate such that the upper turning body 3 front-faces the intended work surface.

What is claimed is:

1. A shovel comprising:

a lower traveling body;

an upper turning body turnably mounted on the lower traveling body;

an attachment including a boom attached to the upper turning body, an arm attached to the boom, and an end attachment attached to the arm; and a computer mounted on the upper turning body, the computer including a processor and a memory, wherein the computer is configured to, before each time an excavation is performed while the shovel is in operation, dynamically determine a next location of a virtual plane to be reached by the shovel for the excavation, the virtual plane including a normal to an intended work surface and passing through a center point of the shovel and through the attachment along a longitudinal direction thereof, wherein the computer is configured to determine the next location of the virtual plane by determining a distance between a current location of the virtual plane and the next location of the virtual plane such that a volume of soil to be loaded into the end attachment during the excavation equals a volume of the end attachment, wherein the computer is configured to calculate the volume of soil to be loaded into the end attachment based on data on the intended work surface, data on a current ground surface, data on a size of the end attachment, and data on a work start position and a work end position of the excavation, and wherein the computer is configured to, when the lower traveling body is in motion, notify an operator of the shovel of a remaining distance between the center point of the shovel and the next location of the virtual plane through at least one of a display or a sound output device, upon determining that the remaining distance is less than or equal to a threshold.

2. A shovel comprising:

a lower traveling body;

a traveling hydraulic motor configured to move the lower traveling body;

an upper turning body turnably mounted on the lower traveling body;

an attachment including a boom attached to the upper turning body, an arm attached to the boom, and an end attachment attached to the arm; and a computer mounted on the upper turning body, the computer including a processor and a memory, wherein the computer is configured to, when the lower traveling body is in motion, control the traveling hydraulic motor to stop a movement of the lower traveling body upon determining that the lower traveling body has moved a predetermined distance, and the computer is configured to, before an excavation each time the excavation is performed, dynamically determine the predetermined distance based on a volume of soil to be loaded into the end attachment during the excavation, while the shovel is in operation.

3. The shovel according to claim 2, wherein the computer is configured to determine a distance of the movement of the lower traveling body based on a distance between a predetermined part of the end attachment before the movement of the lower traveling body and the predetermined part of the end attachment after the movement of the lower traveling body, or based on a distance between a predetermined part of the upper turning body before the movement of the lower traveling body and the predetermined part of the upper turning body after the movement of the lower traveling body.

4. The shovel according to claim 3, wherein the predetermined distance is less than a width of the end attachment.

5. The shovel according to claim 3, wherein the computer is configured to dynamically determine the predetermined distance such that a first area and a second area overlap with each other, the first area being an area excavated using the attachment immediately before the movement of the lower traveling body, and the second area being an area to be excavated using the attachment immediately after the movement of the lower traveling body.

6. The shovel according to claim 5, wherein the computer is configured to dynamically determine the predetermined distance such that there is an overlap between the first area and the second area throughout excavation of the second area using the attachment.

7. The shovel according to claim 5, wherein the computer is configured to dynamically determine the predetermined distance such that the overlap between the first area and the second area increases as the volume of the soil to be loaded into the end attachment during the excavation of the second area increases.

8. The shovel according to claim 2, wherein the volume of the soil to be loaded into the end attachment during the excavation is calculated based on data on an intended work surface, data on a current ground surface, data on a size of the end attachment, and data on a distance between a start position and an end position of the excavation.

9. The shovel according to claim 2, wherein the computer is configured to control the upper turning body to front-face an intended work surface during the movement of the lower traveling body.

10. A construction system comprising:

a shovel including a lower traveling body, an upper turning body turnably mounted on the lower traveling body, and an attachment including a boom attached to the upper turning body, an arm attached to the boom, and an end attachment attached to the arm;

a display configured to output information to and receive information; and a computer including a processor and a memory, the computer being configured to remotely control the shovel, wherein the computer is configured to, before each time an excavation is performed while the shovel is in operation, dynamically determine a next location of a virtual plane to be reached by the shovel for the excavation, the virtual plane including a normal to an intended work surface and passing through a center point of the shovel and through the attachment along a longitudinal direction thereof, wherein the computer is configured to determine the next location of the virtual plane by determining a distance between a current location of the virtual plane and the next location of the virtual plane such that a volume of soil to be loaded into the end attachment during the excavation equals a volume of the attachment, wherein the computer is configured to calculate the volume of soil to be loaded into the end attachment based on data on the intended work surface, data on a current ground surface, data on a size of the end attachment, and data on a work start position and a work end position of the excavation, wherein the computer is configured to control the display to display an image indicating the next location of the virtual plane and information on a remaining distance between the center point of the shovel and the next location of the virtual plane in an overhead view image of an area surrounding the shovel, and wherein the computer is configured to update the information on the remaining distance as the shovel moves.

11. The construction system according to claim 10, wherein the computer is configured to output the remaining distance to the display.

12. A construction system for assisting construction work to be performed using a shovel, the shovel including a lower traveling body; a traveling hydraulic motor configured to move the lower traveling body; an upper turning body turnably mounted on the lower traveling body; and an attachment including a boom attached to the upper turning body, an arm attached to the boom, and an end attachment attached to the arm, the construction system comprising:

a computer including a processor and a memory, the computer being configured to, when the lower traveling body is in motion, output a command to the shovel, the command being a command to control the traveling hydraulic motor to stop a movement of the lower traveling body, upon determining that the lower traveling body has moved a predetermined distance, wherein the computer is configured to, before each time an excavation is performed, dynamically determine the predetermined distance while the shovel is in operation, wherein the computer is configured to dynamically determine the predetermined distance such that a volume of soil to be load into the end attachment during the excavation to be performed immediately after the shovel moves the predetermined distance equals a volume of the end attachment, and wherein the computer is configured to calculate the volume of soil to be loaded into the end attachment based on data on the intended work surface, data on a current ground surface, data on a size of the end attachment, and data on a work start position and a work end position of the excavation.

13. The construction system according to claim 12, wherein the computer is configured to determine a distance of the movement of the lower traveling body based on a distance between a predetermined part of the end attachment before the movement of the lower traveling body and the predetermined part of the end attachment after the movement of the lower traveling body, or based on a distance between a predetermined part of the upper turning body before the movement of the lower traveling body and the predetermined part of the upper turning body after the movement of the lower traveling body.

14. The construction system according to claim 13, wherein the predetermined distance is less than a width of the end attachment.

* * * * *